US010658792B2

(12) United States Patent
Drewnicki et al.

(10) Patent No.: US 10,658,792 B2
(45) Date of Patent: May 19, 2020

(54) ELECTRICAL DATA CONNECTOR

(71) Applicants: Alexander Drewnicki, Northampton (GB); Leigh Drewnicki, Northampton (GB); Richard Drewnicki, Northampton (GB)

(72) Inventors: Alexander Drewnicki, Northampton (GB); Leigh Drewnicki, Northampton (GB); Richard Drewnicki, Northampton (GB)

( * ) Notice: Subject to any disclaimer, the term of this patent is extended or adjusted under 35 U.S.C. 154(b) by 0 days.

(21) Appl. No.: 16/095,423

(22) PCT Filed: Apr. 21, 2017

(86) PCT No.: PCT/GB2017/051121
§ 371 (c)(1),
(2) Date: Oct. 22, 2018

(87) PCT Pub. No.: WO2017/182825
PCT Pub. Date: Oct. 26, 2017

(65) Prior Publication Data

US 2019/0140395 A1 May 9, 2019

(30) Foreign Application Priority Data

Apr. 21, 2016 (GB) ..... 1606958.5

(51) Int. Cl.
*H01R 24/60* (2011.01)
*H01R 13/627* (2006.01)
(Continued)

(52) U.S. Cl.
CPC ..... *H01R 13/6275* (2013.01); *H01R 13/502* (2013.01); *H01R 13/62905* (2013.01);
(Continued)

(58) Field of Classification Search
CPC ..... H01R 13/6275; H01R 13/502; H01R 13/6582; H01R 13/62905; H01R 2107/00;
(Continued)

(56) References Cited

U.S. PATENT DOCUMENTS 5,554,045 A 9/1996 Bethurum
6,010,344 A * 1/2000 Muramatsu ..... G06K 13/08 439/159

(Continued)

FOREIGN PATENT DOCUMENTS

EP 2245707 A2 11/2010
WO WO 2009/065051 A1 5/2009

OTHER PUBLICATIONS

International Search Report dated Jun. 27, 2017 in corresponding International Application No. PCT/GB2017/051121 (2 pages in English).

(Continued)

*Primary Examiner* — Truc T Nguyen
(74) *Attorney, Agent, or Firm* — NSIP Law

(57) ABSTRACT

An electrical data connector comprises a plug that is configured for insertion in a longitudinal direction into a complementary receptacle. The plug includes a connector element that is configured to be received within the receptacle and carries a plurality of electrical connectors, a body that is located externally of the receptacle when the connector element is inserted into the receptacle, and a releasable locking mechanism for locking the plug positively to the receptacle to prevent unintentional removal of the plug from the receptacle. The locking mechanism includes a locking element carried by the connector that is configured for movement between a locked configuration in which it protrudes from the connector element and an unlocked configuration in which it does not protrude substantially from the connector element, a locking control, provided on (Continued)

the body, for manually actuating the locking mechanism, and a drive mechanism that connects the locking control to the locking element, whereby operation of the locking control actuates the locking element. The drive mechanism includes at least one longitudinal sliding element that is connected to the locking control and at least one transverse sliding element that is connected to the locking element, wherein said longitudinal and transverse sliding elements are located in a common plane and are configured such that longitudinal movement of the longitudinal sliding element drives transverse movement of the transverse sliding element, thereby actuating the locking element.

19 Claims, 39 Drawing Sheets

(51) Int. Cl.

| | |
|---|---|
| ***H01R 13/629*** | (2006.01) |
| ***H01R 13/502*** | (2006.01) |
| ***H01R 13/6582*** | (2011.01) |
| *H01R 13/639* | (2006.01) |
| *H01R 107/00* | (2006.01) |

(52) U.S. Cl.
CPC ... *H01R 13/6582* (2013.01); *H01R 13/62927* (2013.01); *H01R 13/639* (2013.01); *H01R 24/60* (2013.01); *H01R 2107/00* (2013.01)

(58) Field of Classification Search
CPC . H01R 24/60; H01R 13/639; H01R 13/62927
See application file for complete search history.

(56) References Cited

U.S. PATENT DOCUMENTS

| | | | | |
|---|---|---|---|---|
| 7,507,103 | B1 * | 3/2009 | Phillips | G02B 6/4201 439/352 |
| 2003/0228788 | A1 | 12/2003 | Igarashi et al. | |
| 2004/0087206 | A1 * | 5/2004 | Grubbs | H01R 13/52 439/489 |
| 2009/0042433 | A1 * | 2/2009 | Bushby | H01R 13/4538 439/352 |
| 2009/0075513 | A1 * | 3/2009 | Amidon | H01R 13/6275 439/352 |
| 2010/0278539 | A1 * | 11/2010 | Kasbeer-Betty | G02B 6/4201 398/135 |
| 2010/0281209 | A1 * | 11/2010 | Ni | G06K 19/07732 711/103 |
| 2010/0311283 | A1 | 12/2010 | Desrosiers et al. | |
| 2012/0294571 | A1 * | 11/2012 | Kappla | H01R 13/6275 385/76 |
| 2014/0004732 | A1 * | 1/2014 | Heil | H01R 13/6275 439/352 |
| 2014/0169865 | A1 * | 6/2014 | Kurumizawa | H01R 13/639 403/322.1 |
| 2015/0017824 | A1 | 1/2015 | Kung | |
| 2016/0322747 | A1 * | 11/2016 | Jian | H01R 13/639 |
| 2017/0110831 | A1 * | 4/2017 | Su | H01R 13/639 |
| 2017/0110898 | A1 * | 4/2017 | Kyriakoulis | H02J 7/0042 |
| 2017/0170596 | A1 * | 6/2017 | Goossens | H01R 13/5202 |

OTHER PUBLICATIONS

United Kingdom Search Report dated Sep. 30, 2016 in corresponding United Kingdom Application No. GB1606958.5 (3 pages in English).

* cited by examiner 2
4
6
7
7a
7b
12
4a
4b

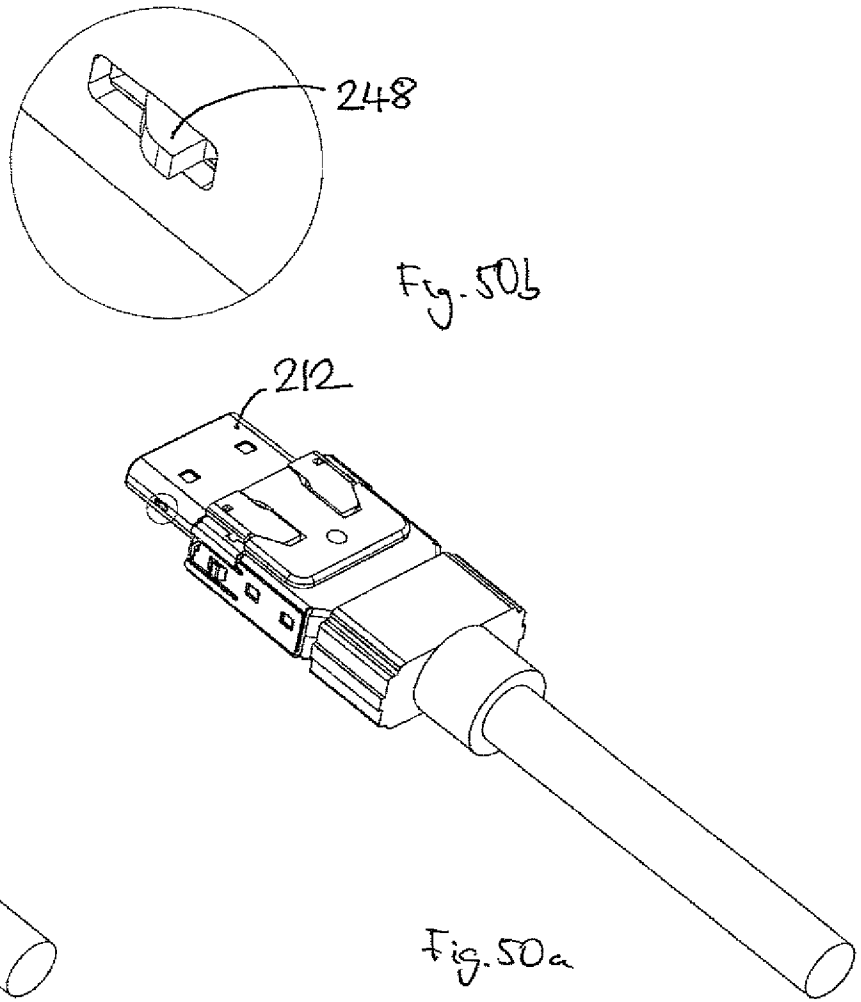
Fig. 50b
Fig. 50a
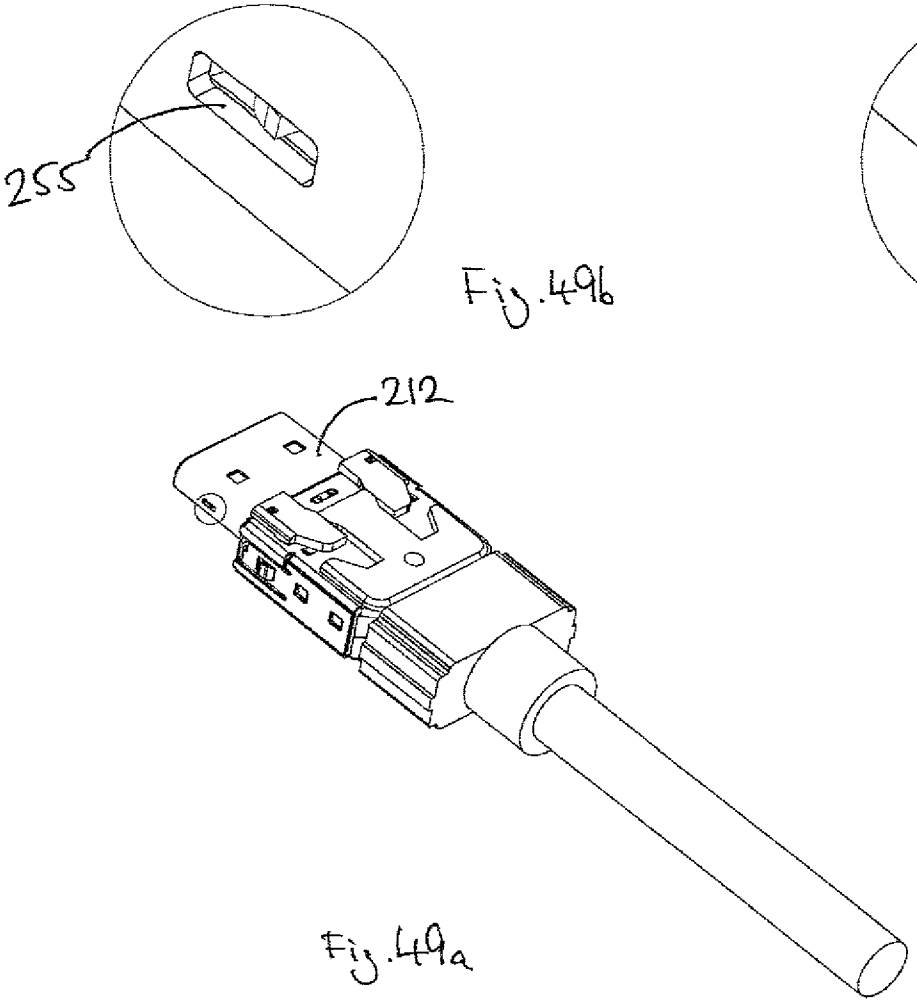
Fig. 49b
Fig. 49a

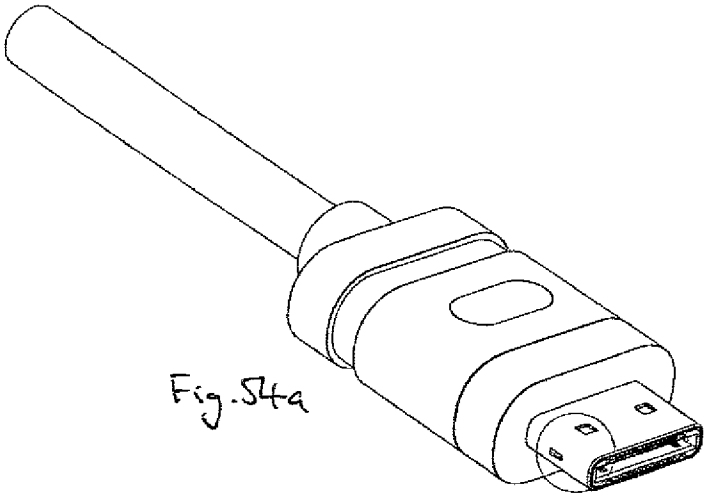
Fig. S44a
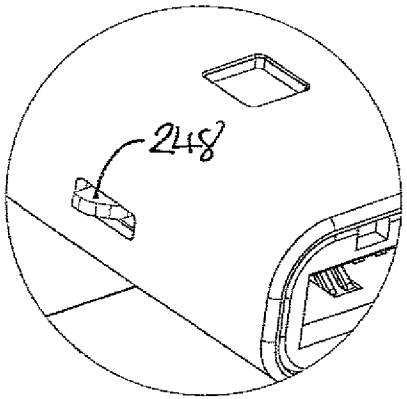
Fig S44b
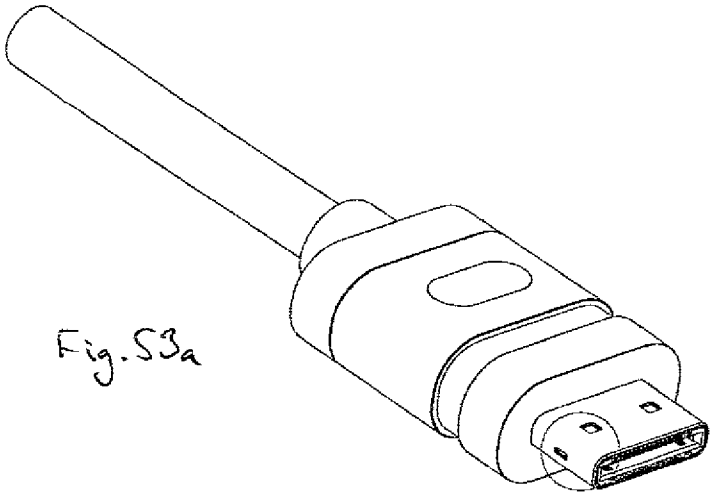
Fig. S3a
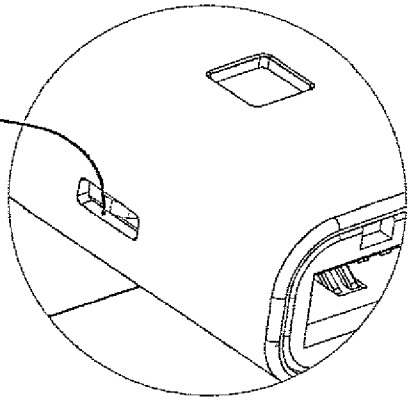
Fig. S3b 206
248
256

206
256

202
204

206
207
207a
257

302
304
316
317
318
314

313
317
304
308
310''
310
310'
312'
312
329
328'
328
326
326'
324'
324
322

342
330
330
346
344
340
348
320
316
317
313'

306

ELECTRICAL DATA CONNECTOR

CROSS REFERENCE TO RELATED APPLICATION(S)

This application is a U.S. National Stage Application of International Application No. PCT/GB2017/051121, filed on Apr. 21, 2017, which claims the benefit under 35 USC 119(a) and 365(b) of United Kingdom Patent Application No. 1606958.5, filed on Apr. 21, 2016, in the United Kingdom Intellectual Property Office.

TECHNICAL FIELD

The present invention relates to an electrical data connector, for example, but not exclusively, of the type known as the mini display port, the superMHL or HDMI connector. In particular, but not exclusively, the invention relates to the plug part of an electrical data connector, which can be connected to a suitable plug receptacle.

BACKGROUND

The mini display port (or mDP) is a well-known type of electrical data connector that is used as a digital interface between display devices and computers. The mDP carries a maximum of 20 connection pins arranged in two rows of 10 pins, mounted within a D-shaped metallic shield. The plug part of the mDP usually has one or more locking holes, which can be engaged by spring-loaded detents on the plug receptacle (or socket), to retain the plug in the receptacle.

The superMHL connector is another type of electrical data connector that is used as a digital interface between display devices and computers. The superMHL connector is reversible and carries a maximum of 32 connection pins for data, video and power.

The HDMI connector is another type of electrical data connector that is used as a digital interface between display devices and computers. There are several types of connectors which are defined in the HDMI 1.0, 1.3 and 1.4 specifications respectively. The HDMI connector has 19 pins.

One problem with many conventional data connectors including mDP, superMHL and HDMI connectors is that the plug does not lock positively into the receptacle and can in some circumstances become disconnected from the receptacle, leading to a loss of the data signal.

Various mechanisms are known for locking a plug into a receptacle, which employ a releasable positive locking mechanism. For example, a locking HDMI plug is described in EP2245707B1. However, we have found that the locking mechanism of this known device does not always operate smoothly and may sometimes be difficult to engage and/or disengage, particularly if too much pressure is applied to the manually actuatable locking/unlocking sleeve. The mechanism is also too large to be accommodated within the very small housings that are specified for some modern connectors, such as mDP and superMHL plugs.

It is an object of the present invention to provide an electrical data connector that mitigates one or more of the aforesaid problems.

SUMMARY

According to one aspect of the present invention there is provided an electrical data connector comprising a plug that is configured for insertion in a longitudinal direction into a complementary receptacle, the plug including a connector element that is configured to be received within the receptacle and carries a plurality of electrical connectors, a body that is located externally of the receptacle when the connector element is inserted into the receptacle, and a releasable locking mechanism for locking the plug positively to the receptacle to prevent unintentional removal of the plug from the receptacle. The locking mechanism includes a locking element carried by the connector that is configured for movement between a locked configuration in which it protrudes from the connector element and an unlocked configuration in which it does not protrude substantially from the connector element, a locking control, provided on the body, for manually actuating the locking mechanism, and a drive mechanism that connects the locking control to the locking element, whereby operation of the locking control actuates the locking element. The drive mechanism includes at least one longitudinal sliding element that is connected to the locking control and at least one transverse sliding element that is connected to the locking element, wherein said longitudinal and transverse sliding elements are located in a common plane and are configured such that longitudinal movement of the longitudinal sliding element drives transverse movement of the transverse sliding element, thereby actuating the locking element.

When the locking element is in the locked configuration it protrudes from the connector element to engage a corresponding locking formation on the receptacle, thereby locking plug positively into the receptacle and preventing it from being withdrawn from the receptacle, even when subjected to a substantial force or to normal movement or vibration. When the locking element is in the unlocked configuration it does not protrude substantially from the connector element, and is preferably positioned flush with or below the surface of the connector element so that it does not impede insertion or removal of the plug.

The locking mechanism allows the plug to be locked positively into the receptacle, thus preventing accidental or unintentional removal of the plug from the receptacle. A good data connection is thus ensured. The locking mechanism is easily actuated, allowing the lock to be applied or released as required. In particular, by locating the longitudinal and transverse sliding elements in a common plane, so that only the edges of the sliding elements come into engagement, friction within the mechanism is considerably reduced, thus avoiding the problems encountered with some previous locking mechanisms. The locking mechanism is also extremely compact, allowing it to be accommodated within a small housing, for example that meets the defined specifications for mDP or superMHL plugs. The locking mechanism is also efficient and reliable, while being simple and economical to manufacture.

In one embodiment, the locking element comprises at least one pin that is rotatable about a longitudinal pivot axis, said pin including a crank portion at a first end that engages the transverse sliding element and a hook portion at a second end that extends substantially perpendicular to the longitudinal pivot axis, wherein the hook portion is rotatable between a locked position in which it protrudes from the connector element and an unlocked position in which it does not protrude substantially from the connector element. Optionally, the hook portion extends substantially perpendicular to the common plane when in the locked position. The hook portion may for example extend through a hole in the connector element to engage a corresponding locking formation on the receptacle, such as the edge of an aperture that surrounds a conventional retention detent.

In another embodiment, the locking element comprises at least one pivoting arm that is pivotable about a pivot axis that is substantially perpendicular to the longitudinal insertion direction, said arm including a first end of the arm that engages the transverse sliding element and a hook portion at a second end of the arm, wherein the hook portion is pivotable between a locked position in which it protrudes from the connector element and an unlocked position in which it does not protrude substantially from the connector element. Optionally, the pivot axis of the arm is substantially perpendicular to the common plane, so that the hook extends outwards from the side of the connector element. Optionally, two pivoting arms may be provided on opposite sides of the plug.

Optionally, the drive mechanism includes a pivoting element located in the common plane and configured for rotation about a pivot axis that is substantially perpendicular to the common plane, wherein the pivoting element is configured to cooperate with the longitudinal sliding element and the transverse sliding element, whereby movement of the longitudinal sliding element in a first longitudinal direction drives movement of the transverse sliding element in a first transverse direction which drives rotation of the pivoting element in a first rotational direction, and movement of the longitudinal sliding element in a second longitudinal direction drives rotation of the pivoting element in a second rotational direction which drives movement of the transverse sliding element in a second transverse direction. This mechanism is simple but reliable in operation and ensures that the elements of the drive mechanism move synchronously during both locking and unlocking actuation of the locking mechanism.

According to an alternative embodiment, the longitudinal sliding element includes first and second cam surfaces, which engage respectively first and second cam surfaces of the transverse sliding element, whereby movement of the longitudinal sliding element in a first longitudinal direction drives movement of the transverse sliding element in a first transverse direction through the first respective cam surfaces, and movement of the longitudinal sliding element in a second longitudinal direction drives movement of the transverse sliding element in a second transverse direction through the second respective cam surfaces. This mechanism is also simple but reliable in operation and again ensures that the elements of the drive mechanism move synchronously during both locking and unlocking actuation of the locking mechanism.

Optionally, the locking mechanism includes a pair of transverse sliding elements, each having first and second cam surfaces, and the longitudinal sliding element has two sets of first and second cam surfaces for engagement respectively with the first and second cam surfaces of the two transverse sliding elements. This permits a pair of locking arms on opposite sides of the connector element to be actuated simultaneously.

Optionally, the locking control is configured for sliding movement relative to the body in the longitudinal direction.

Optionally, the plug is an mDP plug, a HDMI plug or a superMHL plug. Alternatively, the plug may be any other suitable type of electrical data connector.

BRIEF DESCRIPTION OF DRAWINGS

Certain embodiments of the invention will now be described, by way of example, with reference to the accompanying drawings, in which:

FIGS. 1 and 2 are isometric views from the rear showing a mini display port plug in an unlocked configuration, wherein FIG. 1 is an exploded view and FIG. 2 shows a fully assembled plug;

FIGS. 3*a* and 3*b* are isometric views from the rear showing the mini display port plug in an unlocked configuration, wherein FIG. 3*b* shows part of the plug at an enlarged scale;

FIGS. 4*a* and 4*b* are isometric views from the rear showing the mini display port plug in a locked configuration, wherein FIG. 4*b* shows part of the plug at an enlarged scale;

FIGS. 5*a* and 5*b* are isometric views from the rear showing the mini display port plug in an unlocked configuration with the outer casing partially cut away, wherein FIG. 5*b* shows part of the plug at an enlarged scale;

FIGS. 6*a* and 6*b* are isometric views from the rear showing the mini display port plug in a locked configuration with the outer casing partially cut away, wherein FIG. 6*b* shows part of the plug at an enlarged scale;

FIGS. 7*a* and 7*b* are isometric views from the front showing the mini display port plug in an unlocked configuration, wherein FIG. 7*b* shows part of the plug at an enlarged scale;

FIGS. 8*a* and 8*b* are isometric views from the front showing the mini display port plug in a locked configuration, wherein FIG. 8*b* shows part of the plug at an enlarged scale;

FIGS. 9*a* and 9*b* are isometric views from the front showing the mini display port plug in an unlocked configuration with the outer casing removed, wherein FIG. 9*b* shows part of the plug at an enlarged scale;

FIGS. 10*a* and 10*b* are isometric views from the front showing the mini display port plug in a locked configuration with the outer casing removed, wherein FIG. 10*b* shows part of the plug at an enlarged scale;

FIGS. 11*a*, 11*b*, 12*a*, 12*b*, 13*a* and 13*b* are isometric views from the rear showing the mini display port plug and a receptacle for the plug, wherein FIGS. 11*a* and 11*b* show the plug and receptacle while disengaged, FIGS. 12*a* and 12*b* show the plug and receptacle in an engaged and unlocked configuration, and FIGS. 13*a* and 13*b* show the plug and receptacle in an engaged and locked configuration, and wherein FIGS. 11*b*, 12*b* and 13*b* show parts of the plug and/or the receptacle at an enlarged scale;

FIGS. 14*a*, 14*b*, 15*a*, 15*b*, 16*a* and 16*b* are isometric views from the rear showing the mini display port plug with the outer casing removed and a receptacle for the plug, wherein FIGS. 14*a* and 14*b* show the plug and receptacle while disengaged, FIGS. 15*a* and 15*b* show the plug and receptacle in an engaged and unlocked configuration, and FIGS. 16*a* and 16*b* show the plug and receptacle in an engaged and locked configuration, and wherein FIGS. 14*b*, 15*b* and 16*b* show parts of the plug and/or the receptacle at an enlarged scale;

FIGS. 17*a*, 17*b*, 18*a*, 18*b*, 19*a* and 19*b* are isometric views from the front showing the mini display port plug and a receptacle for the plug, wherein FIGS. 17*a* and 17*b* show the plug and receptacle while disengaged, FIGS. 18*a* and 18*b* show the plug and receptacle in an engaged and unlocked configuration, and FIGS. 19*a* and 19*b* show the plug and receptacle in an engaged and locked configuration, and wherein FIGS. 17*b*, 18*b* and 19*b* show parts of the plug and/or the receptacle at an enlarged scale;

FIGS. 20*a*, 20*b*, 21*a*, 21*b*, 22*a* and 22*b* are isometric views from the front showing the mini display port plug with the outer casing removed and a receptacle for the plug, wherein FIGS. 20*a* and 20*b* show the plug and receptacle while disengaged, FIGS. 21*a* and 21*b* show the plug and receptacle in an engaged and unlocked configuration, and FIGS. 22*a* and 22*b* show the plug and receptacle in an engaged and locked configuration, and wherein FIGS. 20*b*, 21*b* and 22*b* show parts of the plug and/or the receptacle at an enlarged scale;

FIGS. 23 and 24 are isometric views from the rear showing a first superMHL plug comprising a second embodiment of the invention in an unlocked configuration, wherein FIG. 23 is an exploded view and FIG. 24 shows a fully assembled plug;

FIGS. 25*a* and 25*b* are isometric views from the rear showing the first superMHL plug in an unlocked configuration, wherein FIG. 25*b* shows part of the plug at an enlarged scale;

FIGS. 26*a* and 26*b* are isometric views from the rear showing the first superMHL plug in a locked configuration, wherein FIG. 26*b* shows part of the plug at an enlarged scale;

FIGS. 27*a* and 27*b* are isometric views from the rear showing the first superMHL plug in an unlocked configuration with the outer casing partially cut away, wherein FIG. 27*b* shows part of the plug at an enlarged scale;

FIGS. 28*a* and 28*b* are isometric views from the rear showing the first superMHL plug in a locked configuration with the outer casing partially cut away, wherein FIG. 28*b* shows part of the plug at an enlarged scale;

FIGS. 29*a* and 29*b* are isometric views from the front showing the first superMHL plug in an unlocked configuration, wherein FIG. 29*b* shows part of the plug at an enlarged scale;

FIGS. 30*a* and 30*b* are isometric views from the front showing the first superMHL plug in a locked configuration, wherein FIG. 30*b* shows part of the plug at an enlarged scale;

FIGS. 31*a* and 31*b* are isometric views from the front showing the first superMHL plug in an unlocked configuration with the outer casing removed, wherein FIG. 31*b* shows part of the plug at an enlarged scale;

FIGS. 32*a* and 32*b* are isometric views from the front showing the first superMHL plug in a locked configuration with the outer casing removed, wherein FIG. 32*b* shows part of the plug at an enlarged scale;

FIGS. 33, 34*a*, 34*b*, 35*a* and 35*b* are isometric views from the rear showing the first superMHL plug and a receptacle for the plug, wherein FIG. 33 shows the plug and receptacle while disengaged, FIGS. 34*a* and 34*b* show the plug and receptacle in an engaged and unlocked configuration, and FIGS. 35*a* and 35*b* show the plug and receptacle in an engaged and locked configuration, and wherein FIGS. 34*b* and 35*b* show parts of the plug and/or the receptacle at an enlarged scale;

FIGS. 36, 37*a*, 37*b*, 38*a* and 38*b* are isometric views from the rear showing the first superMHL plug with the outer casing removed and a receptacle for the plug, wherein FIG. 36 shows the plug and receptacle while disengaged, FIGS. 37*a* and 37*b* show the plug and receptacle in an engaged and unlocked configuration, and FIGS. 38*a* and 38*b* show the plug and receptacle in an engaged and locked configuration, and wherein FIGS. 37*b* and 38*b* show parts of the plug and/or the receptacle at an enlarged scale;

FIGS. 39, 40*a*, 40*b*, 41*a* and 41*b* are isometric views from the front showing the first superMHL plug and a receptacle for the plug, wherein FIG. 39 shows the plug and receptacle while disengaged, FIGS. 40*a* and 40*b* show the plug and receptacle in an engaged and unlocked configuration, and FIGS. 41*a* and 41*b* show the plug and receptacle in an engaged and locked configuration, and wherein FIGS. 40*b* and 41*b* show parts of the plug and/or the receptacle at an enlarged scale;

FIGS. 42, 43*a*, 43*b*, 44*a* and 44*b* are isometric views from the front showing the first superMHL plug with the outer casing removed and a receptacle for the plug, wherein FIG. 42 shows the plug and receptacle while disengaged, FIGS. 43*a* and 43*b* show the plug and receptacle in an engaged and unlocked configuration, and FIGS. 44*a* and 44*b* show the plug and receptacle in an engaged and locked configuration, and wherein FIGS. 43*b* and 44*b* show parts of the plug and/or the receptacle at an enlarged scale;

FIGS. 45 and 46 are isometric views from the rear showing a second superMHL plug comprising a third embodiment of the invention in an unlocked configuration, wherein FIG. 45 is an exploded view and FIG. 46 shows a fully assembled plug;

FIGS. 47*a* and 47*b* are isometric views from the rear showing the second superMHL plug in an unlocked configuration, wherein FIG. 47*b* shows part of the plug at an enlarged scale;

FIGS. 48*a* and 48*b* are isometric views from the rear showing the second superMHL plug in a locked configuration, wherein FIG. 48*b* shows part of the plug at an enlarged scale;

FIGS. 49*a* and 49*b* are isometric views from the rear showing the second superMHL plug in an unlocked configuration with the outer casing partially cut away, wherein FIG. 49*b* shows part of the plug at an enlarged scale;

FIGS. 50*a* and 50*b* are isometric views from the rear showing the second superMHL plug in a locked configuration with the outer casing partially cut away, wherein FIG. 50*b* shows part of the plug at an enlarged scale;

FIGS. 51*a* and 51*b* are isometric views from the rear showing the second superMHL plug in an unlocked configuration with the outer casing and metal sleeve removed, wherein FIG. 51*b* shows part of the plug at an enlarged scale;

FIGS. 52*a* and 52*b* are isometric views from the rear showing the second superMHL plug in a locked configuration with the outer casing and metal sleeve removed, wherein FIG. 52*b* shows part of the plug at an enlarged scale;

FIGS. 53*a* and 53*b* are isometric views from the front showing the second superMHL plug in an unlocked configuration, wherein FIG. 53*b* shows part of the plug at an enlarged scale;

FIGS. 54*a* and 54*b* are isometric views from the front showing the second superMHL plug in a locked configuration, wherein FIG. 54*b* shows part of the plug at an enlarged scale;

FIGS. 55*a* and 55*b* are isometric views from the front showing the second superMHL plug in an unlocked configuration with the outer casing removed, wherein FIG. 55*b* shows part of the plug at an enlarged scale;

FIGS. 56*a* and 56*b* are isometric views from the front showing the second superMHL plug in a locked configuration with the outer casing removed, wherein FIG. 56*b* shows part of the plug at an enlarged scale;

FIGS. 57*a*, 57*b* and 57*c* are views from the front showing the second superMHL plug in an unlocked configuration with the outer casing and metal sleeve removed, wherein FIGS. 57*b* and 57*c* show part of the plug at an enlarged scale, FIGS. 57*a* and 57*b* being isometric views and FIG. 57*c* being a top plan view;

FIGS. 58*a*, 58*b* and 58*c* are views from the front showing the second superMHL plug in a locked configuration with the outer casing and metal sleeve removed, wherein FIGS. 58*b* and 58*c* show part of the plug at an enlarged scale, FIGS. 58*a* and 58*b* being isometric views and FIG. 58*c* being a top plan view;

FIGS. 59, 60*a*, 60*b*, 61*a* and 61*b* are isometric views from the rear showing the second superMHL plug and a receptacle for the plug, wherein FIG. 59 shows the plug and receptacle while disengaged, FIGS. 60*a* and 60*b* show the plug and receptacle in an engaged and unlocked configuration, and FIGS. 61*a* and 61*b* show the plug and receptacle in an engaged and locked configuration, and wherein FIGS. 60*b* and 61*b* show parts of the plug and/or the receptacle at an enlarged scale;

FIGS. 62, 63*a*, 63*b*, 64*a* and 64*b* are isometric views from the rear showing the second superMHL plug with the outer casing removed and a receptacle for the plug, wherein FIG. 62 shows the plug and receptacle while disengaged, FIGS. 63*a* and 63*b* show the plug and receptacle in an engaged and unlocked configuration, and FIGS. 64*a* and 64*b* show the plug and receptacle in an engaged and locked configuration, and wherein FIGS. 63*b* and 64*b* show parts of the plug and/or the receptacle at an enlarged scale;

FIGS. 65, 66*a*, 66*b*, 67*a* and 67*b* are isometric views from the front showing the second superMHL plug and a receptacle for the plug, wherein FIG. 65 shows the plug and receptacle while disengaged, FIGS. 66*a* and 66*b* show the plug and receptacle in an engaged and unlocked configuration, and FIGS. 67*a* and 67*b* show the plug and receptacle in an engaged and locked configuration, and wherein FIGS. 66*b* and 67*b* show parts of the plug and/or the receptacle at an enlarged scale;

FIGS. 68, 69*a*, 69*b*, 70*a* and 70*b* are isometric views from the front showing the second superMHL plug with the outer casing removed and a receptacle for the plug, wherein FIG. 68 shows the plug and receptacle while disengaged, FIGS. 69*a* and 69*b* show the plug and receptacle in an engaged and unlocked configuration, and FIGS. 70*a* and 70*b* show the plug and receptacle in an engaged and locked configuration, and wherein FIGS. 69*b* and 70*b* show parts of the plug and/or the receptacle at an enlarged scale;

FIGS. 71 and 72 are isometric views from the rear showing a HDMI plug in an unlocked configuration, wherein FIG. 71 is an exploded view and FIG. 72 shows a fully assembled plug;

FIGS. 73*a* and 73*b* are isometric views from the rear showing the HDMI plug in an unlocked configuration, wherein FIG. 73*b* shows part of the plug at an enlarged scale;

FIGS. 74*a* and 74*b* are isometric views from the rear showing the HDMI plug in a locked configuration, wherein FIG. 74*b* shows part of the plug at an enlarged scale;

FIGS. 75*a* and 75*b* are isometric views from the rear showing the HDMI plug in an unlocked configuration with the outer casing partially cut away, wherein FIG. 75*b* shows part of the plug at an enlarged scale;

FIGS. 76*a* and 76*b* are isometric views from the rear showing the HDMI plug in a locked configuration with the outer casing partially cut away, wherein FIG. 76*b* shows part of the plug at an enlarged scale;

FIGS. 77*a* and 77*b* are isometric views from the front showing the HDMI plug in an unlocked configuration, wherein FIG. 77*b* shows part of the plug at an enlarged scale;

FIGS. 78*a* and 78*b* are isometric views from the front showing the HDMI plug in a locked configuration, wherein FIG. 78*b* shows part of the plug at an enlarged scale;

FIGS. 79*a* and 79*b* are isometric views from the front showing the HDMI plug in an unlocked configuration with the outer casing removed, wherein FIG. 79*b* shows part of the plug at an enlarged scale;

FIGS. 80*a* and 80*b* are isometric views from the front showing the HDMI plug in a locked configuration with the outer casing removed, wherein FIG. 80*b* shows part of the plug at an enlarged scale;

FIGS. 81*a*, 81*b*, 82*a*, 82*b*, 83*a* and 83*b* are isometric views from the rear showing the HDMI plug and a receptacle for the plug, wherein FIGS. 81*a* and 81*b* show the plug and receptacle while disengaged, FIGS. 82*a* and 82*b* show the plug and receptacle in an engaged and unlocked configuration, and FIGS. 83*a* and 83*b* show the plug and receptacle in an engaged and locked configuration, and wherein FIGS. 81*b*, 82*b* and 83*b* show parts of the plug and/or the receptacle at an enlarged scale;

FIGS. 84*a*, 84*b*, 85*a*, 85*b*, 86*a* and 86*b* are isometric views from the rear showing the HDMI plug with the outer casing removed and a receptacle for the plug, wherein FIGS. 84*a* and 84*b* show the plug and receptacle while disengaged, FIGS. 85*a* and 85*b* show the plug and receptacle in an engaged and unlocked configuration, and FIGS. 86*a* and 86*b* show the plug and receptacle in an engaged and locked configuration, and wherein FIGS. 84*b*, 85*b* and 86*b* show parts of the plug and/or the receptacle at an enlarged scale;

FIGS. 87*a*, 87*b*, 88*a*, 88*b*, 89*a* and 89*b* are isometric views from the front showing the HDMI plug and a receptacle for the plug, wherein FIGS. 87*a* and 87*b* show the plug and receptacle while disengaged, FIGS. 88*a* and 88*b* show the plug and receptacle in an engaged and unlocked configuration, and FIGS. 89*a* and 89*b* show the plug and receptacle in an engaged and locked configuration, and wherein FIGS. 87*b*, 88*b* and 89*b* show parts of the plug and/or the receptacle at an enlarged scale;

FIGS. 90*a*, 90*b*, 91*a*, 91*b*, 92*a* and 92*b* are isometric views from the front showing the HDMI plug with the outer casing removed and a receptacle for the plug, wherein FIGS. 90*a* and 90*b* show the plug and receptacle while disengaged, FIGS. 91*a* and 91*b* show the plug and receptacle in an engaged and unlocked configuration, and FIGS. 92*a* and 92*b* show the plug and receptacle in an engaged and locked configuration, and wherein FIGS. 90*b*, 91*b* and 92*b* show parts of the plug and/or the receptacle at an enlarged scale;

FIGS. 93*a*, 93*b*, 94*a*, 94*b* are partial cutaway views from the rear showing the HDMI plug with the outer casing partially removed, wherein FIGS. 93*a* and 93*b* show the plug in an unlocked configuration, and FIGS. 94*a* and 94*b* show the plug in a locked configuration, wherein FIGS. 93*b* and 94*b* shows part of the plug at an enlarged scale.

DETAILED DESCRIPTION OF THE DRAWINGS

Embodiment 1

Figure 1:
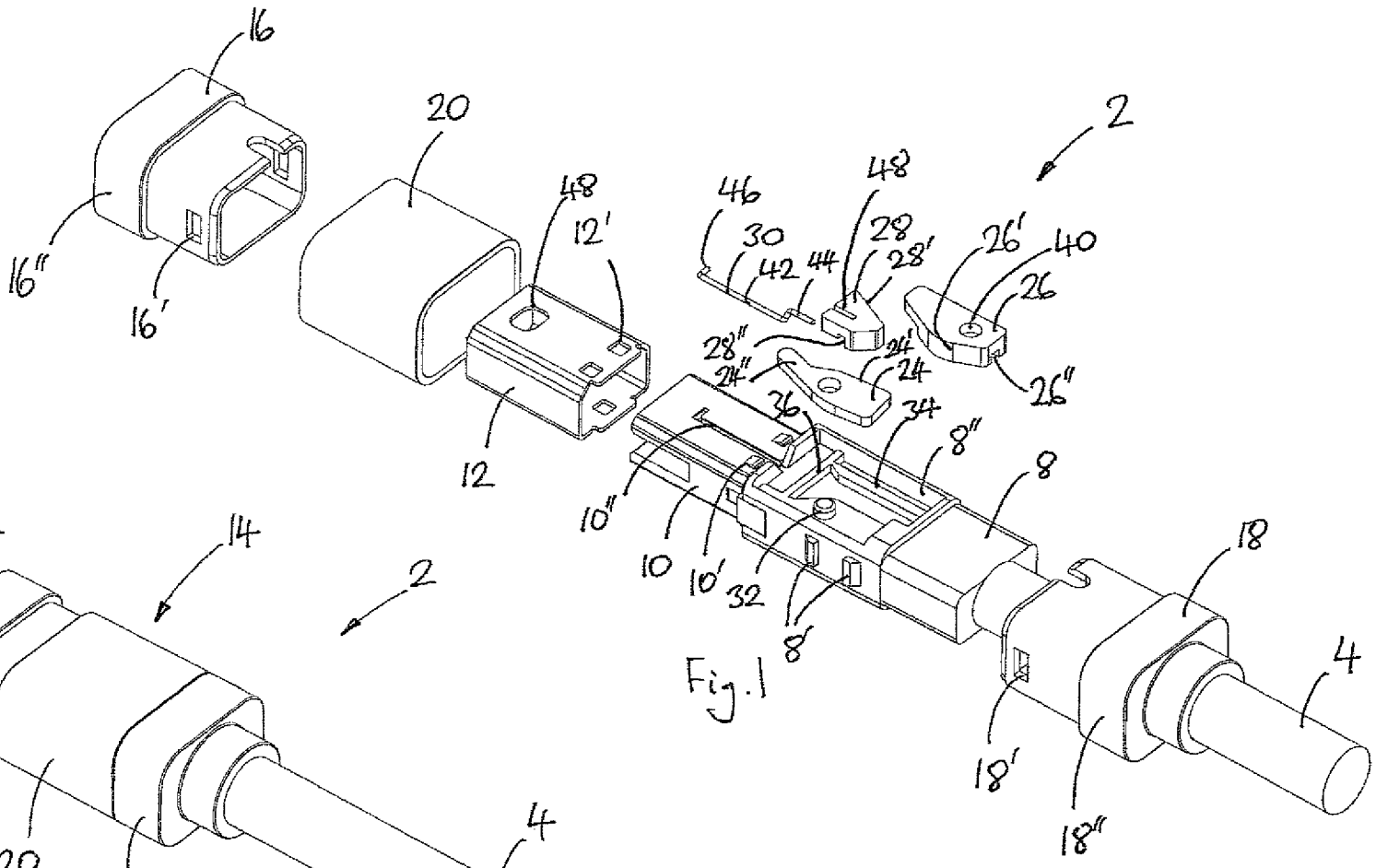
Figure 2:
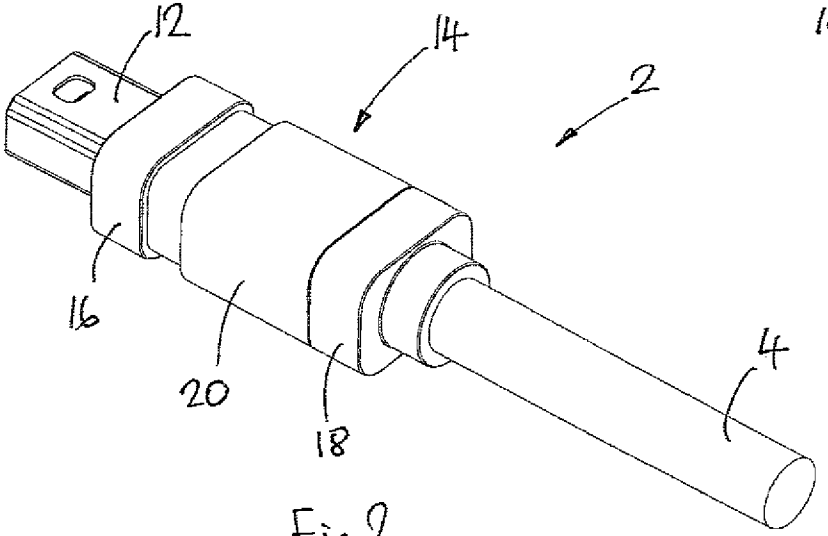
Figure 4B:
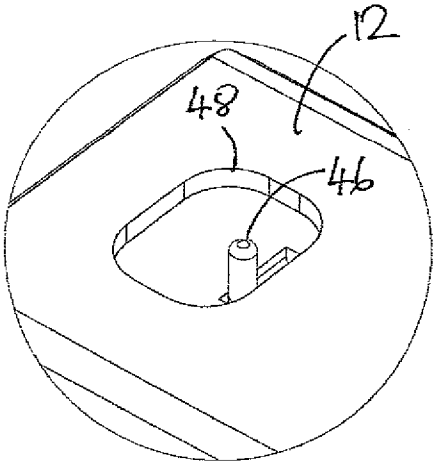
Figure 4A:
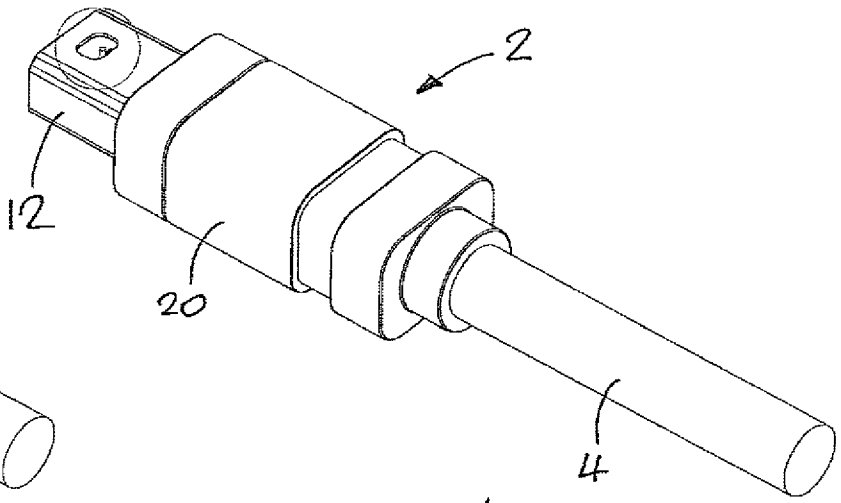
Figure 3B:
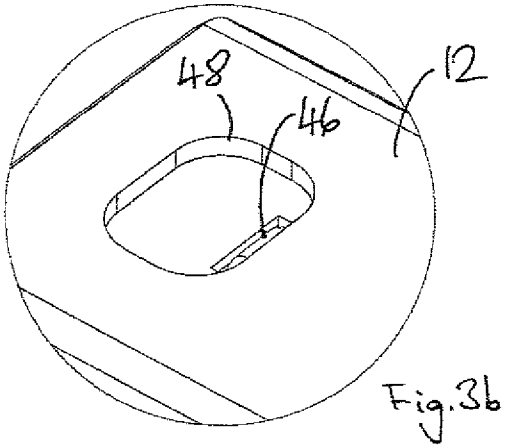
Figure 3A:
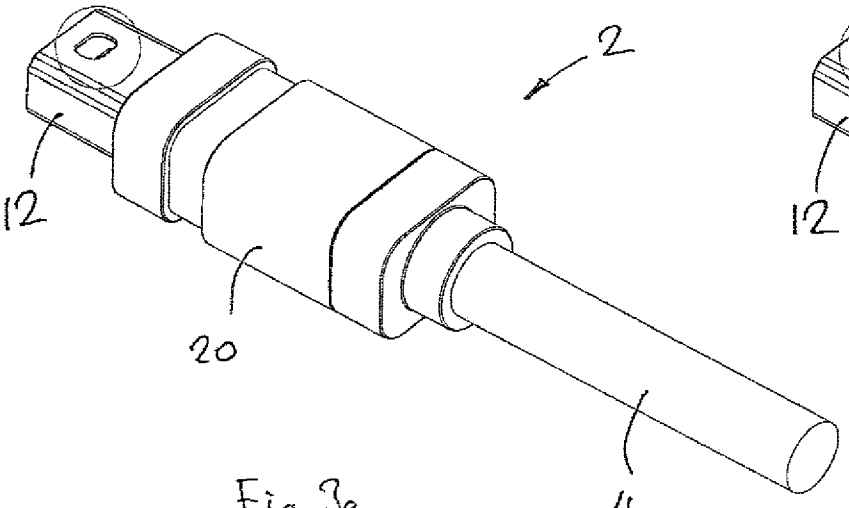
Figures 5A, 5B, 6A, 6B:
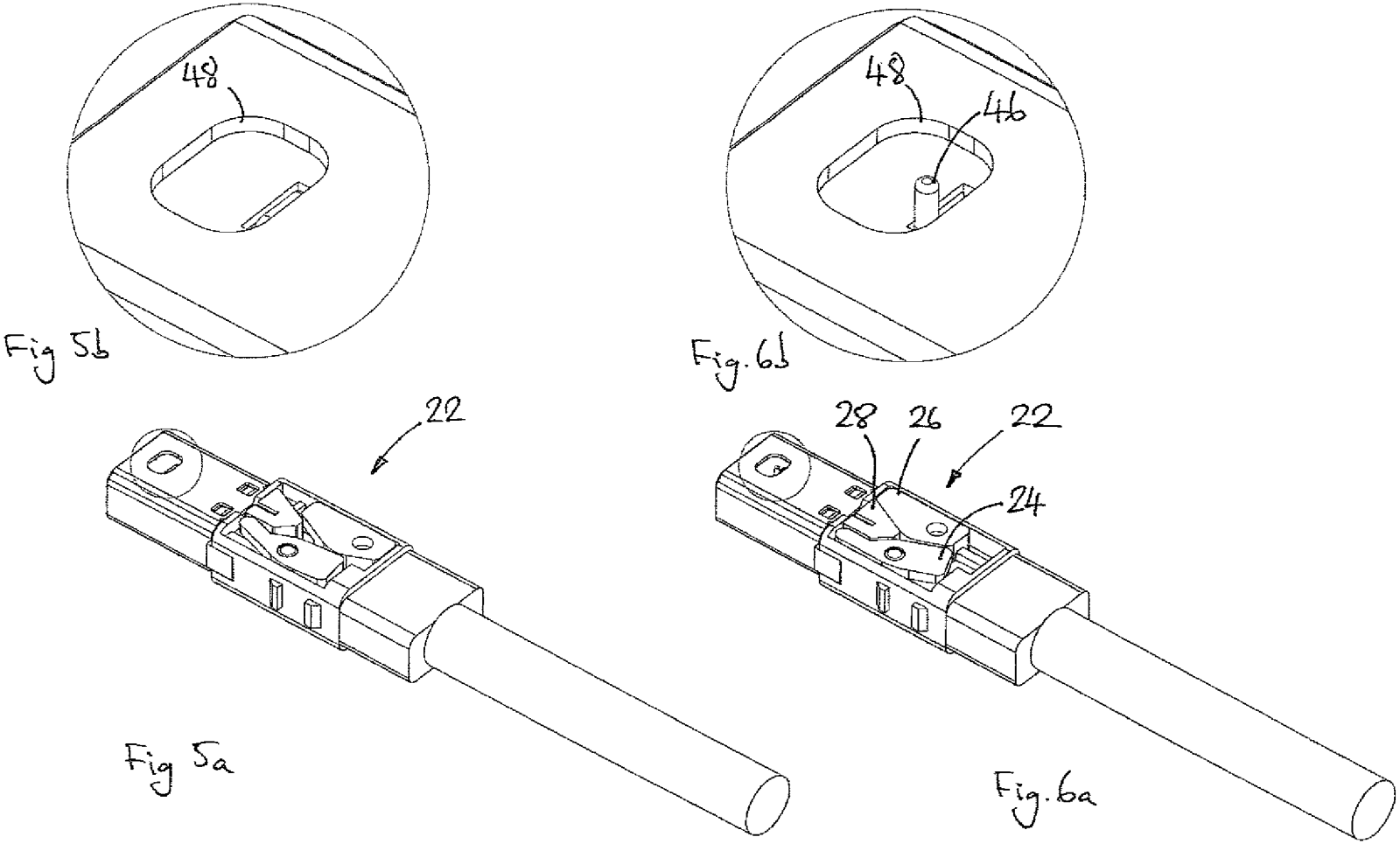
Figure 8A:
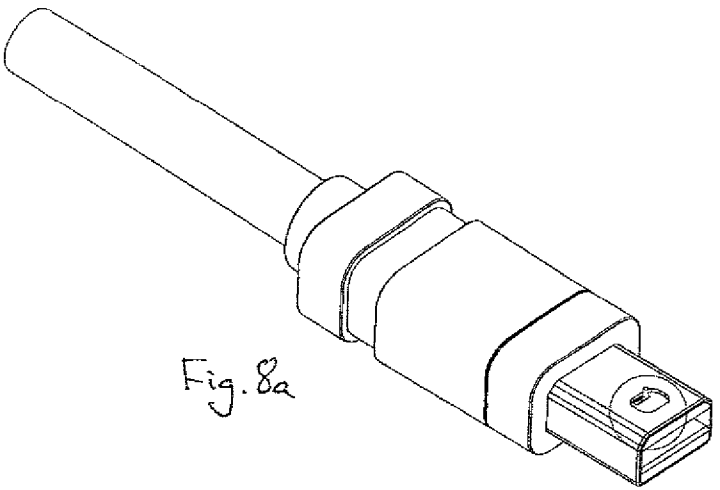
Figure 8B:
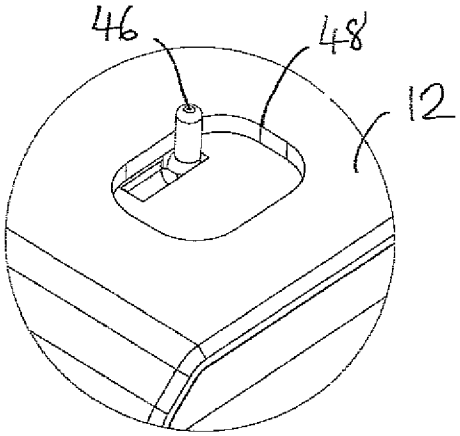
Figure 7A:
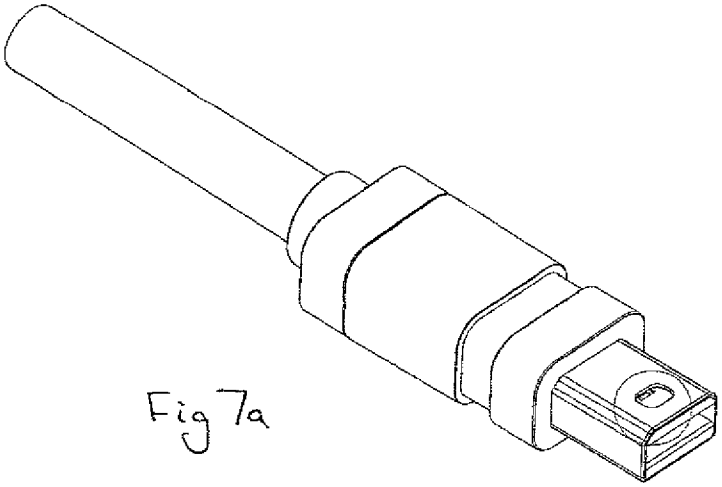
Figure 7B:
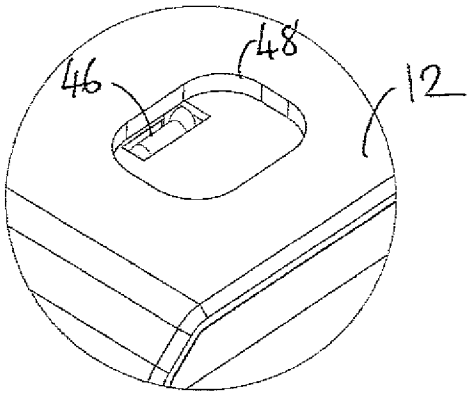
Figure 10A:
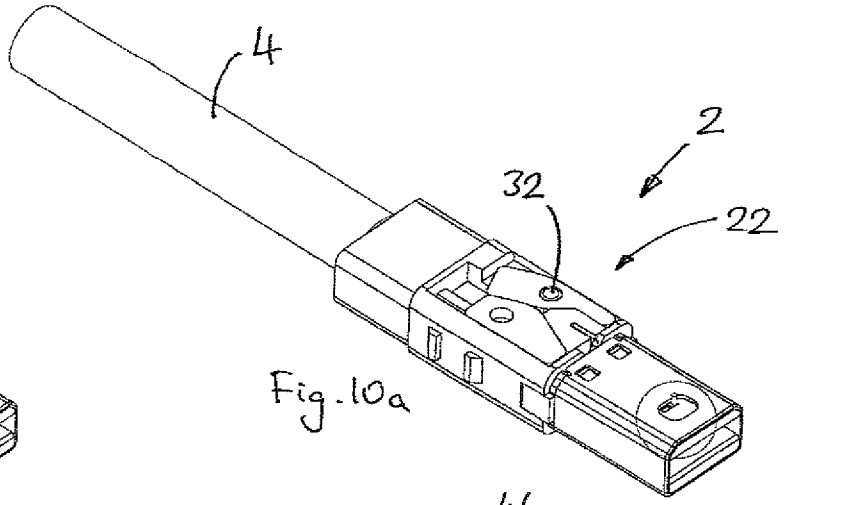
Figure 10B:
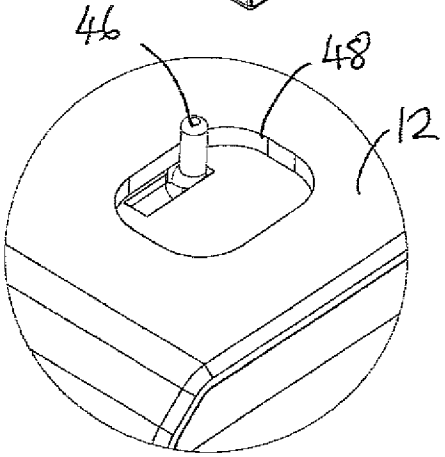
Figure 9A:
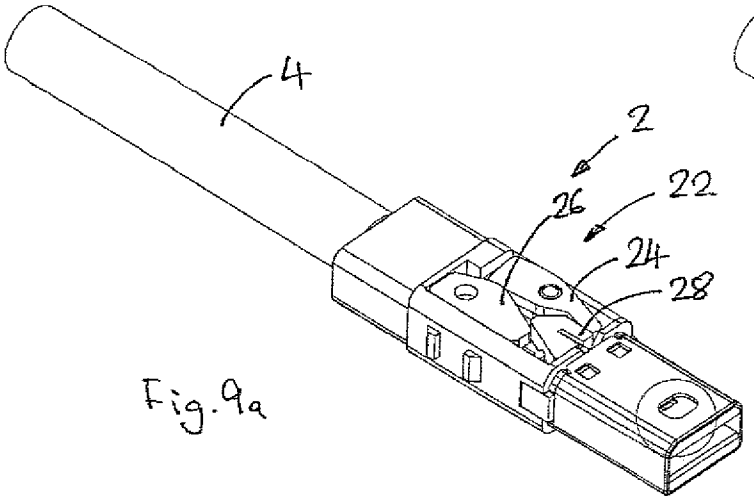
Figure 9B:
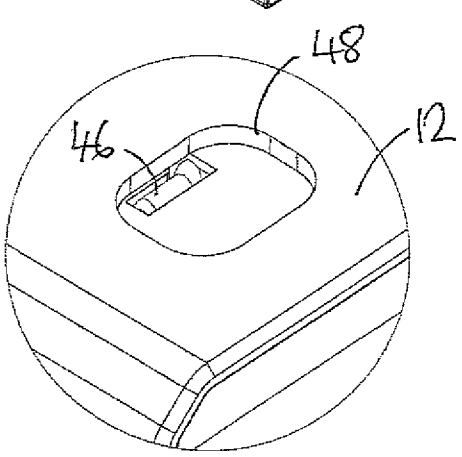
Figures 11A, 11B, 12A, 12B, 13A, 13B:
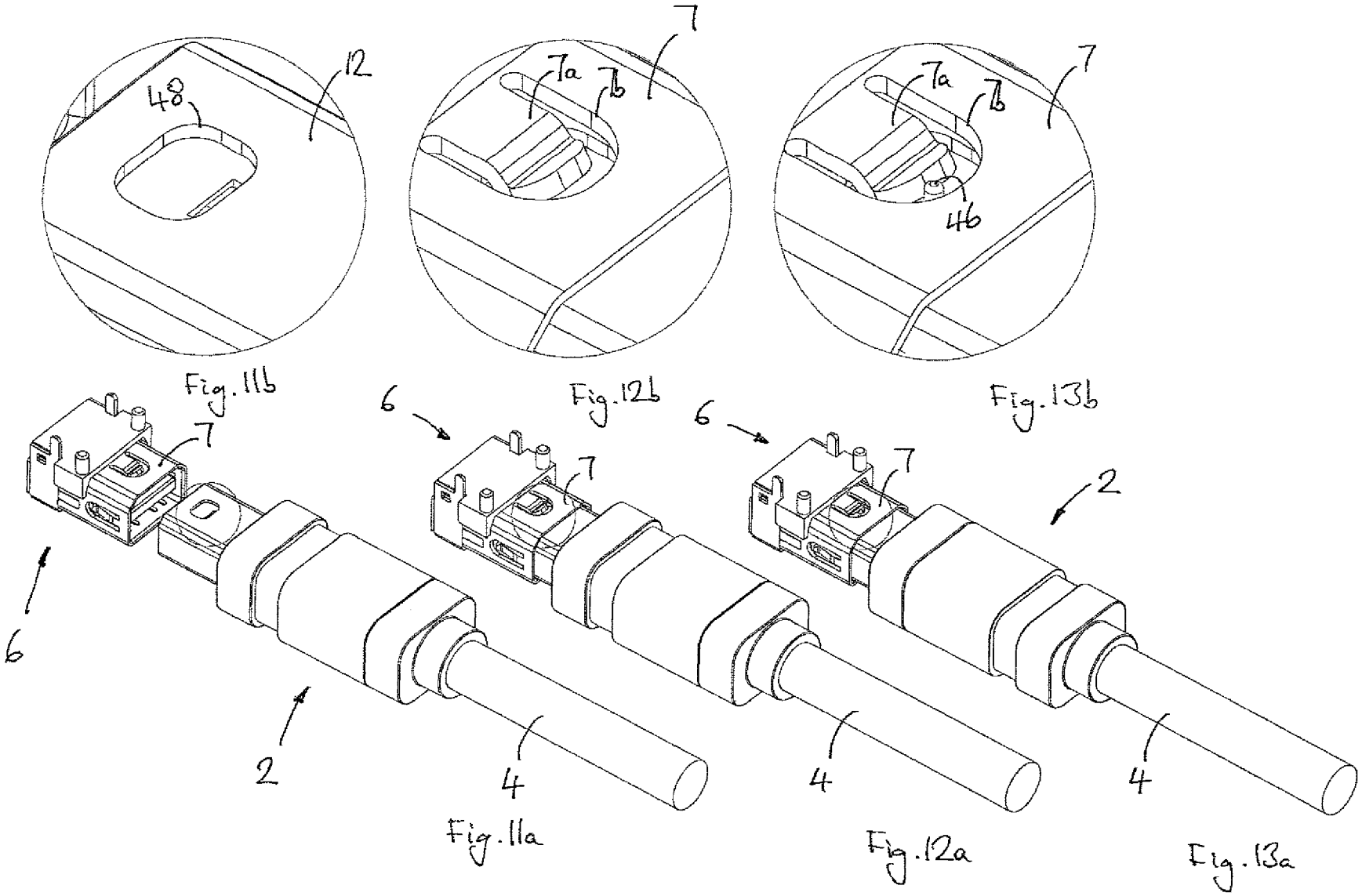
Figures 14A, 14B, 15A, 15B, 16A, 16B:
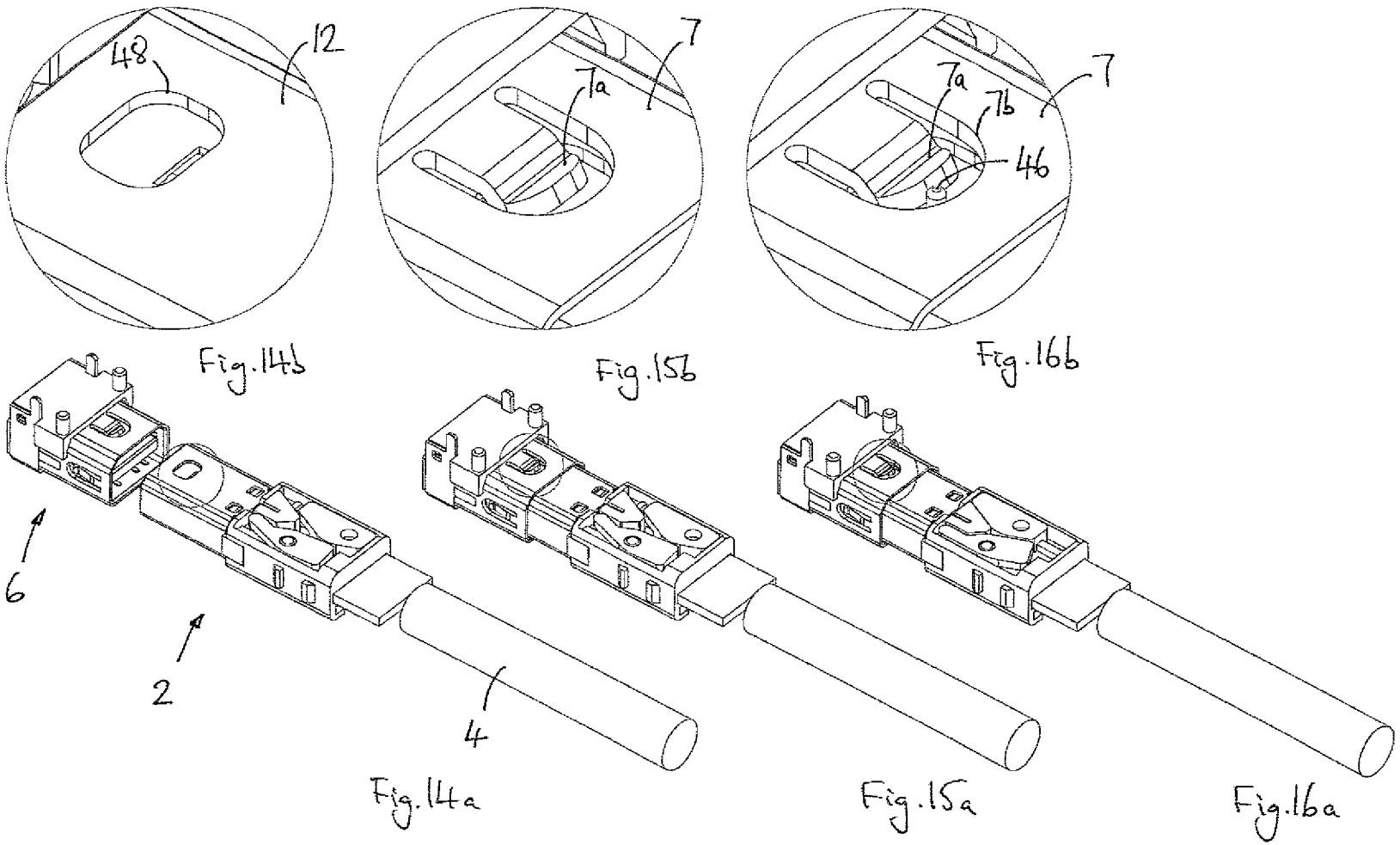
Figures 17A, 17B, 18A, 18B, 19A, 19B:
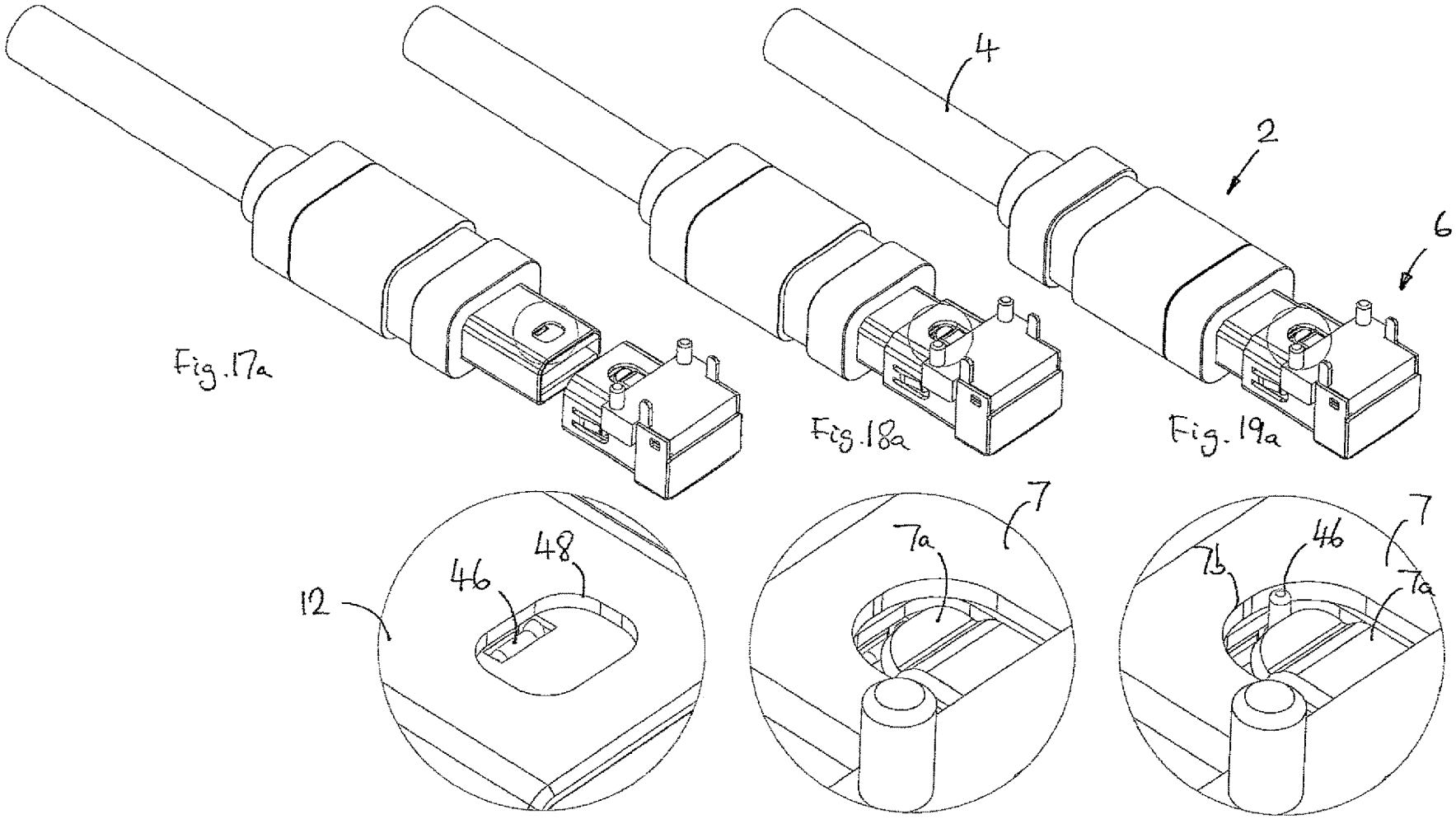
Figures 20A, 20B, 21A, 21B, 22A, 22B:
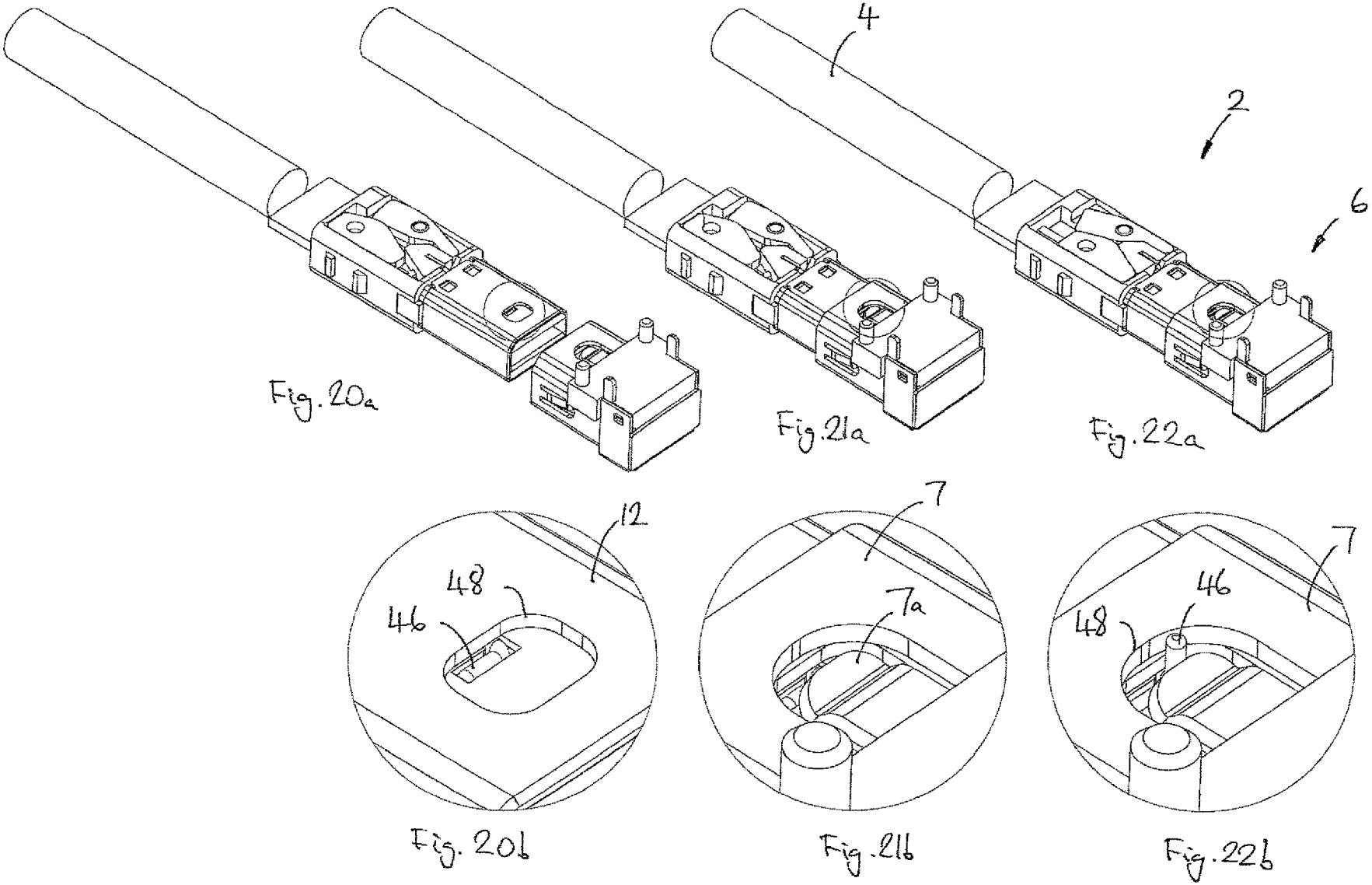

With reference to the drawings, the first electrical data connector shown in FIGS. 1-22 comprises a plug 2, which is attached to a cable 4, and a receptacle 6 that receives the plug 2. The receptacle 6 may be entirely conventional and will not therefore be described in great detail. Typically, the receptacle 6 includes a metal shield 7 that includes a spring detent 7*a* positioned within an aperture 7*b* in the upper part of the shield 7.

In this embodiment the electrical data connector is a mini display port or mDP connector. However, it should be understood that the invention is also applicable to other kinds of electrical data connector (for example, HDMI connectors, USB connectors and others).

The plug 2 includes a substantially cuboidal body 8 and a connector block 10 that carries a set of connection pins. In a conventional mDP plug ten connection pins are provided, which are arranged in two parallel rows, each row containing five pins. Each row of pins lies in a plane, which in the following description we will refer to as the "horizontal" plane, since in practice this plane is often horizontal. However, it should be understood that the so-called "horizontal" plane may in fact be positioned in any other orientation. We shall also refer to the "longitudinal" direction, which in the following description means the direction in which the plug is inserted into and removed from the receptacle, the "transverse" direction, which is perpendicular to the longitudinal direction and lies in the horizontal plane, and the "vertical" direction, which is perpendicular to the horizontal plane, and the "upper" and "lower" sides of various components, which are defined with reference to the vertical direction. Again, these terms are intended only for reference and are not intended to be limiting in any way.

A D-shaped metal shield 12 fits over the connector block 10 and is attached to the body 8 by detents 10' that engage locking holes 12' in the shield 12. The cable 4 enters the rear of the body 8 and the wires within the cable are connected to the connection pins. The connector block 10, the shield 12 and the cable 4 are largely conventional (except where indicated otherwise) and so will not be described in further detail.

The plug also includes a casing 14 comprising a front element 16, a rear element 18 and a sliding sleeve 20. The front and rear elements 16, 18 are tubular and fit over the front and rear ends of the body 8. They are attached to the body 8 by detents 8' on the sides of the body 8 that engage locking holes 16', 18' in the side walls of the front and rear elements 16, 18.

A front portion 16" of the front element 16 and a rear portion 18" of the rear element 18 are enlarged to provide outwardly extending stop elements. The sleeve 20 is sized to slide longitudinally over the body 8 between the enlarged front and rear portions 16", 18", which limit longitudinal movement of the sleeve 20.

The body 8 has a recess 8" in its upper face that accommodates a locking mechanism 22 for locking the plug 2 to the receptacle 6. The locking mechanism 22, which is clearly shown for example in FIGS. 1, 5*a*, 6*a*, 9*a* and 10*a*, includes a pivoting element 24, a longitudinal sliding element 26, a transverse sliding element 28 and a pivoting pin 30. The pivoting element 24 is mounted on a pivot pin 32 with a vertical pivot axis, which is connected to the body 8 and is located on the left side of the recess 8" (as seen from above). The longitudinal sliding element 26 is located on the right side of the recess 8" and has on its lower surface a groove 26" that engages a longitudinal rail 34 provided within the recess 8", which guides longitudinal movement of the longitudinal sliding element 26. The longitudinal sliding element 26 includes on its left edge a convex cam surface 26' that engages the right edge 24' of the pivoting element 24 to control pivoting movement of the pivoting element 24.

The front part of the cam surface 26' also engages the right edge 28' of the transverse sliding element 28. The front part of the cam surface 26' and a right edge 28' of the transverse sliding element 28 are both inclined at an acute angle relative to the longitudinal axis of the body 8 so that forwards longitudinal movement of the longitudinal sliding element 26 causes transverse sliding movement of the transverse sliding element 28 from right to left. The transverse sliding element 28 includes a groove 28" in its lower surface that engages a transverse rail 36 provided within the recess 8", which guides transverse movement of the transverse sliding element 28.

The left hand edge of the transverse sliding element 28 engages a finger 24" that forms a front part of the pivoting element 24. Transverse movement of the transverse sliding element 28 from right to left therefore causes pivoting movement of the pivoting element 24 in an anticlockwise direction. Conversely, pivoting movement of the pivoting element 24 in a clockwise direction drives the transverse sliding element 28 from left to right.

The pivoting element 24, the longitudinal sliding element 26 and the transverse sliding element 28 are thus configured to move in unison, movement of the three elements being driven by the longitudinal sliding element 26, which is coupled to the sliding sleeve 20 through a drive pin 29 on the inner surface of the sleeve 20, which engages a drive hole 40 provided in the upper surface of the longitudinal sliding element 26. When the sleeve 20 is pushed forwards this causes the longitudinal sliding element 26 to slide forwards, the transverse sliding element 28 to slide from right to left, and the pivoting element 24 to rotate in an anticlockwise direction. When the sliding sleeve 20 is moved rearwards this causes the longitudinal sliding element 26 to slide rearwards, which causes the pivoting element 24 to rotate clockwise, thus causing the transverse sliding element 28 to slide from left to right.

It should be noted that in this embodiment the pivoting element 24, the longitudinal sliding element 26 and the transverse sliding element 28 all lie in the same plane and engage each other only along their respective edges, which are perpendicular to the plane in which the elements lie. The elements do not slide over each other. This arrangement reduces friction and helps to ensure smooth operation of the locking/unlocking mechanism 22, both when locking and unlocking the mechanism. The mechanism is also extremely compact, allowing it to be accommodated within a housing that meets the defined specification for mDP plugs.

The pivoting pin 30, which is shown most clearly in FIG. 1, includes a central portion 42, a rear crank portion 44 that is offset from the central portion 42, and a locking arm 46, which is provided at the front end of the central portion 42 and is perpendicular to the axis of the central portion 42.

The central portion 42 extends in the longitudinal direction of the plug 2 and is seated within a longitudinal groove 10" provided in the upper surface of the connector block 10, allowing the pivoting pin 10 to rotate about the axis of the central portion 42. The central portion 42 is retained in the groove 10" by the shield 12.

The rear crank part 44 of the pin 30 extends into the recess 8" in the body 8 and is seated within a groove 48 provided in the upper surface of the transverse sliding element 28. Transverse movement of the transverse sliding element 28 thus causes the pin 30 to rotate about the axis of the central portion 42.

The locking arm 46 is located beneath a locking hole 48 provided in the upper part of the shield 12. In a conventional mDP plug the locking hole 48 is engaged by a spring-loaded detent to retain the plug within a receptacle. The locking arm 46 is therefore located adjacent the rear edge of the locking hole 48 to avoid interfering with operation of the detent when the plug 2 is inserted into a conventional receptacle.

Rotation of the pivoting pin 30 causes the locking arm 46 to pivot through an angle of approximately 90° between an unlocked position shown for example in FIGS. 2, 3, 5, 7, 9, 11, 12, 14, 15, 17, 18, 20 and 21, and a locked position shown for example in FIGS. 4, 6, 8, 10, 13, 16, 19 and 22. When the locking arm 46 is in the unlocked position it extends parallel to the upper surface of the connector block 10 and is accommodated within a transverse portion of the groove 10". It does not protrude from the locking hole 48 and so does not interfere with insertion or removal of the plug 2 to or from the receptacle 6.

When the locking arm 46 is in the locked position it extends substantially perpendicular to the upper surface of the connector block 10 and protrudes through the locking hole 48 into the aperture 7*b* that surrounds the spring detent 7*a* in the receptacle 6. This can be seen most clearly in FIGS. 13*b*, 16*b*, 19*b*, and 22*b*. When the locking arm 46 is in the locked position it engages the front edge of the aperture 7*b* and prevents the plug 2 from being withdrawn from the receptacle 6.

The locking mechanism 22 is actuated by sliding the sleeve 20 forwards to lock the mechanism or rearwards to unlock the mechanism. Therefore, when making a connection, the plug 2 is inserted into the receptacle 6 and the sleeve 20 is then slid forwards to lock the locking mechanism 22, providing a positive locking engagement between the plug 2 and the receptacle 6. When disconnecting the plug, the sleeve 20 is slid backwards to unlock the locking mechanism 22 and the plug 2 is then withdrawn from the receptacle 6.

Embodiment 2

FIGS. 23-44 of the drawings depict an electrical data connector according to a second embodiment of the invention, comprising a plug 102, which is attached to a cable 104, and a receptacle 106 that receives the plug 102. The receptacle 106 may be entirely conventional and will not therefore be described in great detail. Typically, the receptacle 106 includes a metal shield 107 that includes a spring detent 107*a* positioned within an aperture 107*b* in the upper part of the shield 7.

In this embodiment the electrical data connector is a superMHL connector. However, it should be understood that the invention is also applicable to other kinds of electrical data connector (for example, HDMI connectors, USB connectors and others).

The plug 102 includes a body 108 and a connector block 110 that carries a set of connection pins. The superMHL plug includes thirty-two connection pins, which are arranged in two parallel rows. Each row of pins lies in a plane, which in the following description we will refer to as the "horizontal" plane, since in practice this plane is often horizontal. However, it should be understood that the so-called "horizontal" plane may in fact be positioned in any other orientation. We shall also refer to the "longitudinal" direction, which in the following description means the direction in which the plug is inserted into and removed from the receptacle, the "transverse" direction, which is perpendicular to the longitudinal direction and lies in the horizontal plane, and the "vertical" direction, which is perpendicular to the horizontal plane, and the "upper" and "lower" sides of various components, which are defined with reference to the vertical direction. Again, these terms are intended only for reference and are not intended to be limiting in any way.

A metal shield 112 fits over the connector block 110 and is attached to the body 108 by detents 110' that engage locking holes 112' in the shield 112. The cable 104 enters the rear of the body 108 and the wires within the cable are connected to the connection pins. The connector block 110, the shield 112 and the cable 104 are largely conventional (except where indicated otherwise) and so will not be described in further detail.

The plug also includes a casing 114 comprising a front element 116, a central element 117, a rear element 118 and a sliding sleeve 120. The front and rear elements 116, 118 are tubular and fit over the front and rear ends of the body 108. They are attached to the body 108 by detents 116', 118' that engage locking holes 117' in the central element 117.

The front element 116 and the rear element 118 are enlarged relative to the central element 117 to provide outwardly extending stop elements. The sleeve 120 is sized to slide longitudinally over the body 108 between the enlarged front and rear element 116, 118, which limit longitudinal movement of the sleeve 120.

The body 108 accommodates a locking mechanism 122 on its upper face for locking the plug 102 to the receptacle 106. The locking mechanism 122, which is clearly shown for example in FIGS. 23, 27*a*, 28*a*, 31*a* and 32*a*, includes a pivoting element 124, a longitudinal sliding element 126, a transverse sliding element 128 and a pair of pivoting pins 130. The pivoting element 124 has on its lower surface a pivot pin (not shown) with a vertical pivot axis, which is received in a hole 132 on the upper surface of the body 108 and is located on the left side of the body 108 (as seen from above). The longitudinal sliding element 126 is located on the right side of the body 108 and includes on its left edge a convex cam surface 126' that engages the right edge of the pivoting element 124 to control pivoting movement of the pivoting element 124.

The front part of the cam surface 126' also engages the right edge 128' of the transverse sliding element 128. The front part of the cam surface 126' and a right edge 128' of the transverse sliding element 128 are both inclined at an acute angle relative to the longitudinal axis of the body 108 so that forwards longitudinal movement of the longitudinal sliding element 126 causes transverse sliding movement of the transverse sliding element 128 from right to left.

The left hand edge of the transverse sliding element 128 engages a front part 124' of the pivoting element 124. Transverse movement of the transverse sliding element 128 from right to left therefore causes pivoting movement of the pivoting element 124 in an anticlockwise direction. Conversely, pivoting movement of the pivoting element 124 in a clockwise direction drives the transverse sliding element 128 from left to right.

The pivoting element 124, the longitudinal sliding element 126 and the transverse sliding element 128 are thus configured to move in unison, movement of the three elements being driven by the longitudinal sliding element 126, which is coupled to the sliding sleeve 120 through a drive pin 129 on the underside of a drive plate 139 that fits into a recess 120' on the upper surface of the sleeve 120, which engages a drive hole 140 provided in the upper surface of the longitudinal sliding element 126. When the sleeve 120 is pushed forwards this causes the longitudinal sliding element 126 to slide forwards, the transverse sliding element 128 to slide from right to left, and the pivoting element 124 to rotate in an anticlockwise direction. When the sliding sleeve 120 is moved rearwards this causes the longitudinal sliding element 126 to slide rearwards, which causes the pivoting element 124 to rotate clockwise, thus causing the transverse sliding element 128 to slide from left to right.

It should be noted that in this embodiment the pivoting element 124, the longitudinal sliding element 126 and the transverse sliding element 128 all lie in the same plane and engage each other only along their respective edges, which are perpendicular to the plane in which the elements lie. The elements do not slide over each other. This arrangement reduces friction and helps to ensure smooth operation of the locking/unlocking mechanism 122, both when locking and unlocking the mechanism. The mechanism is also extremely compact, allowing it to be accommodated within a housing that meets the defined specification for superMHL plugs.

Figures 23, 24:
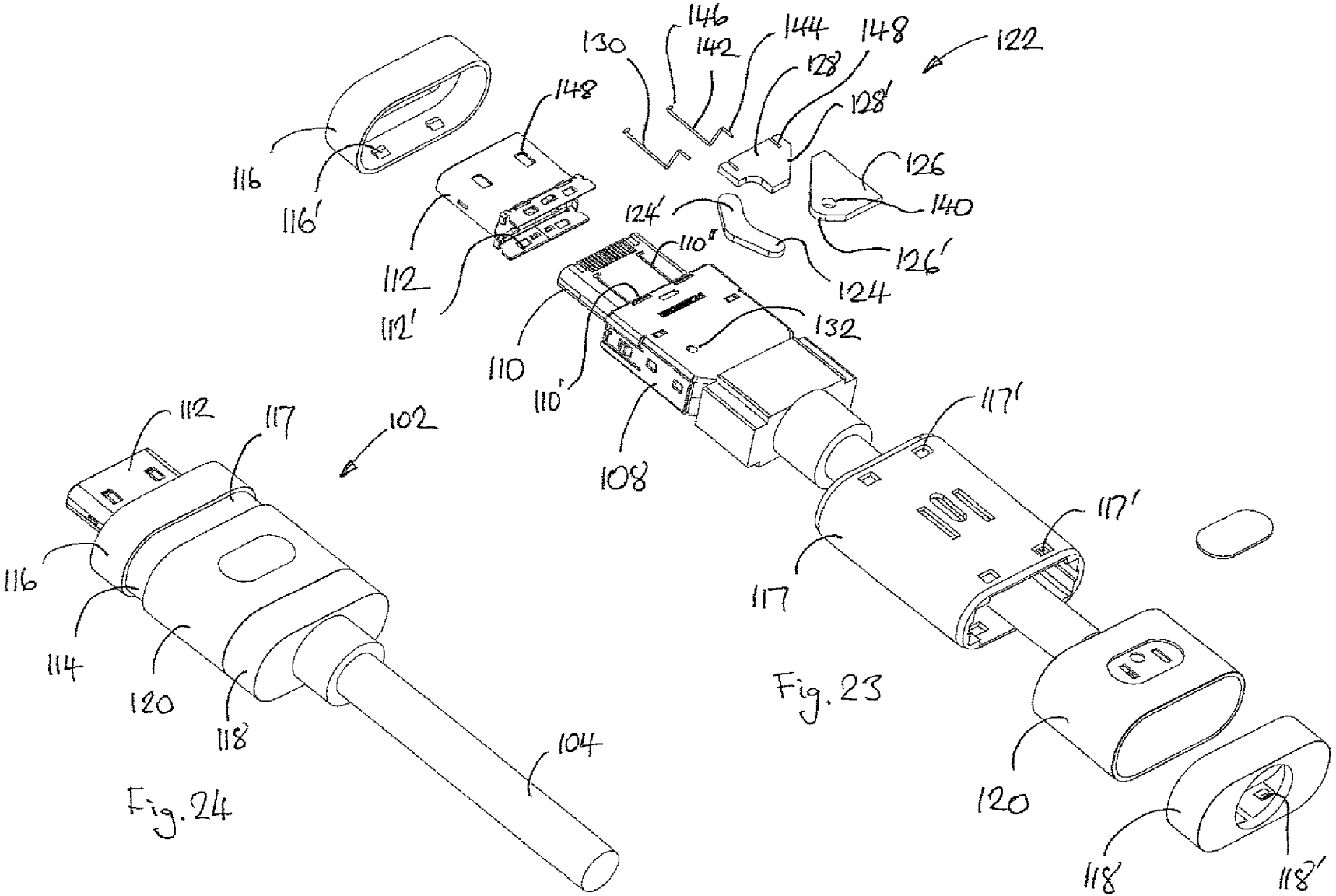

The pivoting pins 130, which are shown most clearly in FIG. 23, each include a central portion 142, a rear crank portion 144 that is offset from the central portion 142, and a locking arm 146, which is provided at the front end of the central portion 142 and is perpendicular to the axis of the central portion 142.

Each central portion 142 extends in the longitudinal direction of the plug 102 and is seated within one of a pair of longitudinal grooves 110" provided in the upper surface of the connector block 110, allowing each pivoting pin 110 to rotate about the axis of the central portion 142. Each central portion 142 is retained in the respective groove 110" by the shield 112.

Each rear crank part 144 of each pin 130 extends into the body 108 and is seated within one of a pair of grooves 148 provided in the upper surface of the transverse sliding element 128. Transverse movement of the transverse sliding element 128 thus causes each pin 130 to rotate about the axis of the central portion 142.

Each locking arm 146 is located beneath one of a pair of locking holes 148 provided in the upper part of the shield 112. Conventionally, each locking hole 148 is engaged by a spring-loaded detent to retain the plug within a receptacle. Each locking arm 146 is therefore located adjacent the rear edge of the respective locking hole 148 to avoid interfering with operation of the detent when the plug 102 is inserted into a conventional receptacle.

Figure 26B:
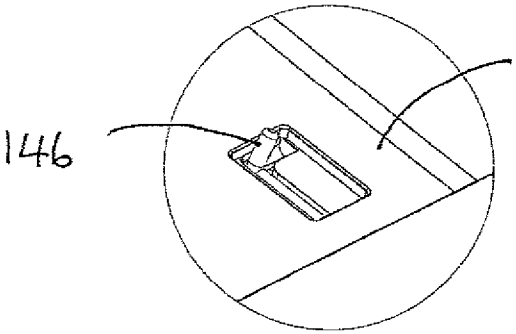
Figure 26A:
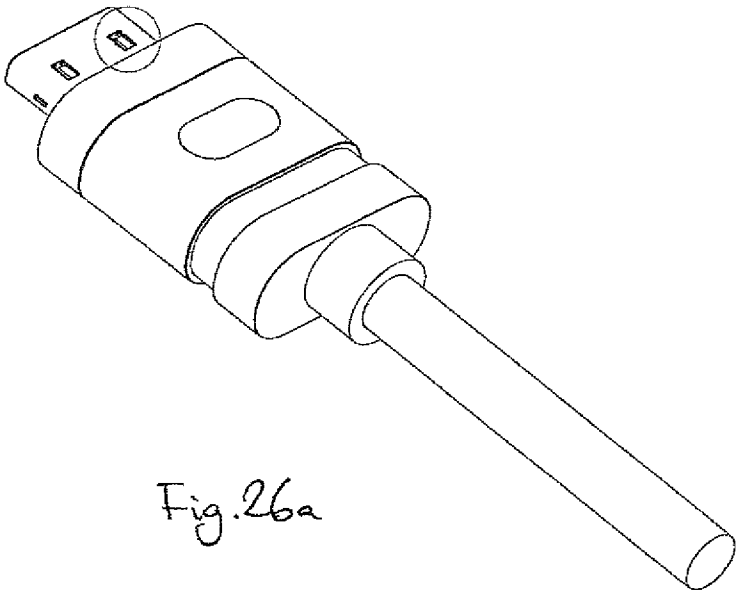
Figure 25B:
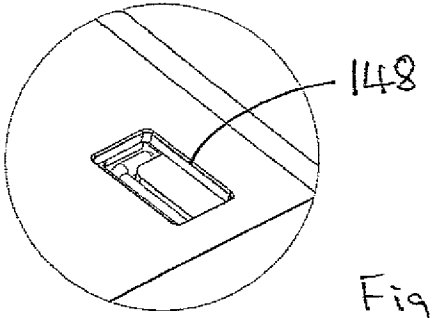
Figure 25A:
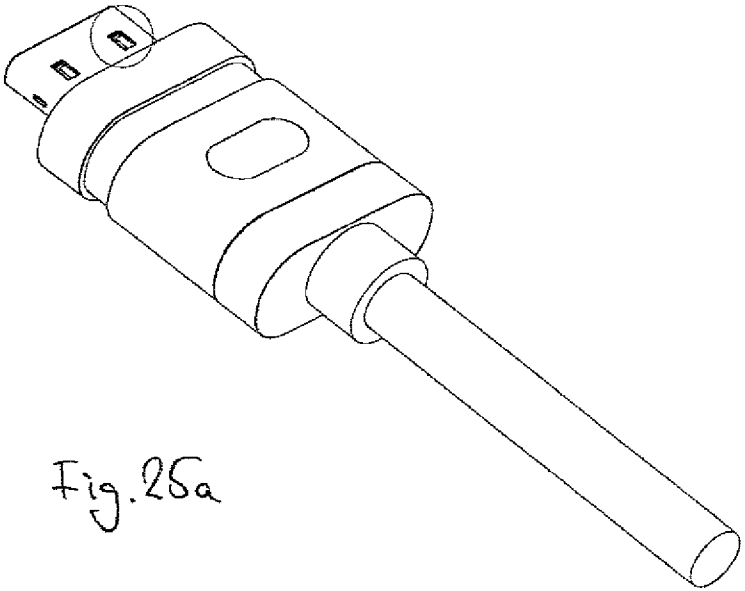
Figure 28B:
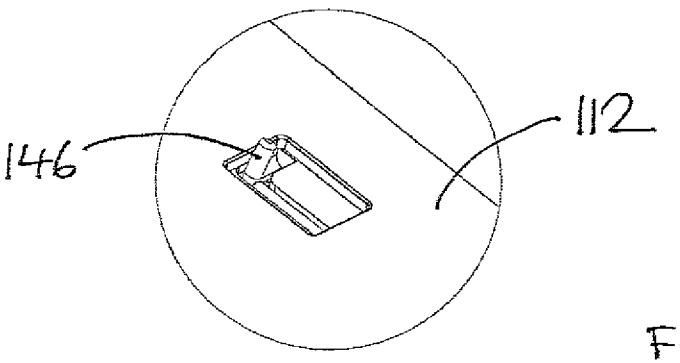
Figure 28A:
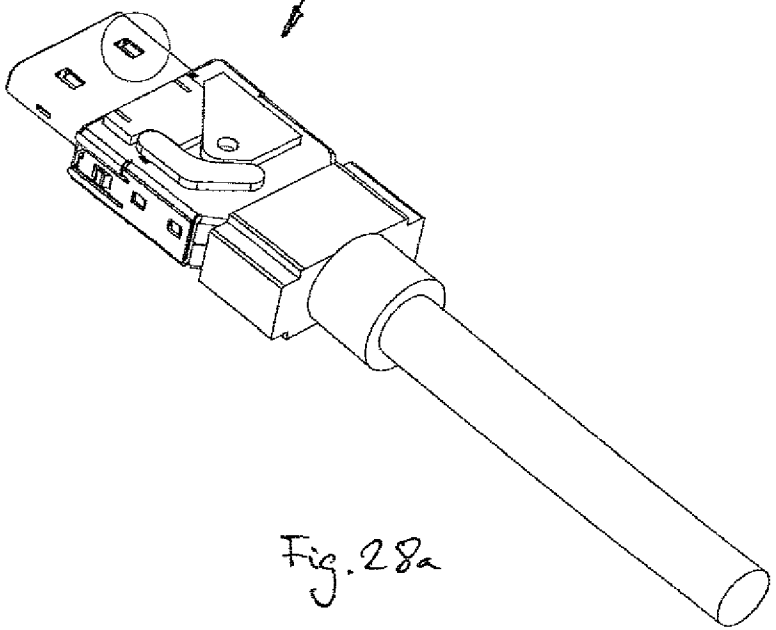
Figure 27B:
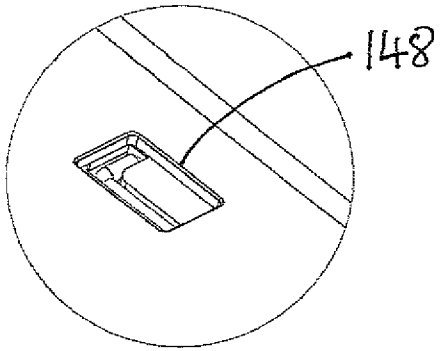
Figure 27A:
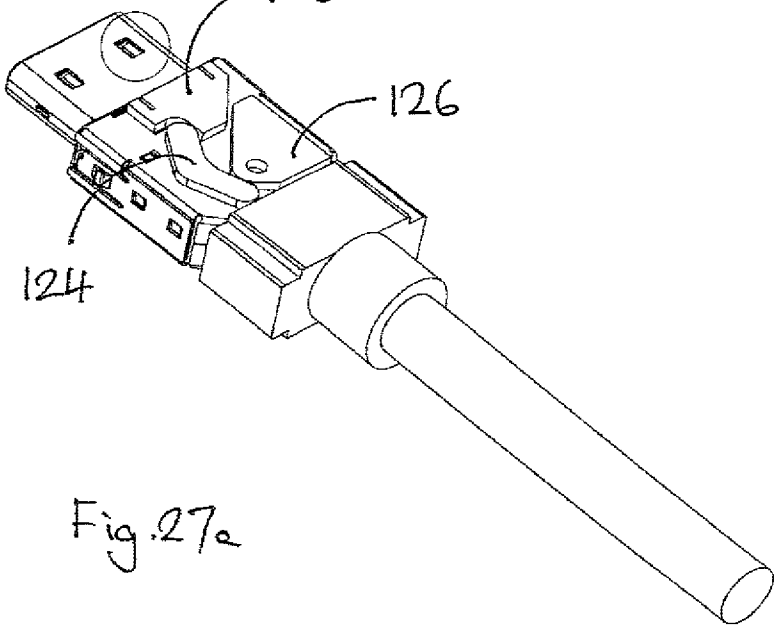
Figure 30A:
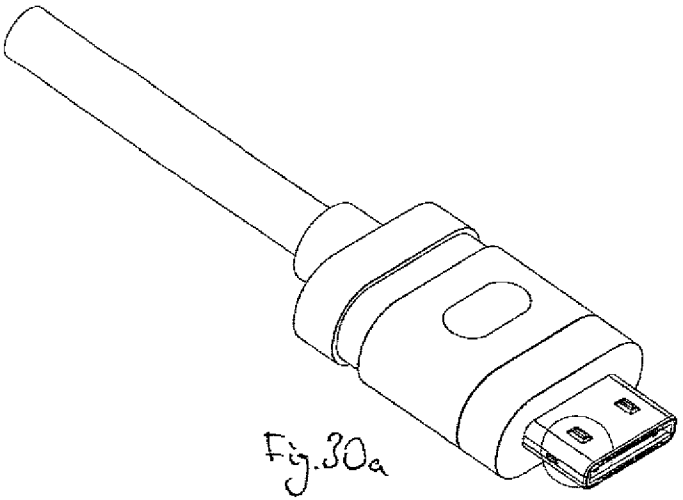
Figure 30B:
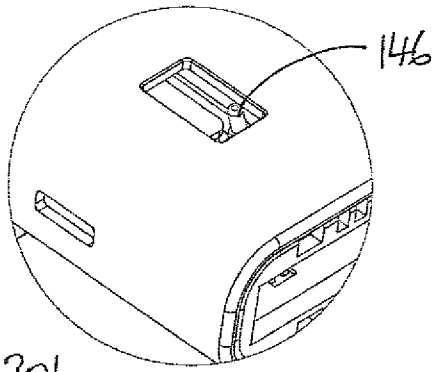
Figure 29A:
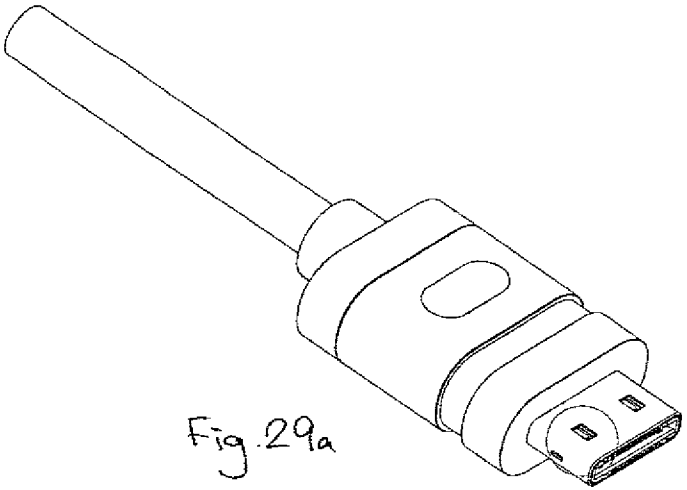
Figure 29B:
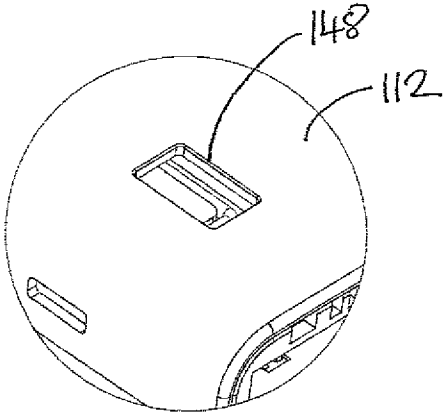
Figure 32A:
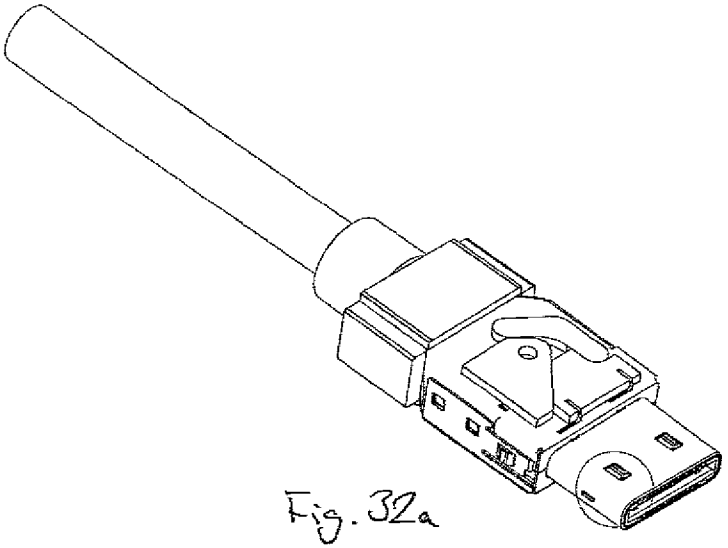
Figure 32B:
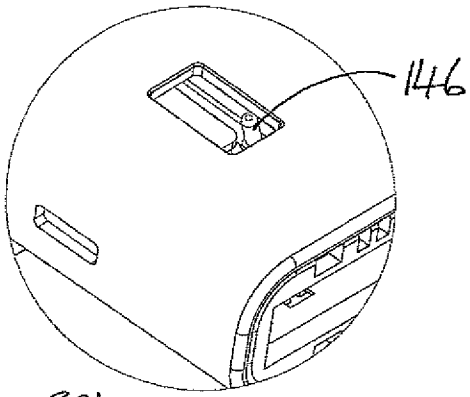
Figure 31A:
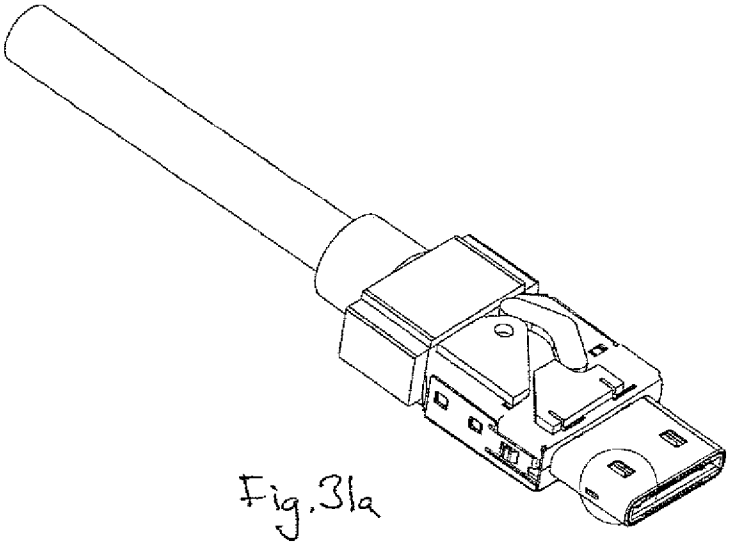
Figure 31B:
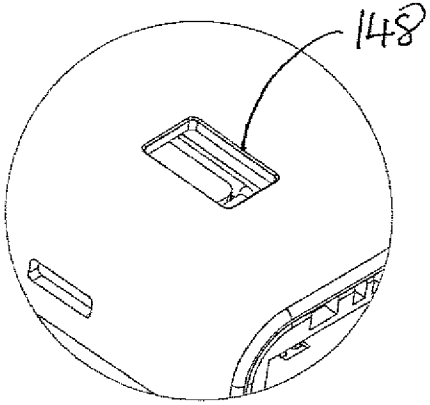
Figures 33, 34A, 34B, 35A, 35B:
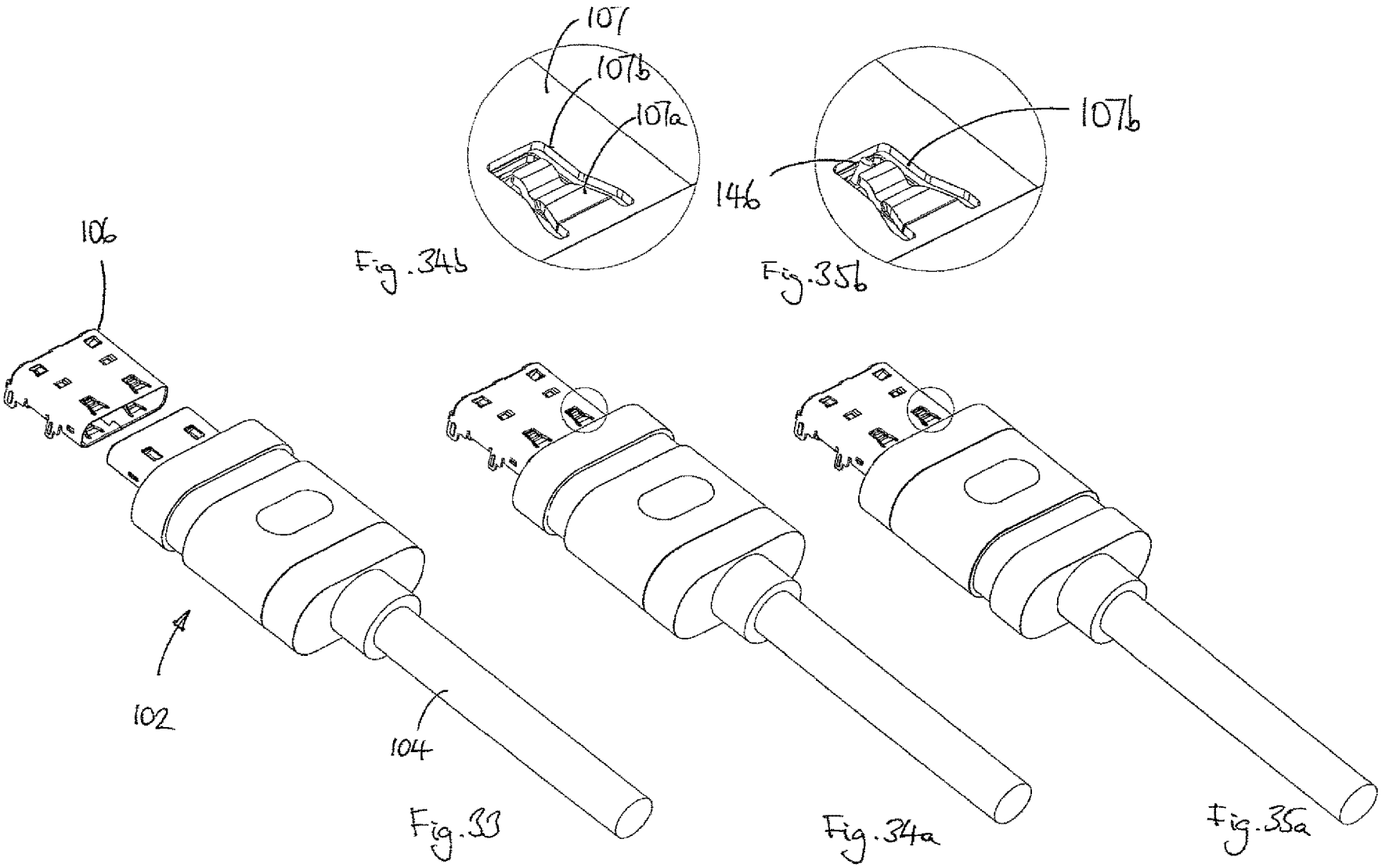
Figures 36, 37A, 37B, 38A, 38B:
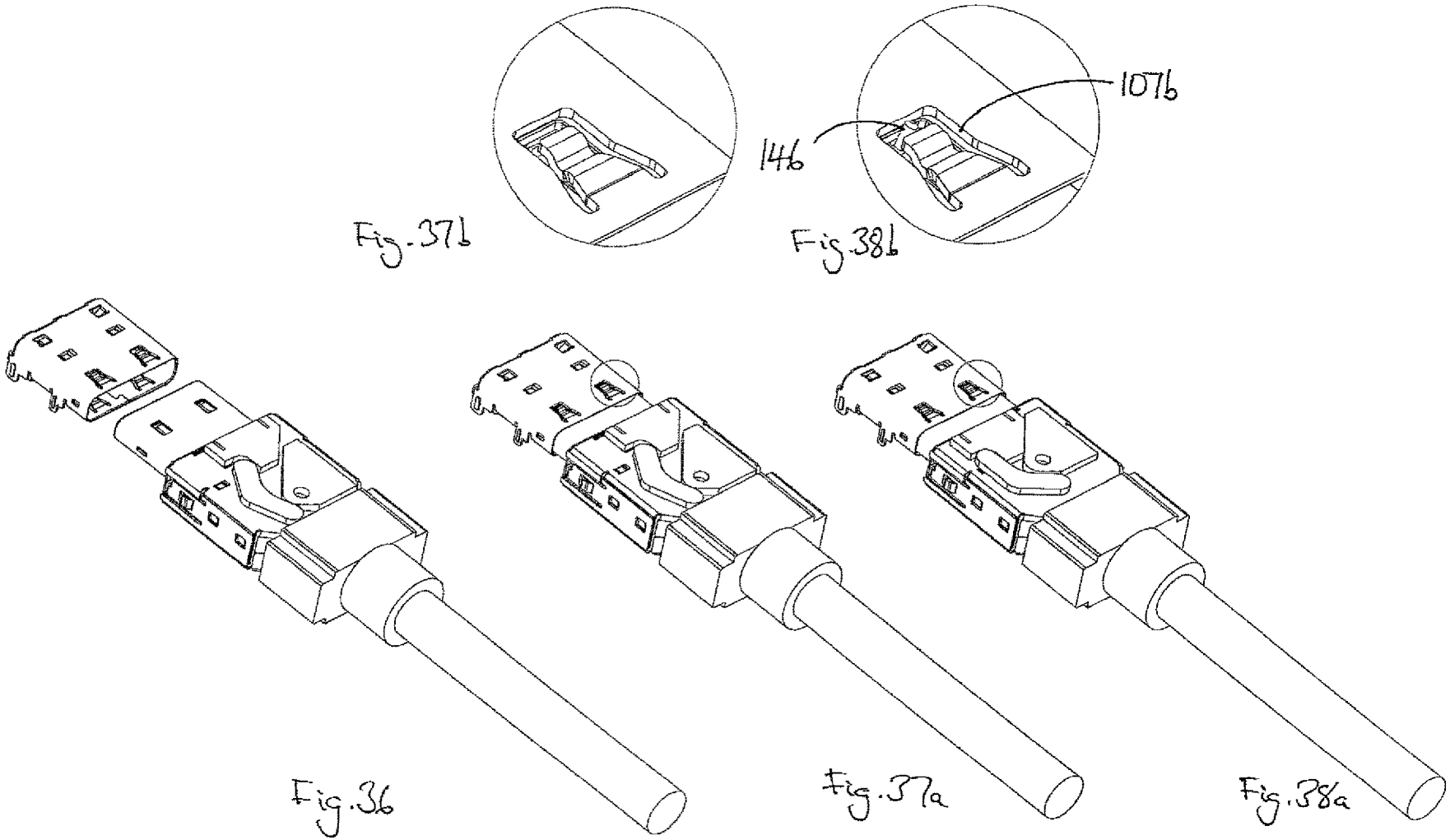
Figures 39, 40A, 40B, 41A, 41B:
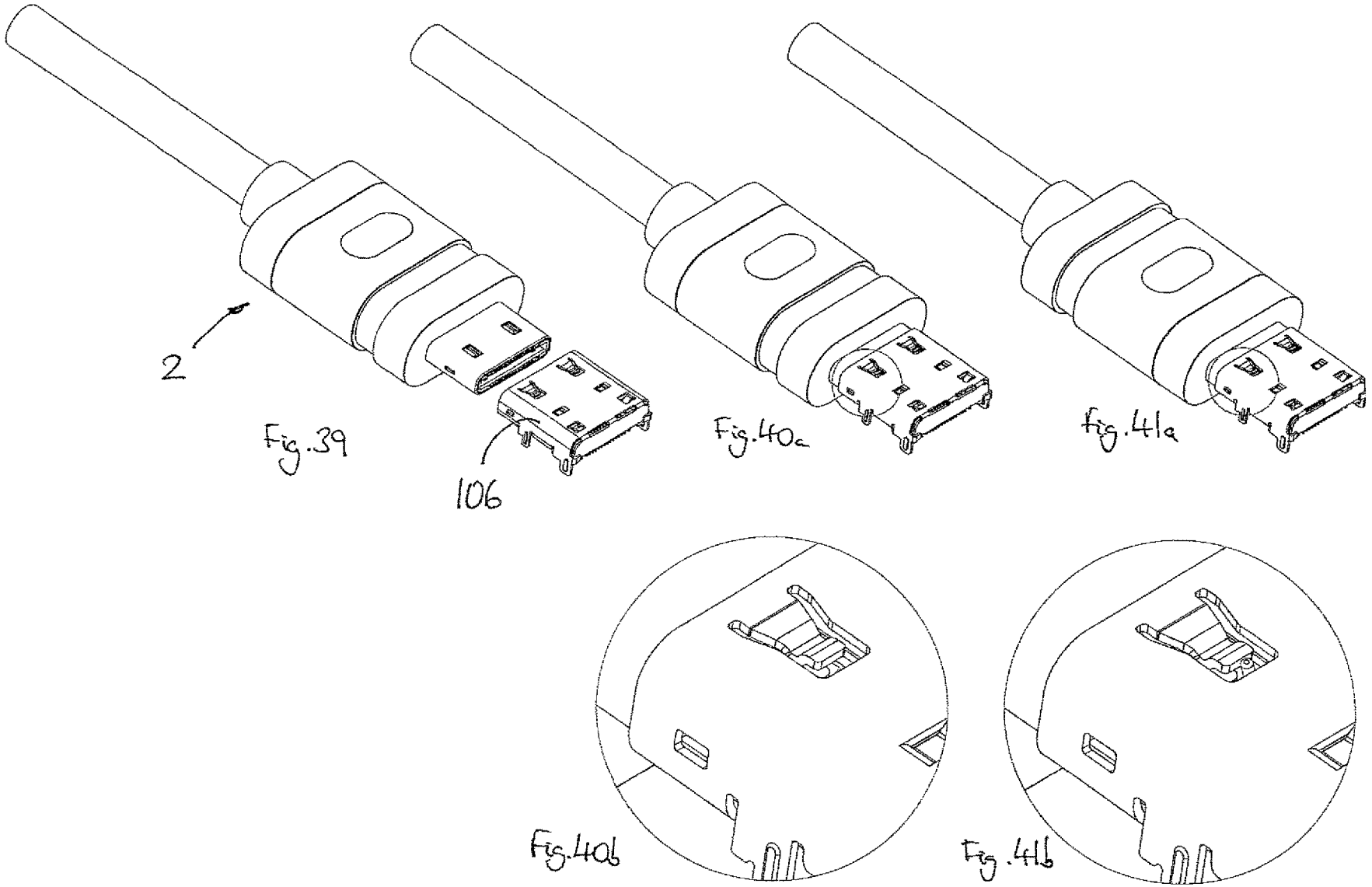
Figures 42, 43A, 43B, 44A, 44B:
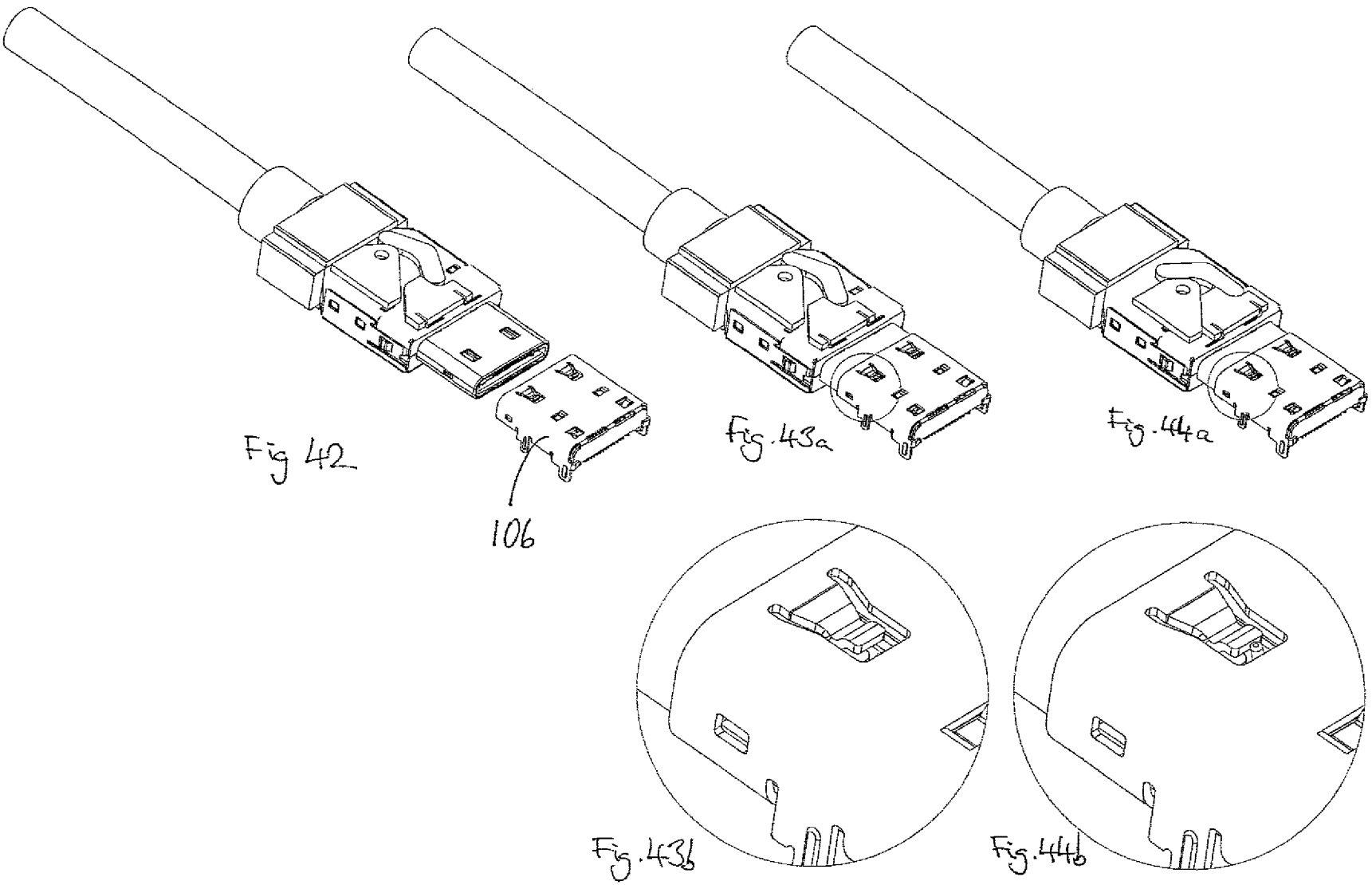
Figures 45, 46:
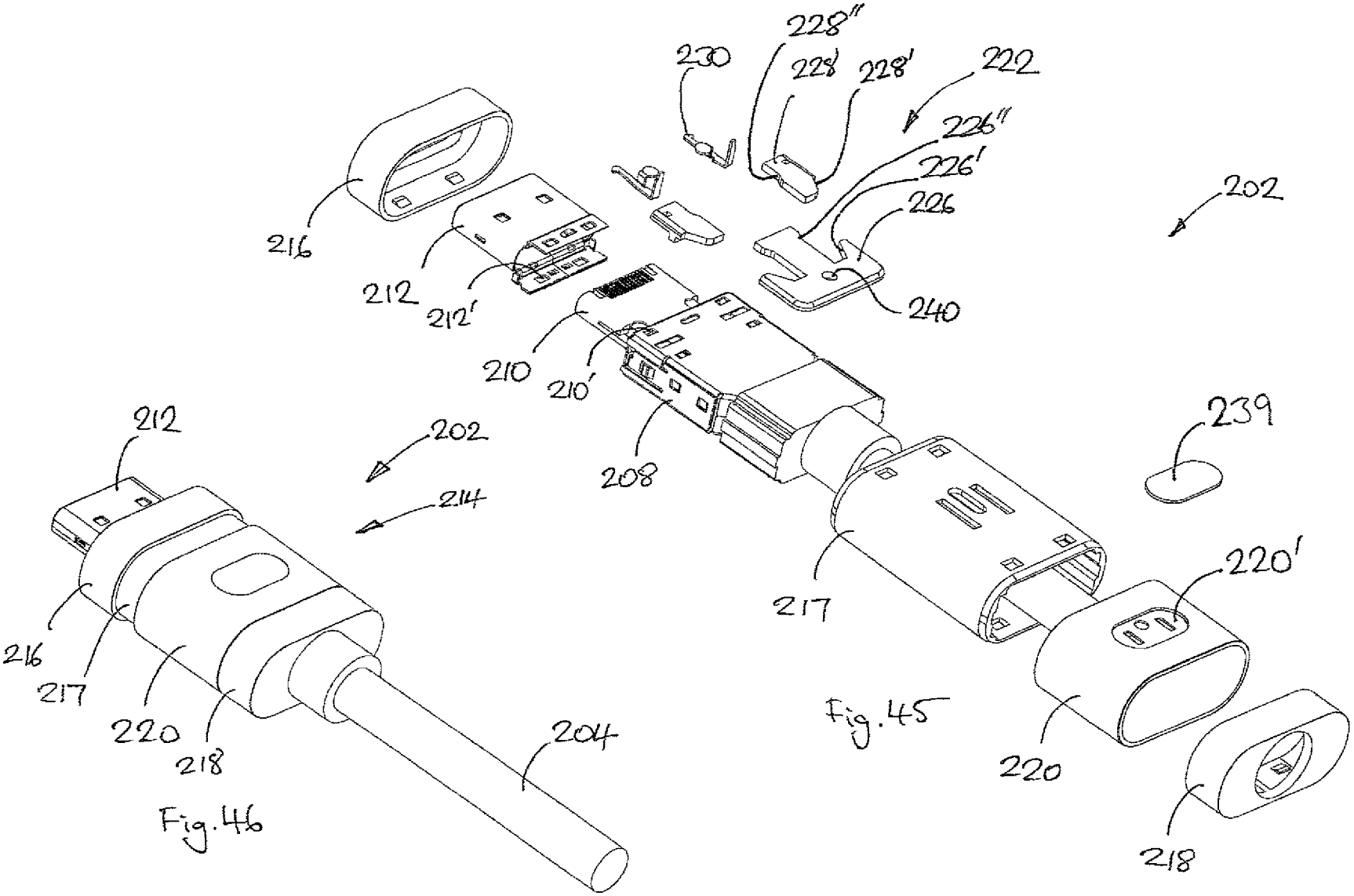
Figure 48A:
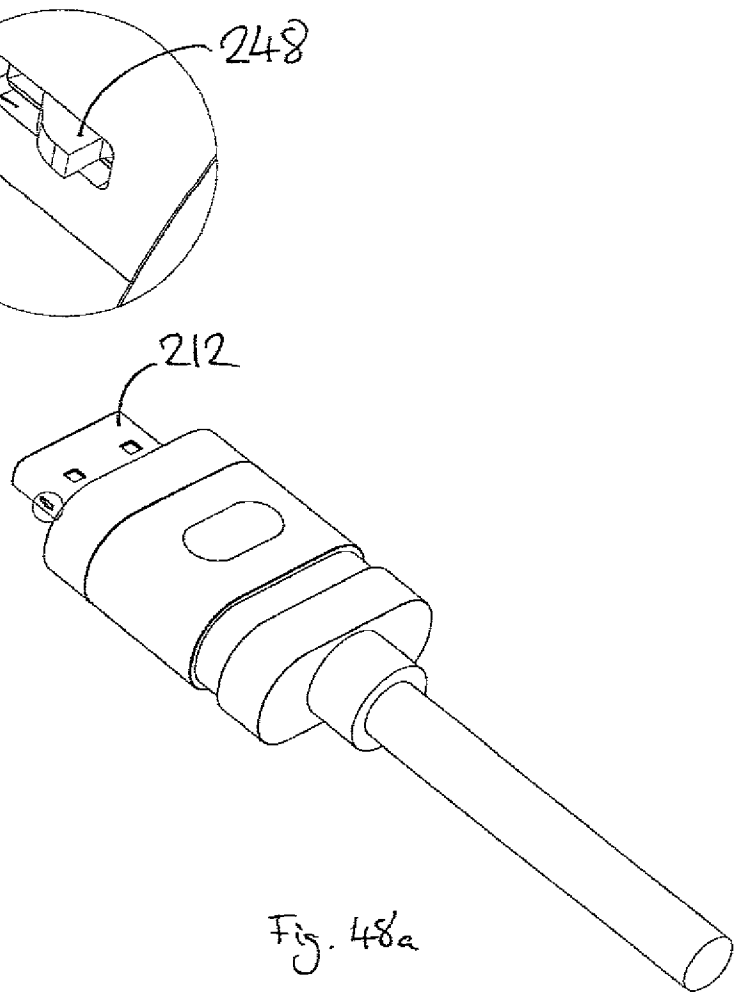
Figure 48B:
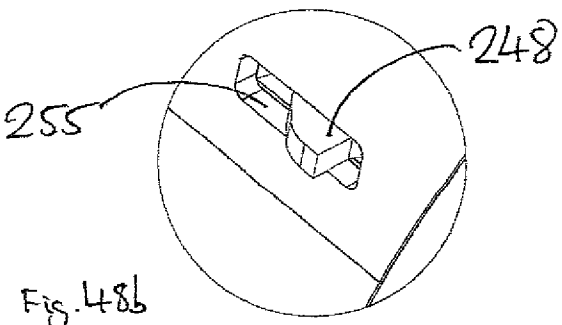
Figure 47A:
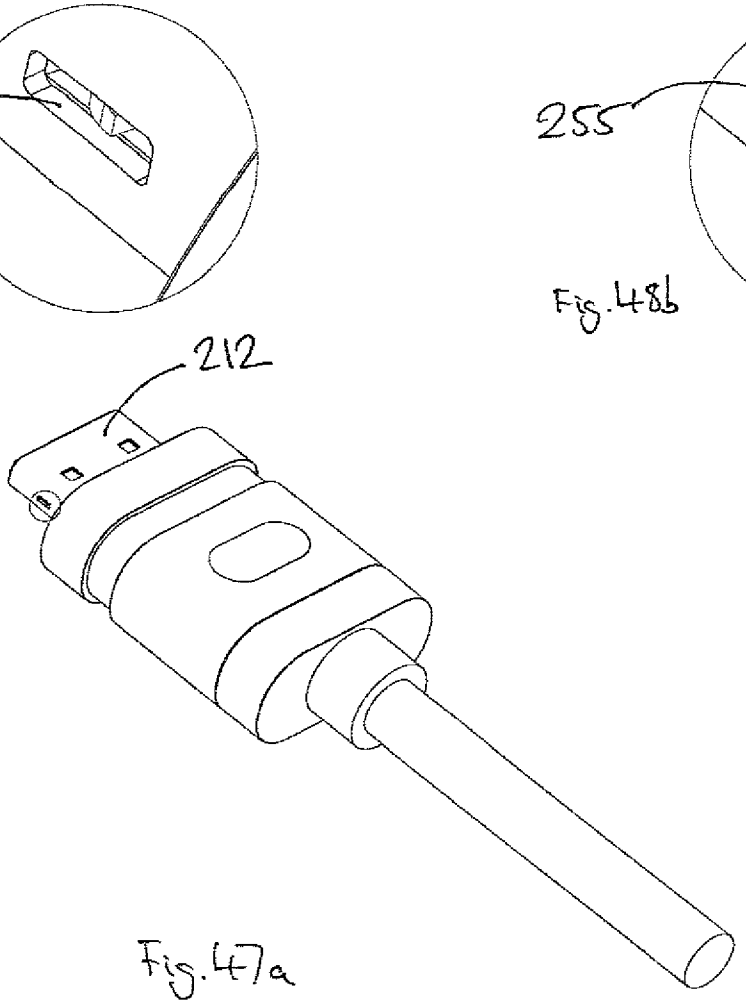
Figure 47B:
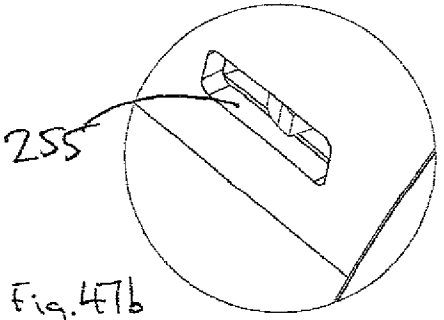
Figure 52B:
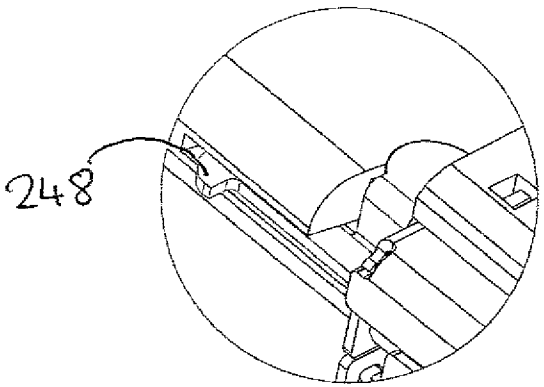
Figure 52A:
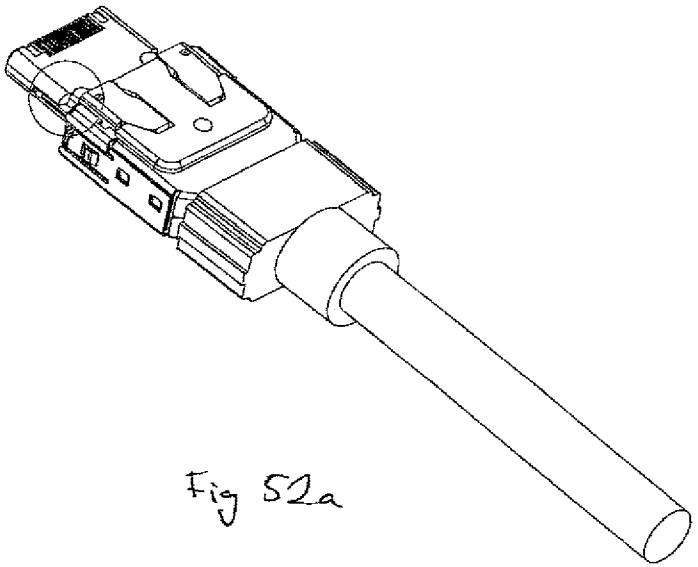
Figure 51B:
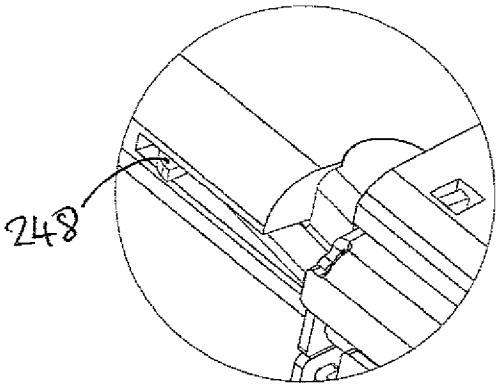
Figure 51A:
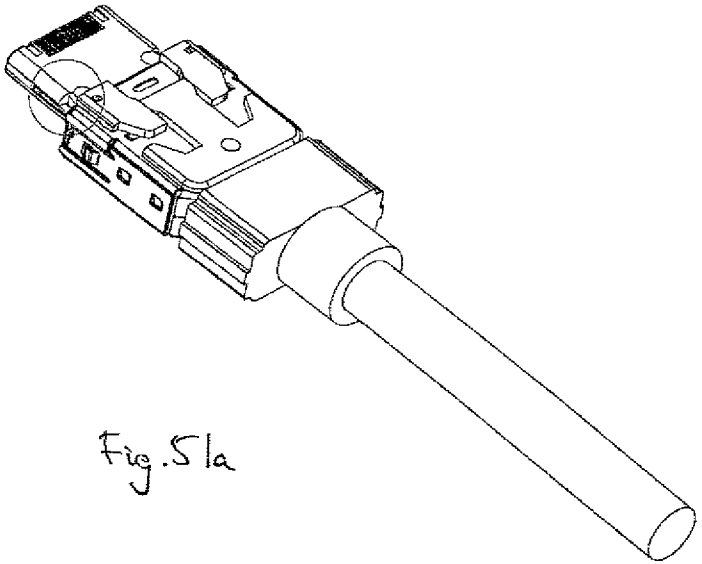
Figure 56A:
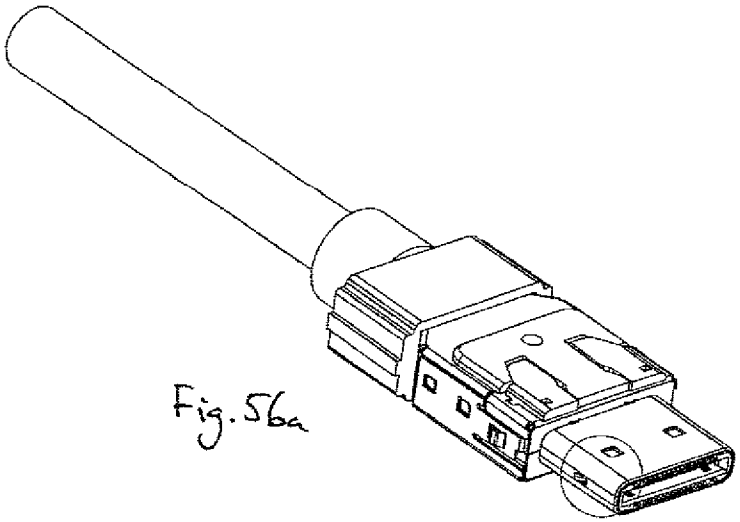
Figure 56B:
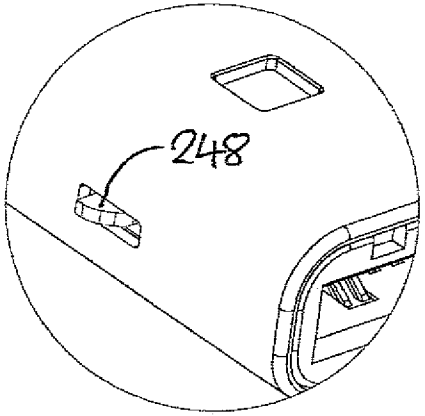
Figure 55A:
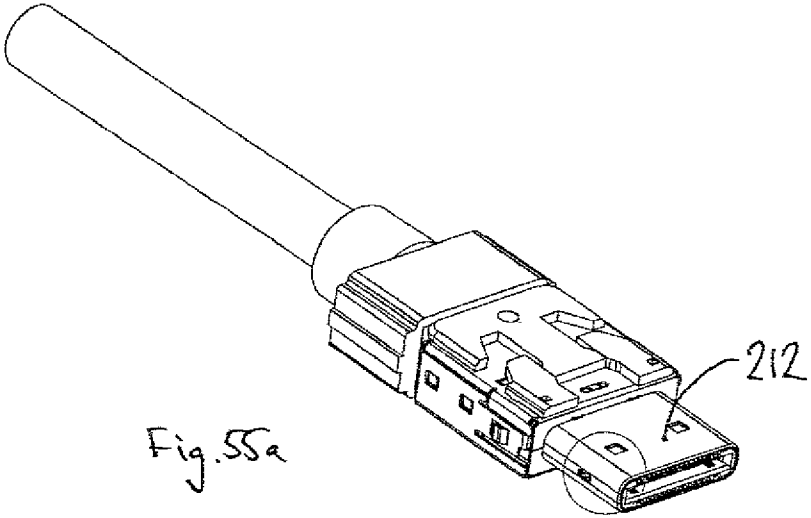
Figure 55B:
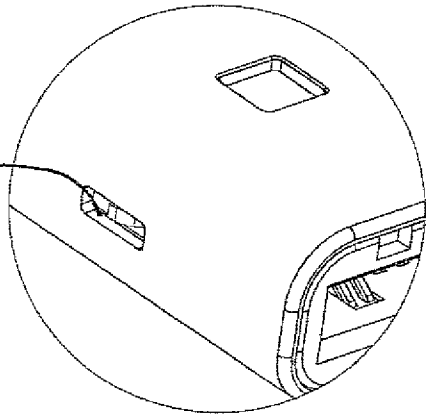

Rotation of each pivoting pin 130 causes the locking arm 146 to pivot through an angle of approximately 90° between an unlocked position shown for example in FIGS. 24, 25, 27, and 29 (etc.) and a locked position shown for example in FIGS. 26, 28, 30 (etc.). When each locking arm 146 is in the unlocked position it extends parallel to the upper surface of the connector block 110 and is accommodated within a transverse portion of the groove 110". It does not protrude from the locking hole 148 and so does not interfere with insertion or removal of the plug 102 to or from the receptacle 106.

When each locking arm 146 is in the locked position it extends substantially perpendicular to the upper surface of the connector block 110 and protrudes through the respective locking hole 148 into the aperture 107*b* that surrounds the spring detent 107*a* in the receptacle 106. This can be seen most clearly in FIGS. 35*b*, 38*b*, 41*b* and 44*b*. When each locking arm 146 is in the locked position it engages the front edge of the respective aperture 107*b* and prevents the plug 102 from being withdrawn from the receptacle 106.

The locking mechanism 122 is actuated by sliding the sleeve 120 forwards to lock the mechanism or rearwards to unlock the mechanism. Therefore, when making a connection, the plug 102 is inserted into the receptacle 106 and the sleeve 120 is then slid forwards to lock the locking mechanism 122, providing a positive locking engagement between the plug 102 and the receptacle 106. When disconnecting the plug, the sleeve 120 is slid backwards to unlock the locking mechanism 122 and the plug 102 is then withdrawn from the receptacle 106.

Embodiment 3

FIGS. 45-70 of the drawings depict an electrical data connector according to a third embodiment of the invention, comprising a plug 202, which is attached to a cable 204, and a receptacle 206 that receives the plug 202. The receptacle 206 may be entirely conventional and will not therefore be described in great detail. Typically, the receptacle 206 includes a metal shield 207 that includes a spring detent 207*a*.

In this embodiment the electrical data connector is a superMHL connector. However, it should be understood that the invention is also applicable to other kinds of electrical data connector (for example, HDMI connectors, USB connectors and others).

The plug 202 includes a body 208 and a connector block 210 that carries a set of connection pins. The superMHL plug includes thirty-two connection pins, which are arranged in two parallel rows. Each row of pins lies in a plane, which in the following description we will refer to as the "horizontal" plane, since in practice this plane is often horizontal. However, it should be understood that the so-called "horizontal" plane may in fact be positioned in any other orientation. We shall also refer to the "longitudinal" direction, which in the following description means the direction in which the plug is inserted into and removed from the receptacle, the "transverse" direction, which is perpendicular to the longitudinal direction and lies in the horizontal plane, and the "vertical" direction, which is perpendicular to the horizontal plane, and the "upper" and "lower" sides of various components, which are defined with reference to the vertical direction. Again, these terms are intended only for reference and are not intended to be limiting in any way.

A metal shield 212 fits over the connector block 210 and is attached to the body 208 by detents 210' that engage locking holes 212' in the shield 212. The cable 204 enters the rear of the body 208 and the wires within the cable are connected to the connection pins. The connector block 210, the shield 212 and the cable 204 are largely conventional (except where indicated otherwise) and so will not be described in further detail.

The plug also includes a casing 214 comprising a front element 216, a central element 217, a rear element 218 and a sliding sleeve 220. The front and rear elements 216, 218 are tubular and fit over the front and rear ends of the body 108. They are attached to the body 208 by detents 216', 218' that engage locking holes 217' in the central element 217.

The front element 216 and the rear element 218 are enlarged relative to the central element 217 to provide outwardly extending stop elements. The sleeve 220 is sized to slide longitudinally over the body 208 between the enlarged front and rear element 216, 218, which limit longitudinal movement of the sleeve 220.

The body 208 accommodates a locking mechanism 222 on its upper face for locking the plug 202 to the receptacle 206. The locking mechanism 222, which is clearly shown for example in FIGS. 45, 49-52 and 55-58, includes a longitudinal sliding element 226, a pair of transverse sliding elements 228 and a pair of pivoting locking arms 230. The longitudinal sliding element 226 is located centrally on the upper surface of the body 208 and is substantially T-shaped, and includes on each of its left and right sides an inner cam surface 226' and an outer cam surface 226", which engage respectively outer and inner cam surfaces 228', 228" on each of the transverse sliding elements 228.

The cam surfaces 226', 226", 228', 228" are arranged so that forwards longitudinal movement of the longitudinal sliding element 226 causes inwards transverse sliding movement of the two transverse sliding elements 228, and rearwards longitudinal movement of the longitudinal sliding element 226 causes outwards transverse sliding movement of the two transverse sliding elements 228.

The longitudinal sliding element 226 and the two transverse sliding elements 228 are thus configured to move in unison, movement of the three elements being driven by the longitudinal sliding element 226, which is coupled to the sliding sleeve 220 through a drive pin 229 on the underside of a drive plate 239 that fits into a recess 220' on the upper surface of the sleeve 220. The drive pin engages a drive hole 240 provided in the upper surface of the longitudinal sliding element 226. When the sleeve 220 is pushed forwards this causes the longitudinal sliding element 226 to slide forwards and the transverse sliding elements 228 to slide transversely outwards. When the sliding sleeve 220 is moved rearwards this causes the longitudinal sliding element 226 to slide rearwards, which causes the transverse sliding elements 228 to slide transversely inwards.

It should be noted that in this embodiment the longitudinal sliding element 226 and the transverse sliding elements 228 all lie in the same plane and engage each other only along their respective edges, which are perpendicular to the plane in which the elements lie. The elements do not slide over each other. This arrangement reduces friction and helps to ensure smooth operation of the locking/unlocking mechanism 222, both when locking and unlocking the mechanism. The mechanism is also extremely compact, allowing it to be accommodated within a housing that meets the defined specification for superMHL plugs.

Figure 58A:
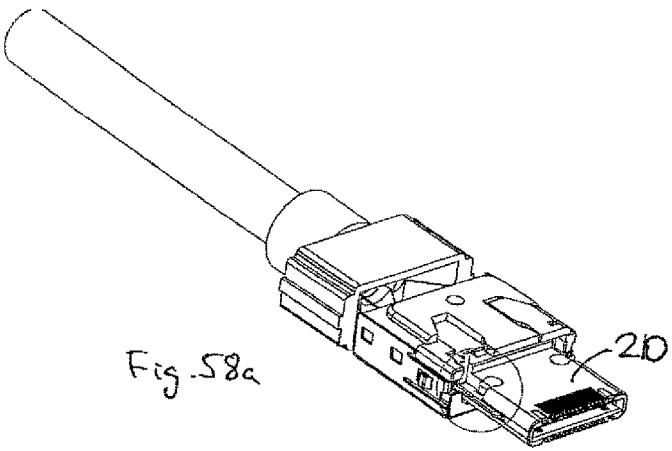
Figure 58B:
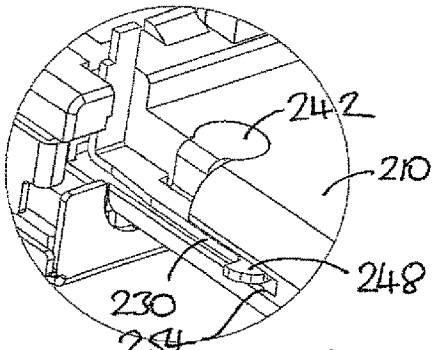
Figure 58C:
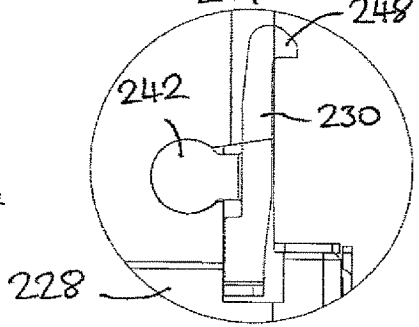
Figure 57A:
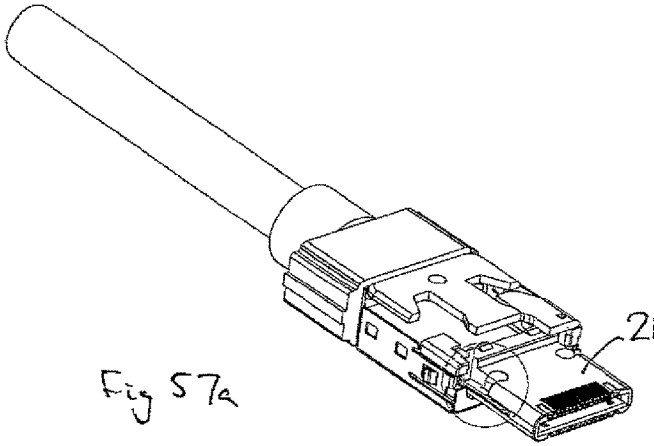
Figure 57B:
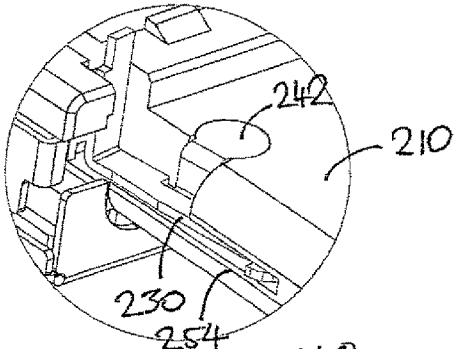
Figure 57C:
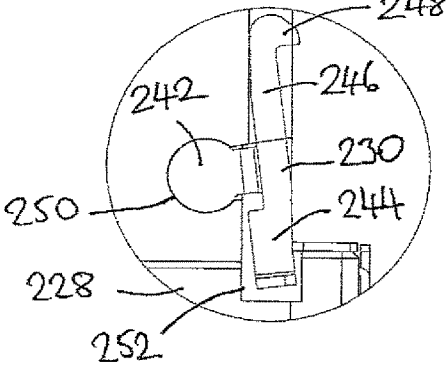
Figures 59, 60A, 60B, 61A, 61B:
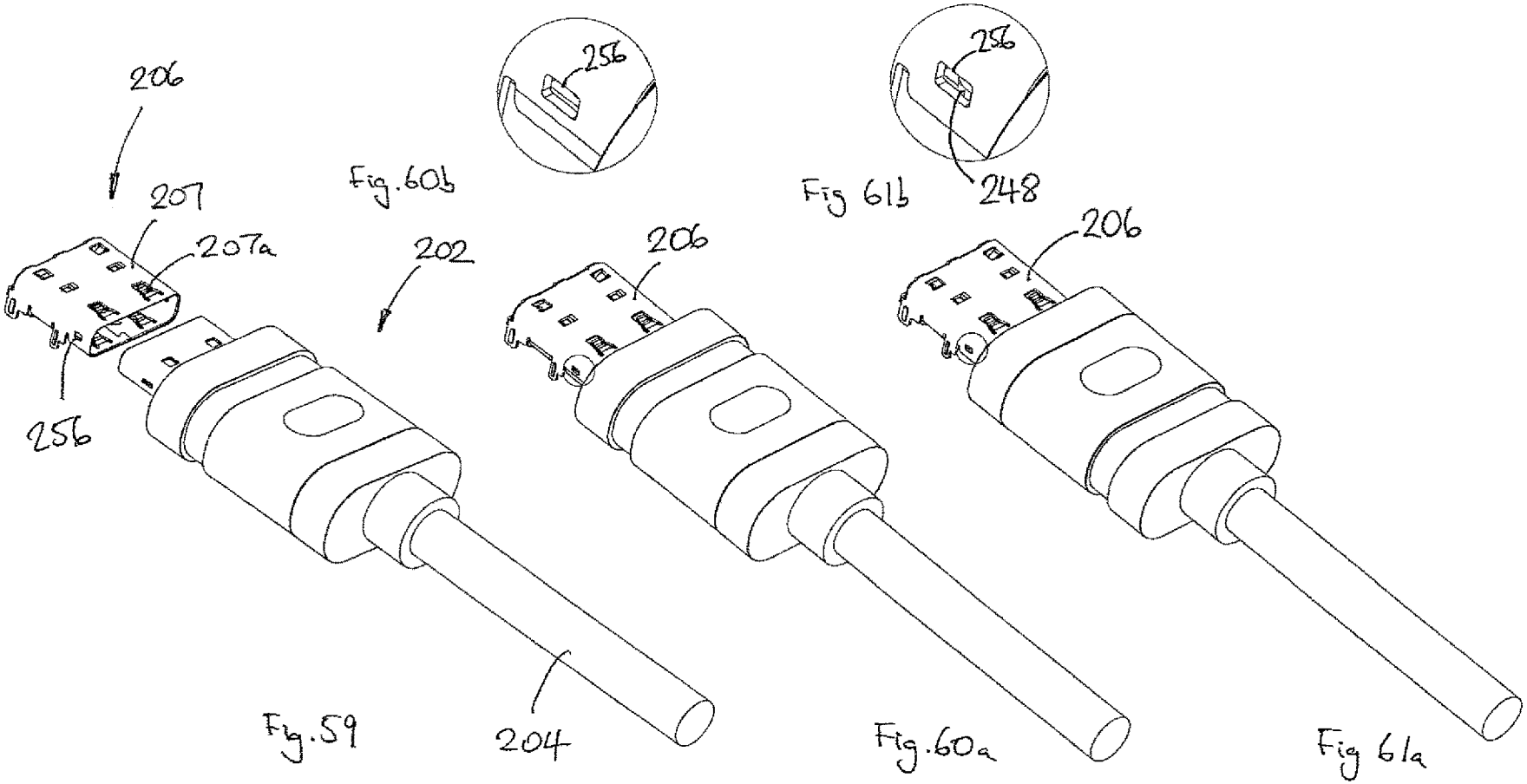
Figures 62, 63A, 63B, 64A, 64B:
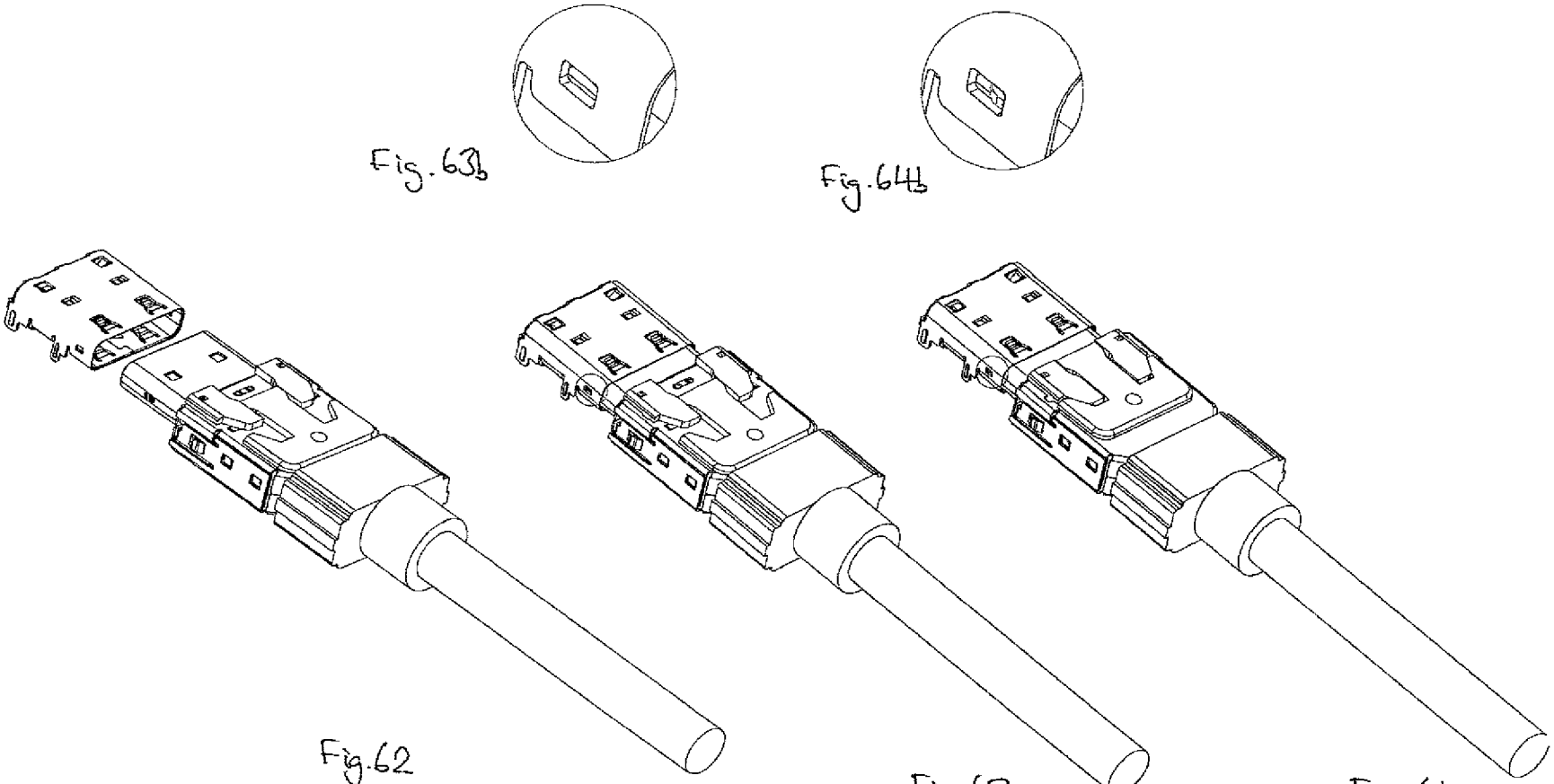
Figures 65, 66A, 66B, 67A, 67B:
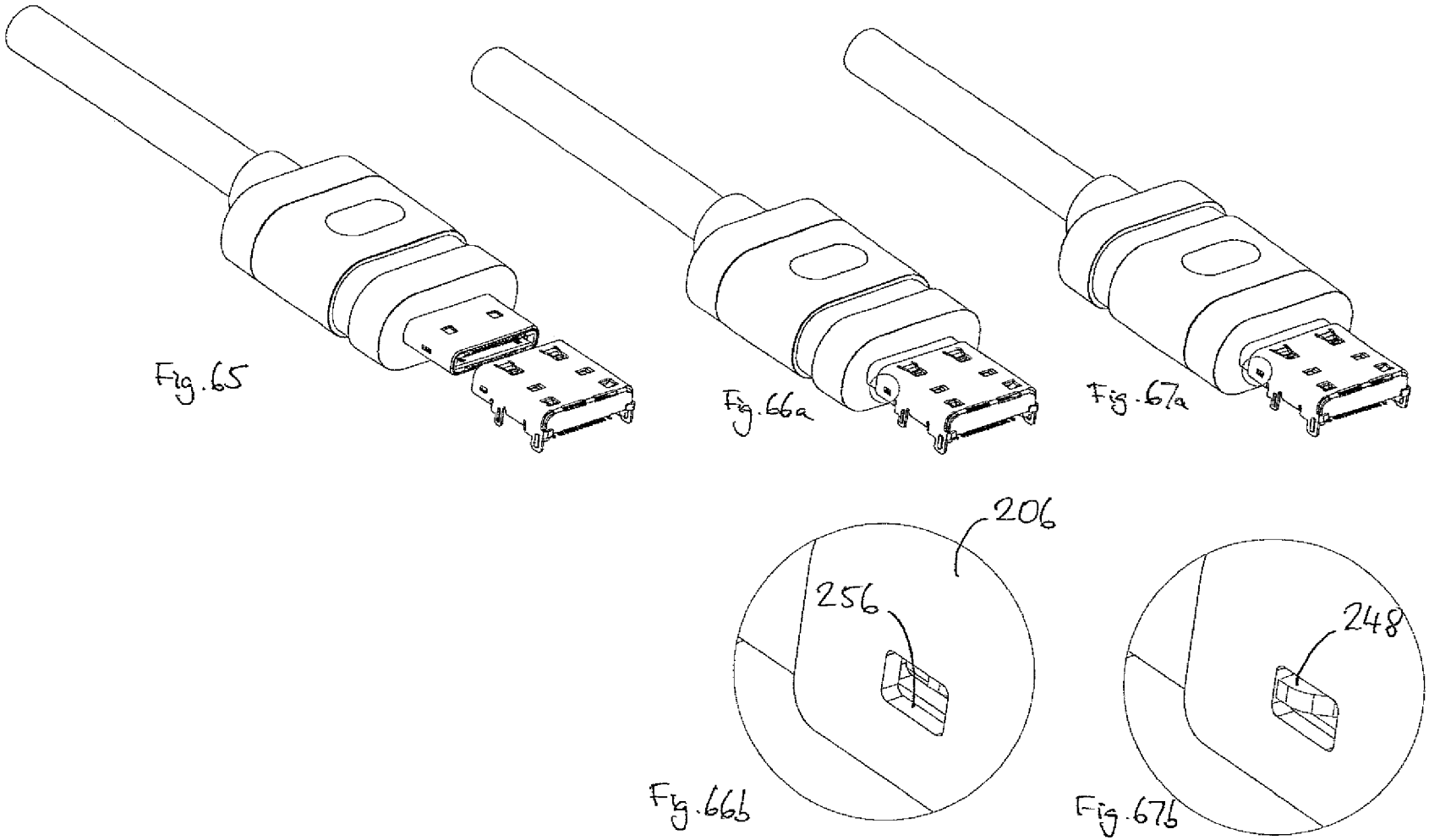
Figure 70A:
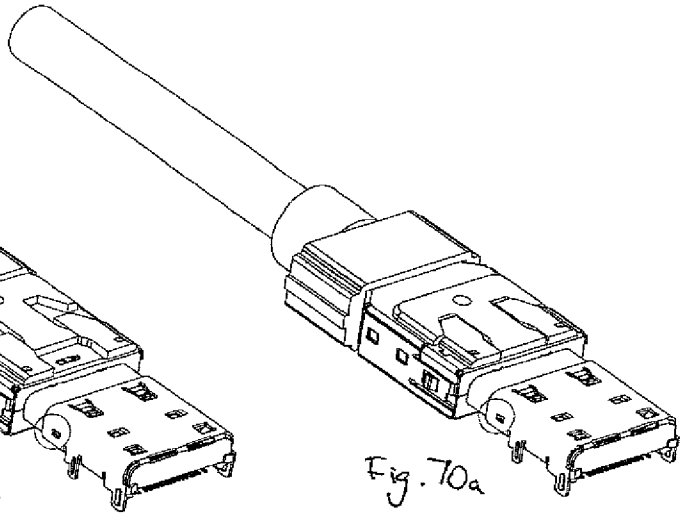
Figure 70B:
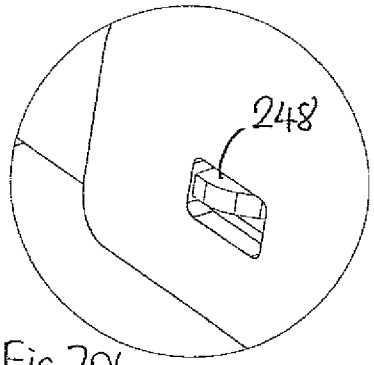
Figure 69A:
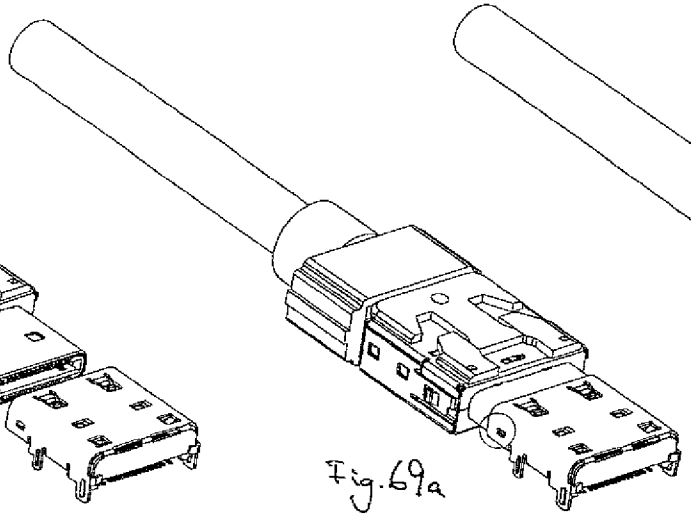
Figure 69B:
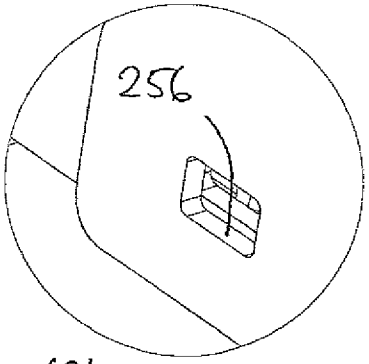
Figure 68:
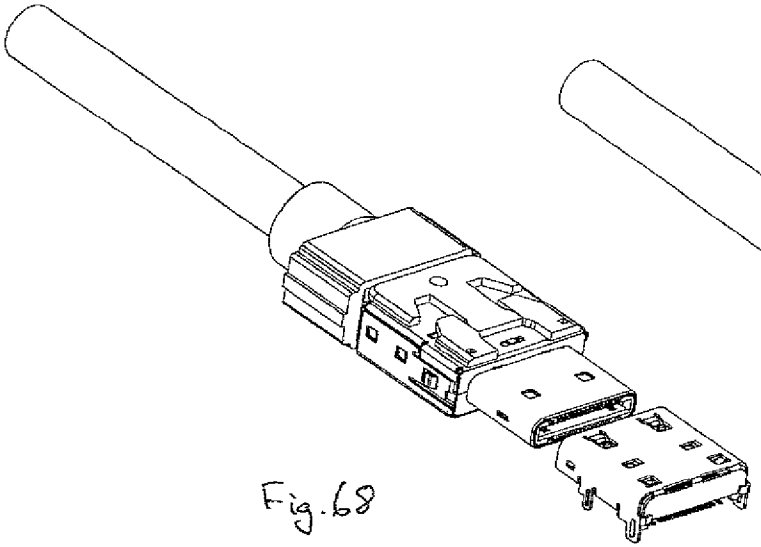

The pivoting locking arms 230, which are shown most clearly in FIGS. 57 and 58, each include a central pivot portion 242, a rear portion 244 and a front portion 246 that includes an outwards-facing locking hook 248. The central pivot portion 242 is located within a recess 250 in the connector block 210, which allows the locking arm to pivot about a substantially vertical axis between an unlocked position shown in FIG. 57 and a locked position shown in FIG. 58.

The rear portion 244 of each locking arm 230 extends into the body 208 and is seated within a groove 252 provided in the front face of the transverse sliding element 228. Transverse movement of the transverse sliding element 128 thus causes the locking arm 230 to pivot about the axis of the central pivot portion 242.

The front portion 246 of each locking arm 230 is located within one of a pair of slots 254, each slot being in one side of the connector block 210. When each locking arm 230 is in the unlocked position shown in FIG. 57 its respective locking hook 248 is accommodated within the respective slot 254 and does not protrude beyond the sides of the connector block 210 and the sleeve 212. It does not then interfere with insertion or removal of the plug 202 to or from the receptacle 206. When each locking arm is in the locked position shown in FIG. 58 the locking hook 248 extends sideways from the slot 254 and protrudes through one of a pair of holes 255, one hole being in each side of the sleeve 212. It then engages one of a pair of apertures 256, each in one side of the receptacle 206 and prevents the plug 202 from being withdrawn from the receptacle 206. This is shown most clearly in FIGS. 59-70.

The locking mechanism 222 is actuated by sliding the sleeve 220 forwards to lock the mechanism or rearwards to unlock the mechanism. Therefore, when making a connection, the plug 202 is inserted into the receptacle 206 and the sleeve 220 is then slid forwards to lock the locking mechanism 222, providing a positive locking engagement between the plug 202 and the receptacle 206. When disconnecting the plug, the sleeve 220 is slid backwards to unlock the locking mechanism 222 and the plug 202 is then withdrawn from the receptacle 206.

Embodiment 4

With reference to the drawings, the fourth electrical data connector shown in FIGS. 71-94*b* comprises a plug 302, which is attached to a cable 304, and a receptacle 306 that receives the plug 302. The receptacle 306 may be entirely conventional and will not therefore be described in great detail. Typically, the receptacle 306 includes a metal shield 307 that includes a pair of spring detents 307*a*, 307*a*' each one positioned within a corresponding aperture 307*b*, 307*b*' in the upper part of the shield 307.

In this embodiment the electrical data connector is a HDMI connector. However, it should be understood that the invention is also applicable to other kinds of electrical data connector (for example, mDP connectors, USB connectors and others).

The plug 302 includes a body 308 and a connector block 310 that carries a set of connection pins. The HDMI plug includes nineteen connection pins, which are arranged in two parallel rows. Each row of pins lies in a plane, which in the following description we will refer to as the "horizontal" plane, since in practice this plane is often horizontal. However, it should be understood that the so-called "horizontal" plane may in fact be positioned in any other orientation. We shall also refer to the "longitudinal" direction, which in the following description means the direction in which the plug is inserted into and removed from the receptacle, the "transverse" direction, which is perpendicular to the longitudinal direction and lies in the horizontal plane, and the "vertical" direction, which is perpendicular to the horizontal plane, and the "upper" and "lower" sides of various components, which are defined with reference to the vertical direction. Again, these terms are intended only for reference and are not intended to be limiting in any way.

A metal shield 312 fits over the connector block 310 and is attached to the body 308 by detents 310' that engage locking holes 312' in the shield 312. The cable 304 enters the rear of the body 308 and the wires within the cable are connected to the connection pins. The connector block 310, the shield 312 and the cable 304 are largely conventional (except where indicated otherwise) and so will not be described in further detail.

The plug also includes a casing 314 comprising a front element 316, an upper element 313, a lower element 313' and a sliding sleeve 320. The front element 116 is tubular and fits over the front end of the body 308. The upper and lower elements 313, 313' fit together to enclose the body 308. When the upper and lower elements 313, 313' are fitted together they form a central element 314 and a rear element 318.

The front element 316 and the rear element 318 are enlarged relative to the central element 317 to provide outwardly extending stop elements. The sleeve 320 is sized to slide longitudinally over the body 308 (and hence over the central element 317) between the enlarged front and rear element 316, 318, which limit longitudinal movement of the sleeve 320.

The body 308 accommodates a locking mechanism 322 on its upper face for locking the plug 302 to the receptacle 306. The locking mechanism 322, which is clearly shown for example in FIGS. 72, 75*a*, 76*a*, 79*a* and 80*a*, includes a pivoting element 324, a longitudinal sliding element 326, a transverse sliding element 328 and a pair of pivoting pins 330. The pivoting element 324 has on its lower surface a pivot pin (not shown) with a vertical pivot axis, which is received in a hole 332 on the upper surface of the body 308 and is located on the left side of the body 308 (as seen from above). The longitudinal sliding element 326 is located on the right side of the body 308 and includes on its left edge a convex cam surface 326' that engages the right edge of the pivoting element 324 to control pivoting movement of the pivoting element 324.

The front part of the cam surface 326' also engages the right edge 328' of the transverse sliding element 328. The front part of the cam surface 326' and a right edge 328' of the transverse sliding element 328 are both inclined at an acute angle relative to the longitudinal axis of the body 308 so that forwards longitudinal movement of the longitudinal sliding element 326 causes transverse sliding movement of the transverse sliding element 328 from right to left.

The left hand edge of the transverse sliding element 328 engages a front part 324' of the pivoting element 324. Transverse movement of the transverse sliding element 328 from right to left therefore causes pivoting movement of the pivoting element 324 in an anticlockwise direction. Conversely, pivoting movement of the pivoting element 324 in a clockwise direction drives the transverse sliding element 328 from left to right.

The pivoting element 324, the longitudinal sliding element 326 and the transverse sliding element 328 are thus configured to move in unison, movement of the three elements being driven by the longitudinal sliding element 326, which is coupled to the sliding sleeve 320 through a drive pin 329 on the underside of the sleeve 320, which engages a drive hole 340 provided in the upper surface of the longitudinal sliding element 326. It will be appreciated that as an alternative the drive pin mechanism shown in the other embodiments could be used in this embodiment or the drive pin mechanism shown in this embodiment could be used with the other embodiments. When the sleeve 320 is pushed forwards this causes the longitudinal sliding element 326 to slide forwards, the transverse sliding element 328 to slide sideways, and the pivoting element 324 to rotate. When the sliding sleeve 320 is moved rearwards this causes the longitudinal sliding element 326 to slide rearwards, which causes the pivoting element 324 to rotate in the opposite direction, thus causing the transverse sliding element 328 to slide sideways in the opposite direction.

It should be noted that in this embodiment the pivoting element 324, the longitudinal sliding element 326 and the transverse sliding element 328 all lie in the same plane and engage each other only along their respective edges, which are perpendicular to the plane in which the elements lie. The elements do not slide over each other. This arrangement reduces friction and helps to ensure smooth operation of the locking/unlocking mechanism 322, both when locking and unlocking the mechanism. The mechanism is also extremely compact. The two different positions of the pivoting element 324, a longitudinal sliding element 326, a transverse sliding element 328 in the unlocked and locked configuration are clearly shown in FIGS. 93*a* and 94*a*.

Figures 71, 72:
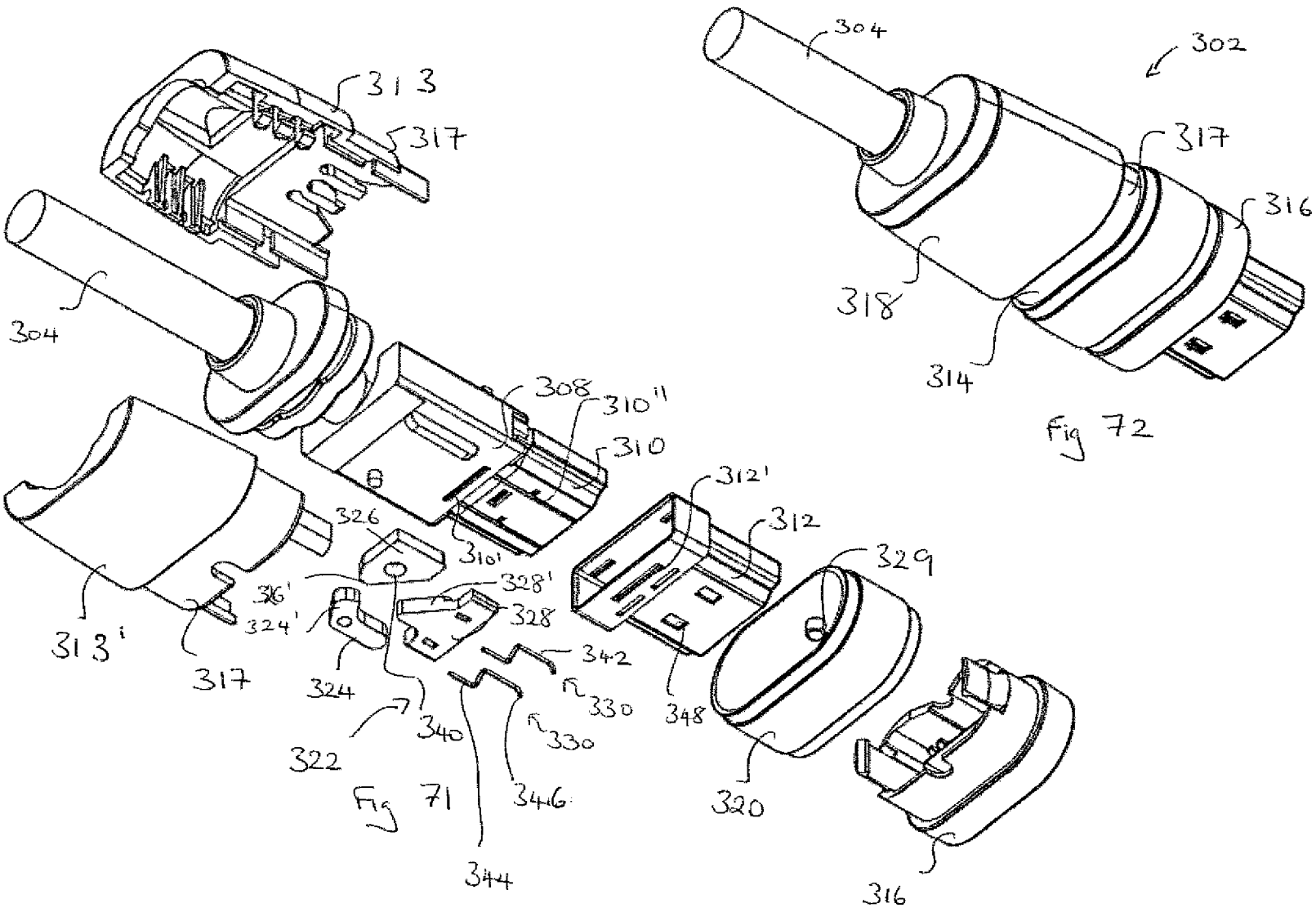
Figure 73B:
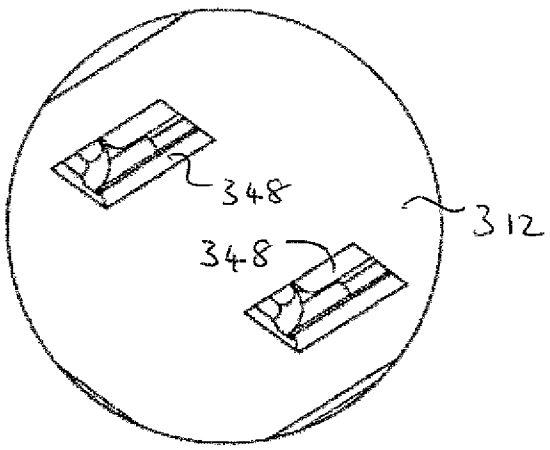
Figure 73A:
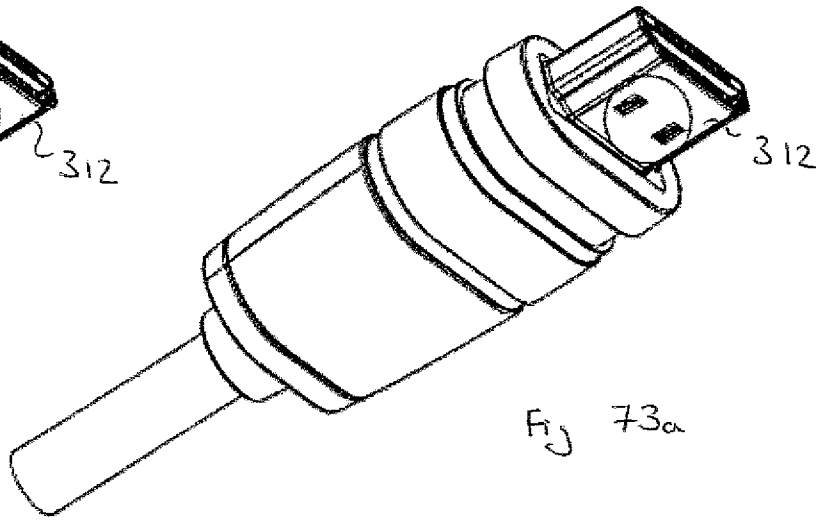

The pivoting pins 330, which are shown most clearly in FIG. 71, each include a central portion 342, a rear crank portion 344 that is offset from the central portion 342, and a locking arm 346, which is provided at the front end of the central portion 342 and is perpendicular to the axis of the central portion 342.

The central portion 342 of each pin extends in the longitudinal direction of the plug 302 and is seated within one of a pair of longitudinal grooves 310" provided in the upper surface of the connector block 310, allowing each pivoting pin 310 to rotate about the axis of the central portion 342. The central portion 342 of each pin is retained in the respective groove 310" by the shield 312.

The rear crank part 344 of each pin 330 extends into the body 308 and is seated within one of a pair of grooves 349 provided in the transverse sliding element 328. Transverse movement of the transverse sliding element 328 thus causes each pin 330 to rotate about the axis of the central portion 342.

The locking arm 346 of each pin is located beneath one of a pair of locking holes 348 provided in the upper part of the shield 312. Conventionally, the locking holes 348 are each engaged by one of a pair of spring-loaded detents to retain the plug within a receptacle. Each locking arm 346 is therefore located adjacent the rear edge of the corresponding locking hole 348 to avoid interfering with operation of the detent when the plug 302 is inserted into a conventional receptacle.

Figure 74B:
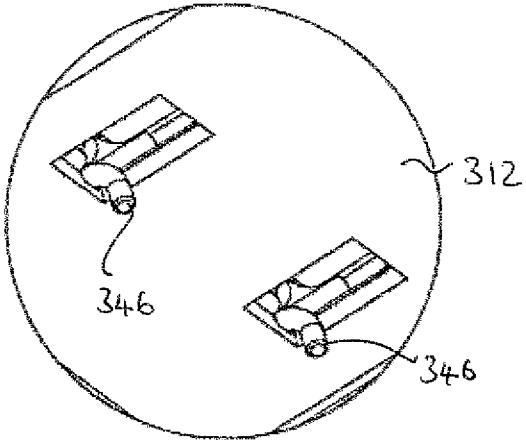
Figure 74A:
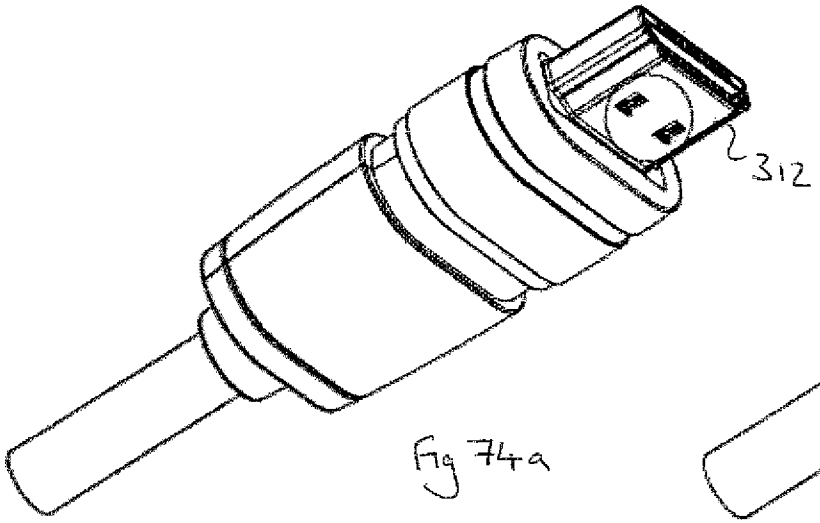
Figure 75A:
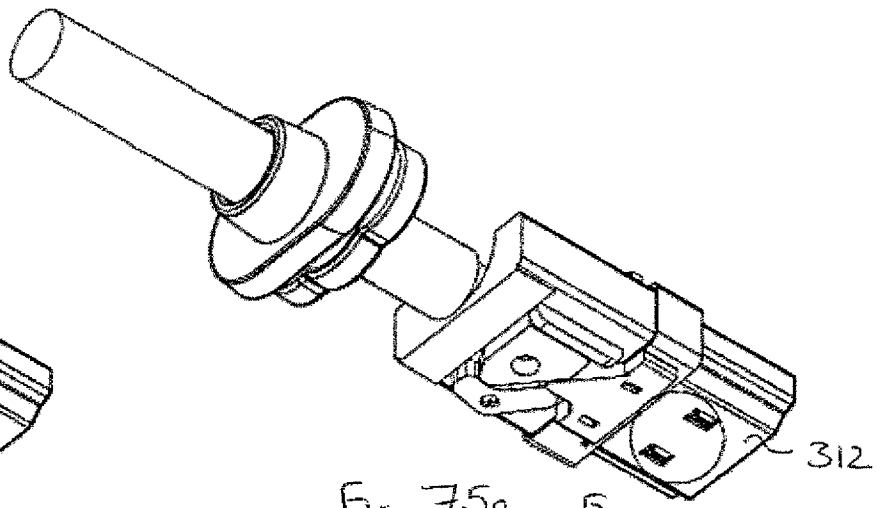
Figure 75B:
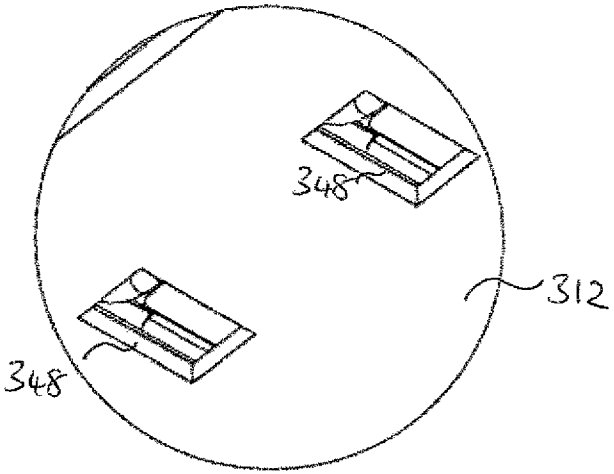
Figure 76A:
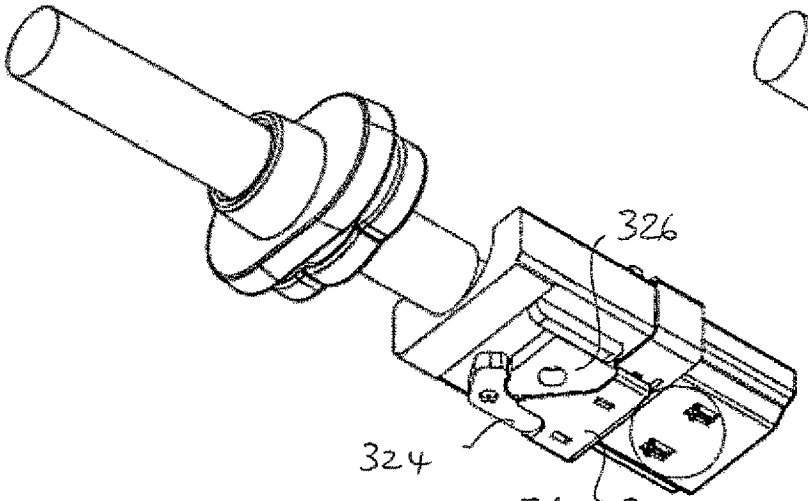
Figure 76B:
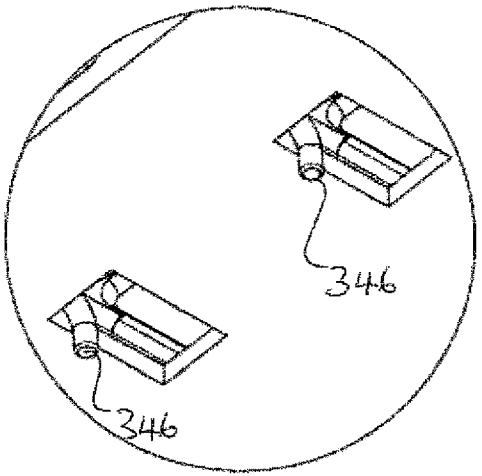
Figure 77A:
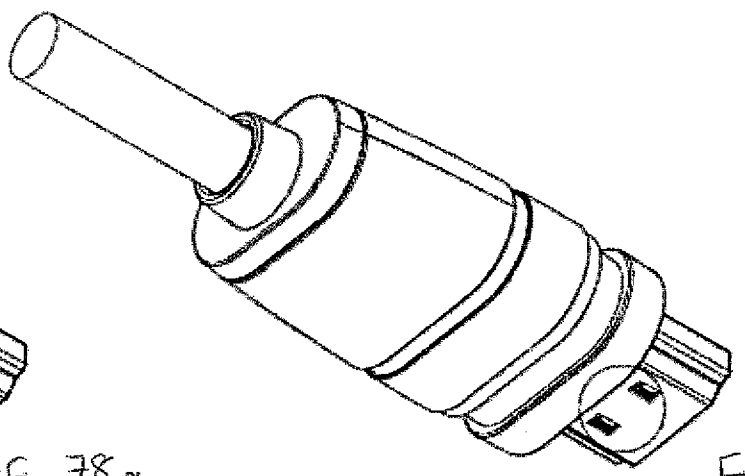
Figure 77B:
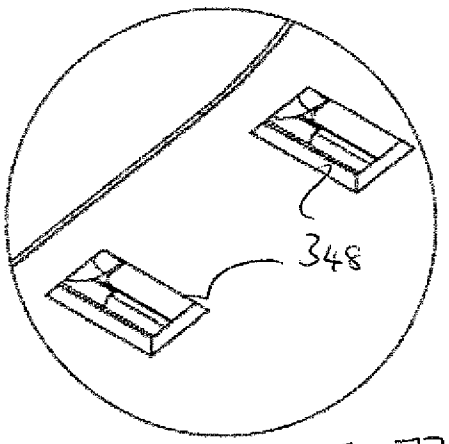
Figure 78A:
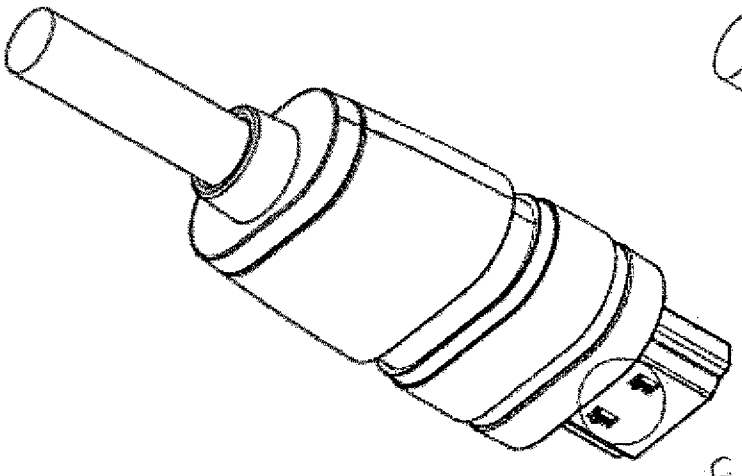
Figure 78B:
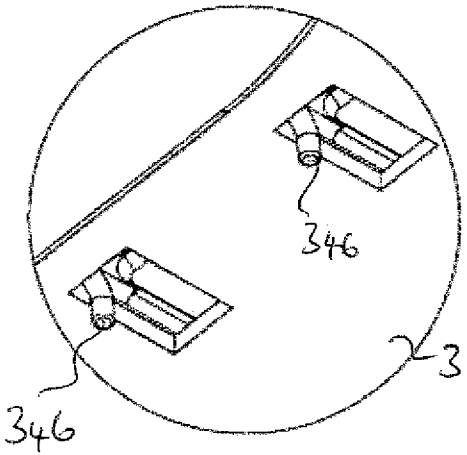
Figure 79B:
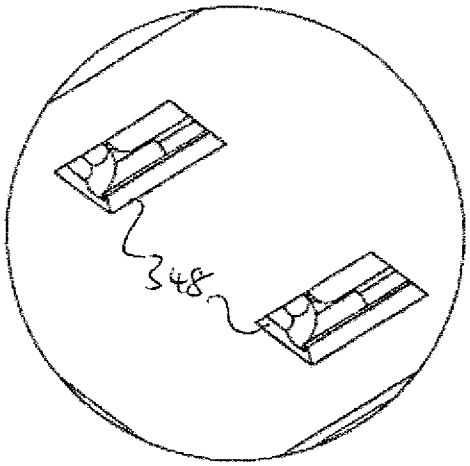
Figure 79A:
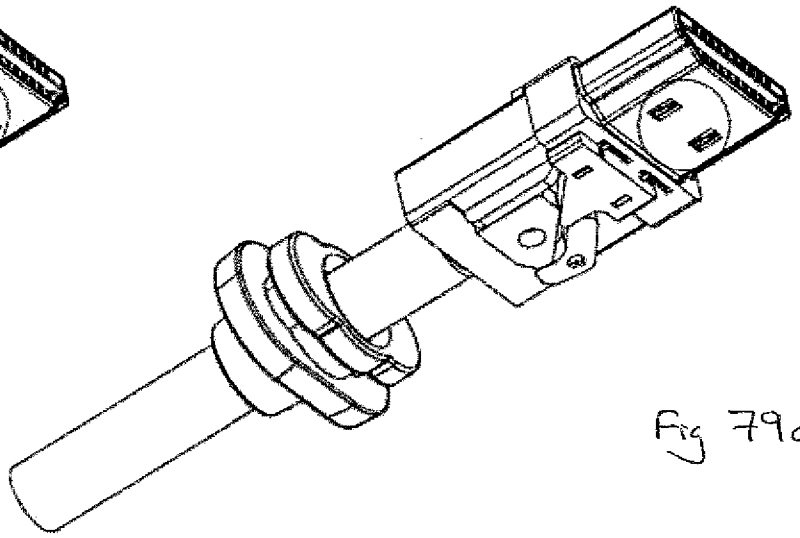
Figure 80B:
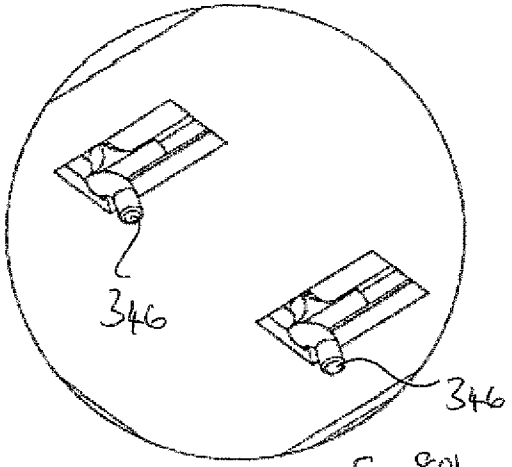
Figure 80A:
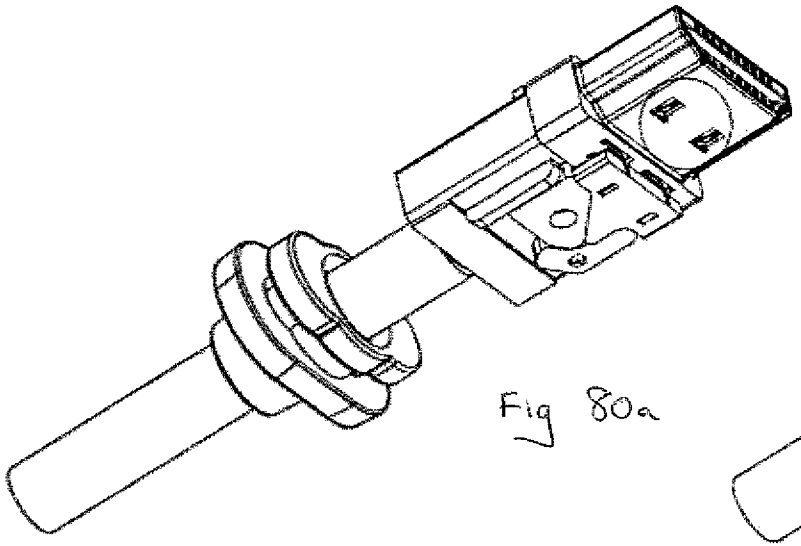
Figure 81A:
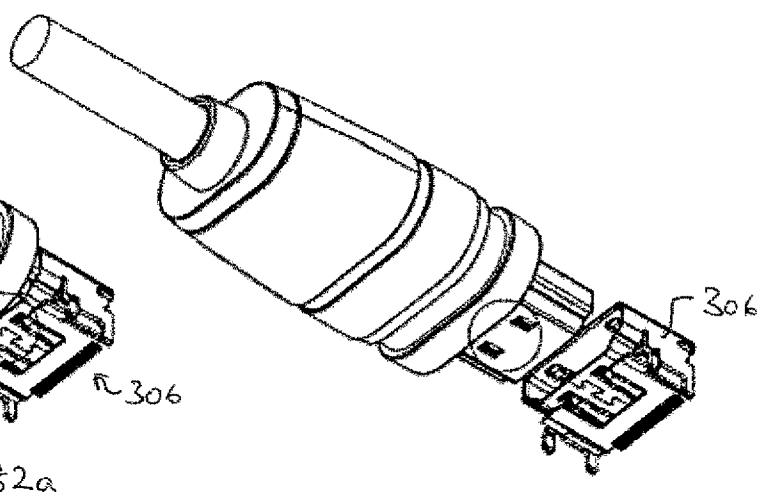
Figure 81B:
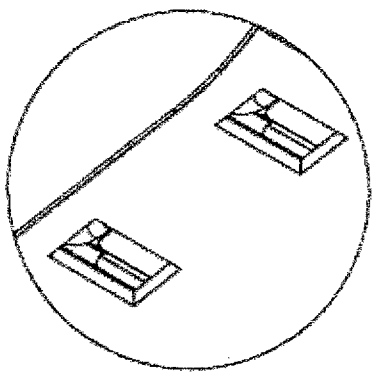
Figure 82A:
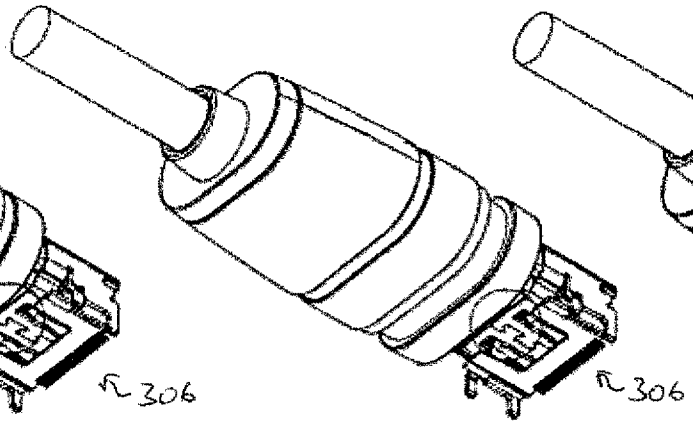
Figure 82B:
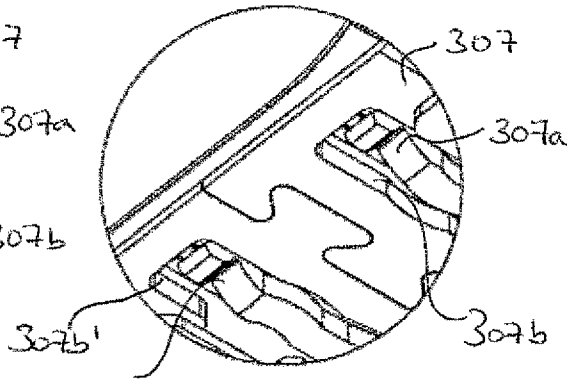
Figure 83A:
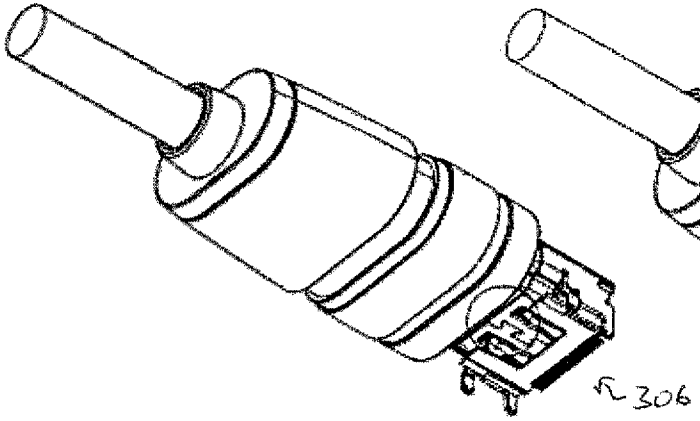
Figure 83B:
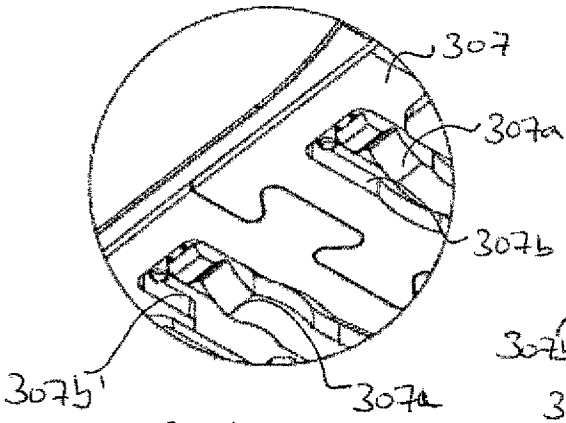
Figure 84A:
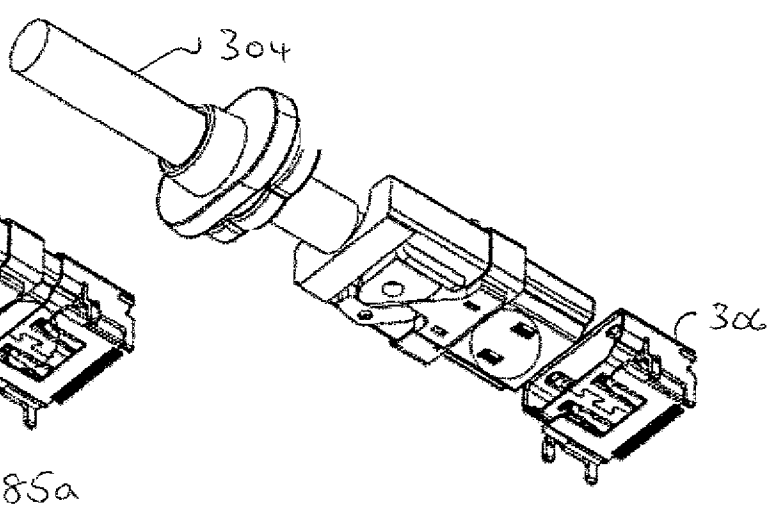
Figure 84B:
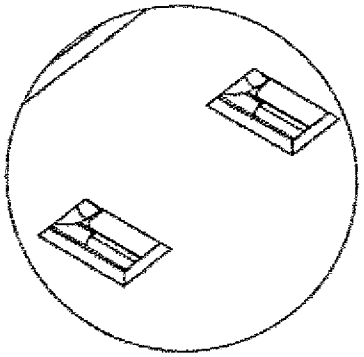
Figure 85A:
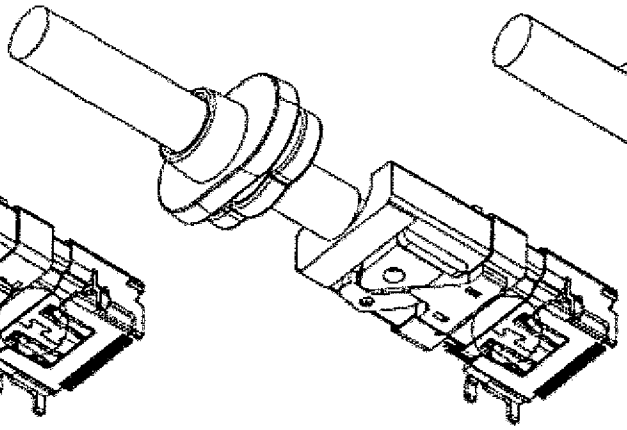
Figure 85B:
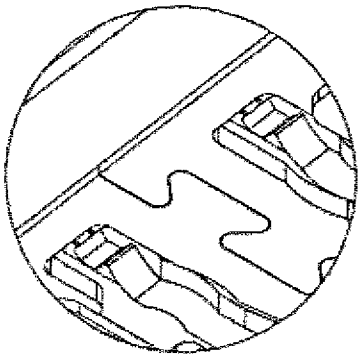
Figure 86A:
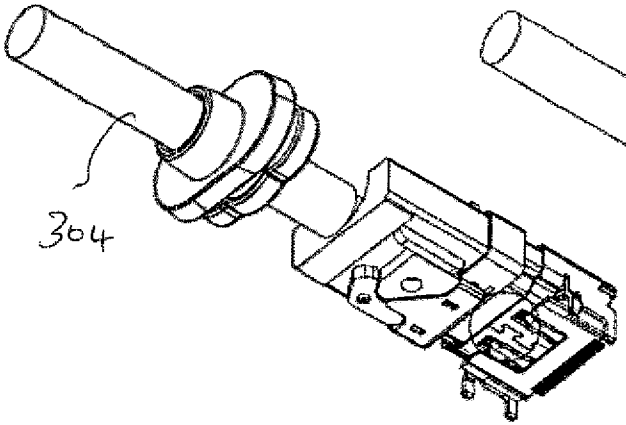
Figure 86B:
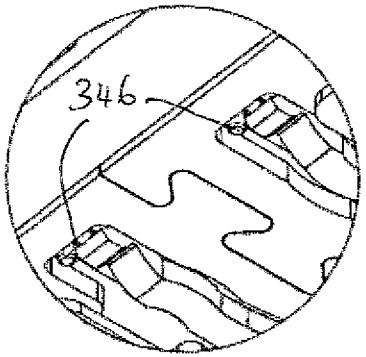
Figures 87A, 87B, 88A, 88B, 89A, 89B:
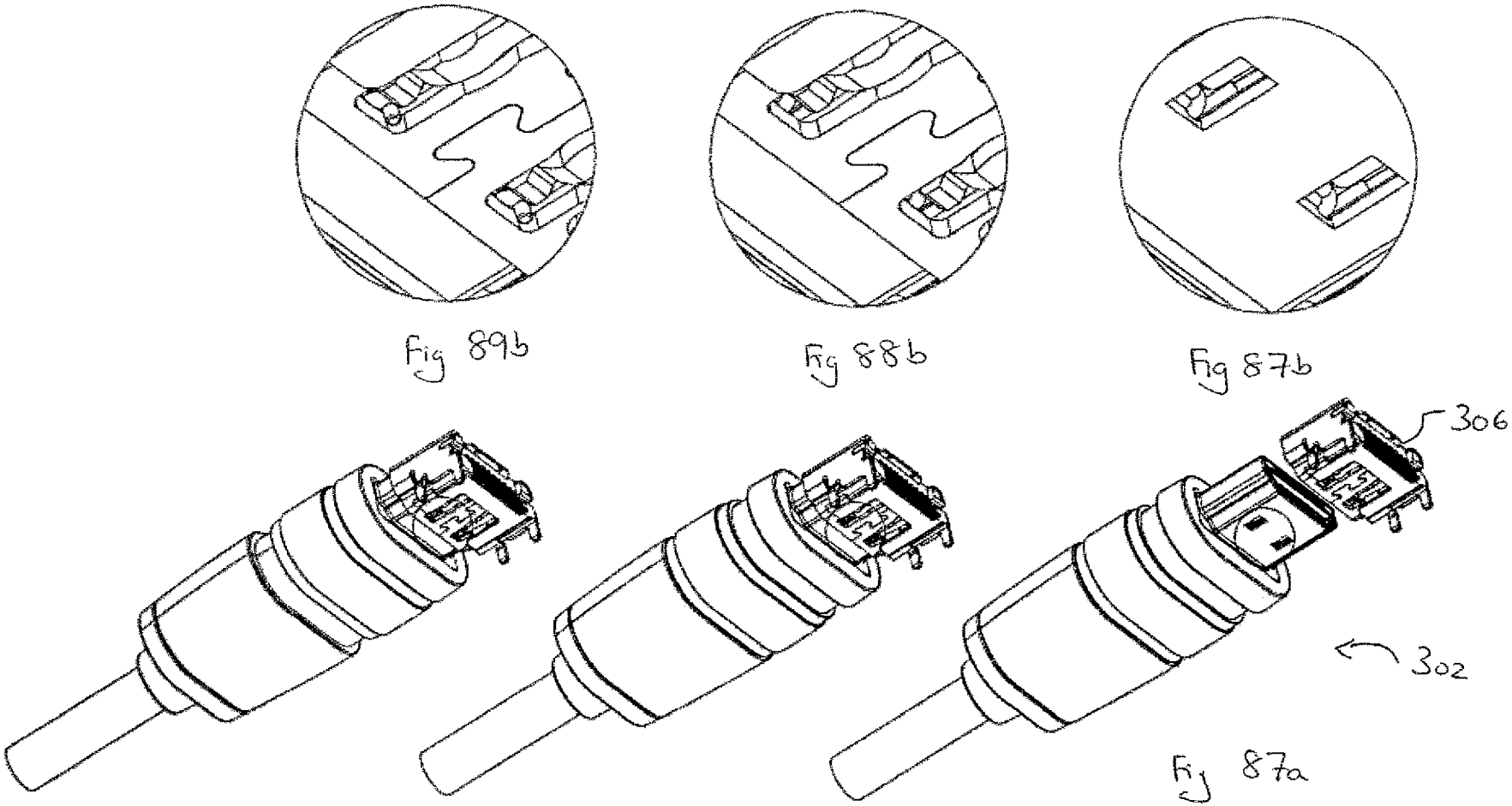
Figures 90A, 90B, 91A, 91B, 92A, 92B:
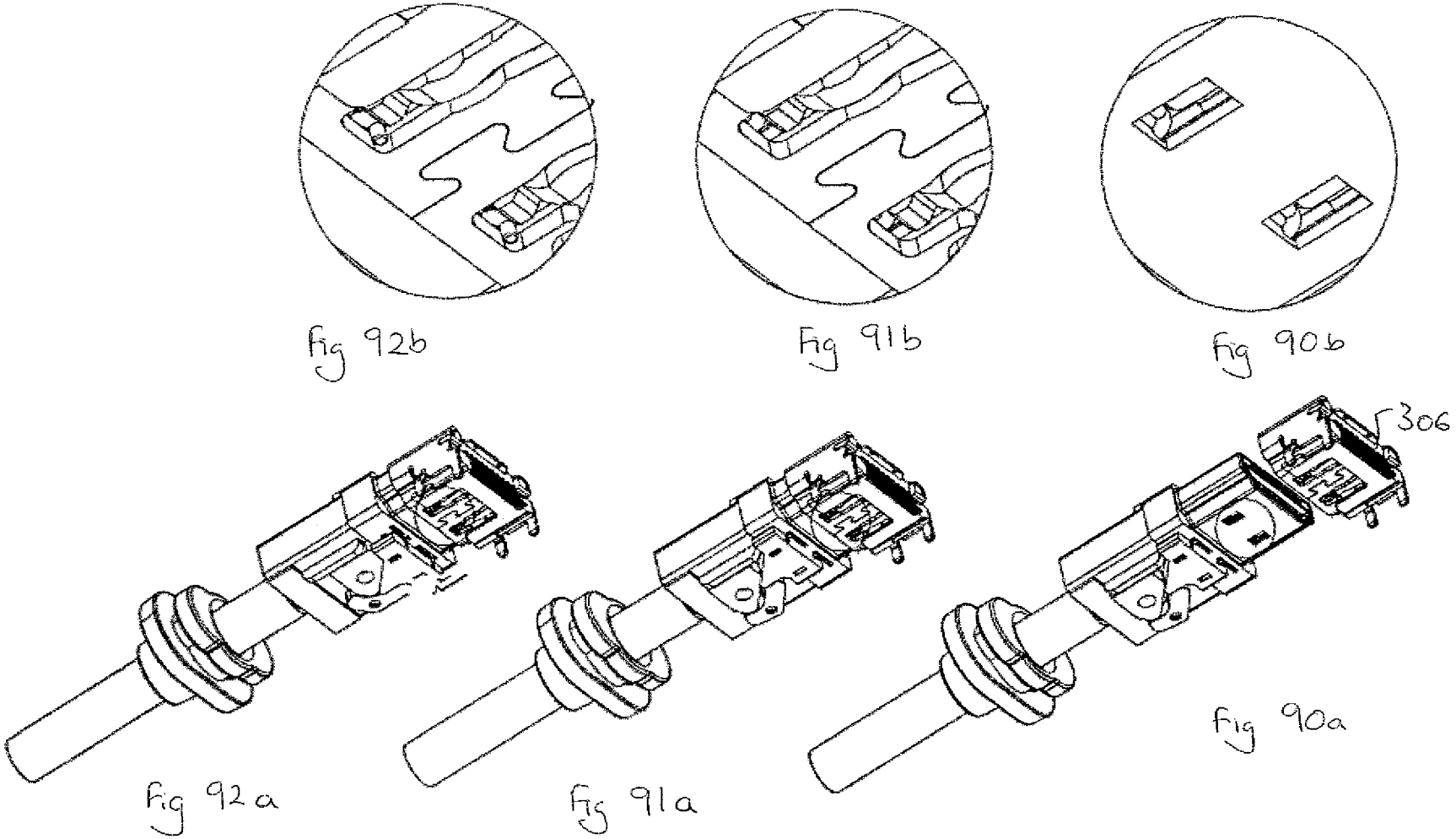
Figure 93B:
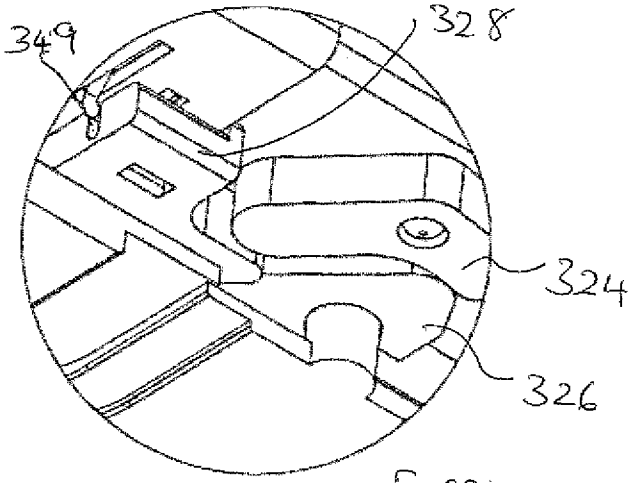
Figure 93A:
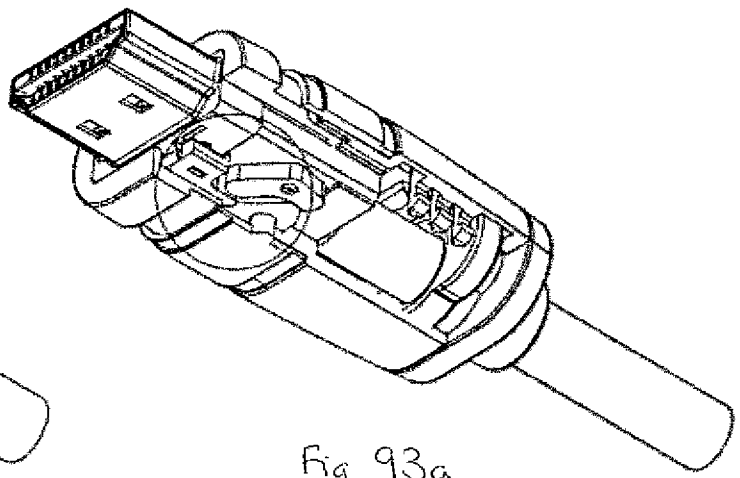
Figure 94B:
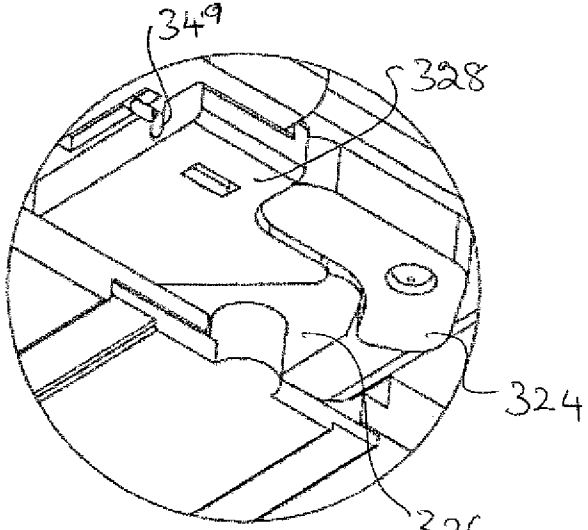
Figure 94A:
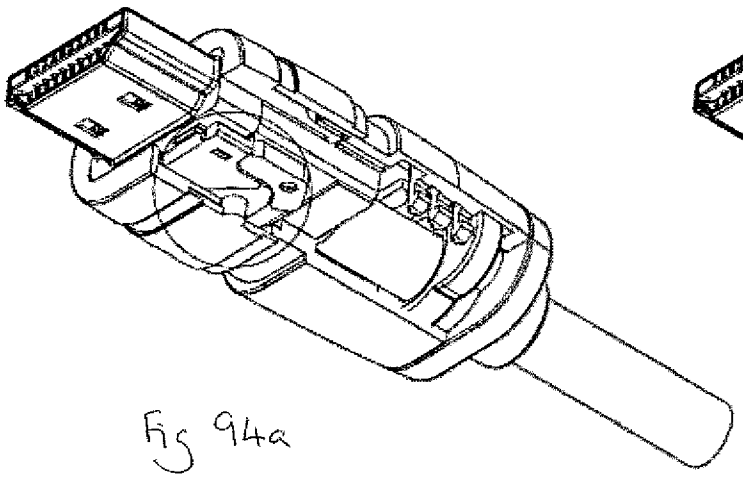

Rotation of each pivoting pin 330 causes the connected locking arm 346 to pivot through an angle of approximately 90° between an unlocked position shown for example in FIGS. 72, 73, 75, and 77 (etc.) and a locked position shown for example in FIGS. 74, 76, 80 (etc.). When each locking arm 346 is in the unlocked position it extends parallel to the upper surface of the connector block 310 and is accommodated within a transverse portion of the respective groove 310". It does not protrude from the respective locking hole 348 and so does not interfere with insertion or removal of the plug 302 to or from the receptacle 306. The pins 330 are parallel to each other and move in unison as a pair.

When each locking arm 346 is in the locked position it extends substantially perpendicular to the upper surface of the connector block 310 and protrudes through the respective locking hole 348 into the respective aperture 307*b* that surrounds the spring detent 307*a* in the receptacle 306. This can be seen most clearly in FIGS. 83*b*, 86*b*, 89*b* and 92*b*. When each locking arm 346 is in the locked position it engages the front edge of the respective aperture 307*b* and prevents the plug 302 from being withdrawn from the receptacle 306.

The locking mechanism 322 is actuated by sliding the sleeve 320 forwards to lock the mechanism or rearwards to unlock the mechanism. Therefore, when making a connection, the plug 302 is inserted into the receptacle 306 and the sleeve 320 is then slid forwards to lock the locking mechanism 322, providing a positive locking engagement between the plug 302 and the receptacle 306. When disconnecting the plug, the sleeve 320 is slid backwards to unlock the locking mechanism 322 and the plug 302 is then withdrawn from the receptacle 306. In line with the other embodiments, the locking mechanism uses a combination of lateral, transverse and rotational movement to lock and unlock the plug in the connector.

Various modifications of the various different locking mechanism described above are of course possible, and features of one embodiment may be combined with features of another embodiment.

For example, the locking arms 230 of the embodiment 3 may be driven via a drive mechanism of the type shown in embodiment 1, 2 or embodiment 4, and vice versa the locking pins 30, 130, 330 of embodiment 1, 2 or embodiment 4 may be driven via a drive mechanism of the type shown in embodiment 3 (with suitable modifications to the pins where necessary). Also, the locking mechanism of embodiment 1 may include two or more locking pins, and the locking mechanisms of embodiment 2, 3 or embodiment 4 may include a single locking pin or arm. Further, although the drawings illustrate only mDP, HDMI and superMHL data connectors, it should be appreciated that the mechanisms are also application to other types of data connector with suitable modifications as necessary, and with other connectors that are compatible with the superMHL standard including, for example, micro-USB, USB Type-C, HDMI Type-A and certain proprietary connectors.

The invention claimed is:

1. An electrical data connector comprising:

a plug that is configured for insertion in a longitudinal direction into a complementary receptacle, said plug including:

a connector element that is configured to be received within the receptacle and carries a plurality of electrical connectors, a body that is located externally of the receptacle when the connector element is inserted into the receptacle, a releasable locking mechanism for locking the plug positively to the receptacle to prevent unintentional removal of the plug from the receptacle, and a locking control, provided on the body, for manually actuating the locking mechanism, wherein the locking mechanism includes:

a locking element carried by the connector that is configured for movement between a locked configuration in which it protrudes from the connector element and an unlocked configuration in which it does not protrude substantially from the connector element, and a drive mechanism that connects the locking control to the locking element, whereby operation of the locking control actuates the locking element;

wherein the drive mechanism includes:

at least one longitudinal sliding element that is connected to the locking control, and at least one transverse sliding element that is connected to the locking element, wherein said longitudinal and transverse sliding elements are located in a common plane and are configured such that longitudinal movement of the longitudinal sliding element drives transverse movement of the transverse sliding element, thereby actuating the locking element.

2. An electrical data connector according to claim 1, wherein the locking element comprises at least one pin that is rotatable about a longitudinal pivot axis, said pin including a crank portion at a first end that engages the transverse sliding element and a hook portion at a second end that extends substantially perpendicular to the longitudinal pivot axis, wherein the hook portion is rotatable between a locked position in which it protrudes from the connector element and an unlocked position in which it does not protrude substantially from the connector element.

3. An electrical data connector according to claim 2, wherein the hook portion extends substantially perpendicular to the common plane when in the locked position.

4. An electrical data connector according to claim 1, wherein the locking element comprises at least one pivoting arm that is pivotable about a pivot axis that is substantially perpendicular to the longitudinal insertion direction, said arm including a first end that engages the transverse sliding element and a hook portion at a second end of the arm, wherein the hook portion is pivotable between a locked position in which it protrudes from the connector element and an unlocked position in which it does not protrude substantially from the connector element.

5. An electrical data connector according to claim 4, wherein the pivot axis of the arm is substantially perpendicular to the common plane.

6. An electrical data connector according to claim 1, wherein the drive mechanism includes a pivoting element located in the common plane and configured for rotation about a pivot axis that is substantially perpendicular to the common plane, wherein the pivoting element is configured to cooperate with the longitudinal sliding element and the transverse sliding element, whereby movement of the longitudinal sliding element in a first longitudinal direction drives movement of the transverse sliding element in a first transverse direction which drives rotation of the pivoting element in a first rotational direction, and movement of the longitudinal sliding element in a second longitudinal direction drives rotation of the pivoting element in a second rotational direction which drives movement of the transverse sliding element in a second transverse direction.

7. An electrical data connector according to claim 1, wherein the longitudinal sliding element includes first and second cam surfaces, which engage respectively first and second cam surfaces of the transverse sliding element, whereby movement of the longitudinal sliding element in a first longitudinal direction drives movement of the transverse sliding element in a first transverse direction through the first respective cam surfaces, and movement of the longitudinal sliding element in a second longitudinal direction drives movement of the transverse sliding element in a second transverse direction through the second respective cam surfaces.

8. An electrical data connector according to claim 7, wherein the locking mechanism includes a pair of transverse sliding elements, each having first and second cam surfaces, and the longitudinal sliding element has two sets of first and second cam surfaces for engagement respectively with the first and second cam surfaces of the two transverse sliding elements.

9. An electrical data connector according to claim 1, wherein the locking control is configured for sliding movement relative to the body in the longitudinal direction.

10. An electrical data connector according to claim 1, wherein the plug is an mDP plug.

11. An electrical data connector according to claim 1, wherein the plug is a superMHL plug.

12. An electrical data connector according to claim 1, wherein the plug is a HDMI plug.

13. An electrical data connector comprising:

a plug that is configured for insertion in a longitudinal direction into a complementary receptacle, said plug including:

a connector element that is configured to be received within the receptacle and carries a plurality of electrical connectors, a body that is located externally of the receptacle when the connector element is inserted into the receptacle, a releasable locking mechanism for locking the plug positively to the receptacle to prevent unintentional removal of the plug from the receptacle, and a locking control, provided on the body, for manually actuating the locking mechanism, wherein the releasable locking mechanism includes:

a locking element carried by the connector that is configured for movement between a locked configuration in which it protrudes from the connector element and an unlocked configuration in which it does not protrude substantially from the connector element;

and a drive mechanism that connects the locking control to the locking element, whereby operation of the locking control actuates the locking element;

wherein the drive mechanism includes:

at least one longitudinal sliding element that is connected to the locking control, at least one transverse sliding element that is connected to the locking element, and a pivoting element configured to cooperate with the longitudinal sliding element and the transverse sliding element, wherein said longitudinal and transverse sliding elements are located in a common plane and are configured such that longitudinal movement of the longitudinal sliding element drives transverse movement of the transverse sliding element, thereby actuating the locking element, and wherein the pivoting element is located in the common plane and configured for rotation about a pivot axis that is substantially perpendicular to the common plane, whereby movement of the longitudinal sliding element in a first longitudinal direction drives movement of the transverse sliding element in a first transverse direction which drives rotation of the pivoting element in a first rotational direction, and movement of the longitudinal sliding element in a second longitudinal direction drives rotation of the pivoting element in a second rotational direction which drives movement of the transverse sliding element in a second transverse direction.

14. An electrical data connector according to claim 13, wherein the plug is an mDP plug.

15. An electrical data connector according to claim 13, wherein the plug is a HDMI plug.

16. An electrical data connector comprising:

a plug that is configured for insertion in a longitudinal direction into a complementary receptacle, said plug including:

a connector element that is configured to be received within the receptacle and carries a plurality of electrical connectors, a body that is located externally of the receptacle when the connector element is inserted into the receptacle, a releasable locking mechanism for locking the plug positively to the receptacle to prevent unintentional removal of the plug from the receptacle, and a locking control, provided on the body, for manually actuating the locking mechanism, wherein the locking mechanism includes:

a locking element carried by the connector that is configured for movement between a locked configuration in which it protrudes from the connector element and an unlocked configuration in which it does not protrude substantially from the connector element, and a drive mechanism that connects the locking control to the locking element, whereby operation of the locking control actuates the locking element;

wherein the drive mechanism includes:

at least one longitudinal sliding element that is connected to the locking control and that includes first and second cam surfaces, and at least one transverse sliding element that is connected to the locking element and that includes first and second cam surfaces which engage respectively first and second cam surfaces of the locking element, wherein said longitudinal and transverse sliding elements are located in a common plane and are configured such that longitudinal movement of the longitudinal sliding element in a first longitudinal direction drives movement of the transverse sliding element in a first transverse direction through the first respective cam surfaces, and movement of the longitudinal sliding element in a second longitudinal direction drives movement of the transverse sliding element in a second transverse direction through the second respective cam surfaces, thereby actuating the locking element.

17. An electrical data connector according to claim 16, wherein the locking mechanism includes a pair of transverse sliding elements, each having first and second cam surfaces, and the longitudinal sliding element has two sets of first and second cam surfaces for engagement respectively with the first and second cam surfaces of the two transverse sliding elements.

18. An electrical data connector according to claim 16, wherein the plug is an mDP plug.

19. An electrical data connector according to claim 16, wherein the plug is a HDMI plug.

* * * * *